US010868374B2

(12) United States Patent
Mizusawa et al.

(10) Patent No.: US 10,868,374 B2
(45) Date of Patent: Dec. 15, 2020

(54) ELECTRIC CONNECTOR FOR CIRCUIT BOARD, AND PRODUCING METHOD FOR ELECTRIC CONNECTOR FOR CIRCUIT BOARD

(71) Applicant: HIROSE ELECTRIC CO., LTD., Tokyo (JP)

(72) Inventors: Shoichi Mizusawa, Tokyo (JP); Haruhiko Murakami, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/576,655

(22) Filed: Sep. 19, 2019

(65) Prior Publication Data

US 2020/0099148 A1 Mar. 26, 2020

(30) Foreign Application Priority Data

Sep. 25, 2018 (JP) ..... 2018-178906

(51) Int. Cl.
*H01R 12/55* (2011.01)
*H01R 12/79* (2011.01)
*H01R 12/88* (2011.01)
*H01R 13/639* (2006.01)

(52) U.S. Cl.
CPC ..... *H01R 12/55* (2013.01); *H01R 12/79* (2013.01); *H01R 12/88* (2013.01); *H01R 13/639* (2013.01)

(58) Field of Classification Search
CPC ..... H01R 12/88; H01R 12/61
USPC ..... 439/495; 29/883
See application file for complete search history.

(56) References Cited

U.S. PATENT DOCUMENTS 6,089,905 A * 7/2000 Shimmyo ..... H01R 12/79 439/260
7,128,597 B2 * 10/2006 Niitsu ..... H01R 13/6205 439/495
7,179,118 B1 * 2/2007 Harlan ..... H01R 12/774 439/260
7,887,351 B2 * 2/2011 Wang ..... H01R 12/88 439/260
8,298,001 B2 10/2012 Ashibu
10,566,721 B2 * 2/2020 Nakajima ..... H01R 12/79
(Continued)

FOREIGN PATENT DOCUMENTS

JP 2008-269984 A 11/2008
JP 4859261 B1 1/2012

OTHER PUBLICATIONS

Extended European Search Report (EESR) dated Feb. 11, 2020, for the corresponding European Patent Application No. 19199310.4.

*Primary Examiner* — Neil Abrams
(74) *Attorney, Agent, or Firm* — Rankin, Hill & Clark LLP

(57) ABSTRACT

An electric connector for a circuit board includes a housing including a reception part, a plurality of metal members, and a movable member that is movable relative to the housing. The movable member includes a movement restricted part. The metal members include a rolled surface that is parallel to a connector width direction and an exposed part that is exposed from the housing. The rolled surface of the exposed part faces the movement restricted part and the exposed part includes a movement restricting part that restricts movement of the movement restricted part. The connector includes a housing part for housing the movement restricted part and the movement restricting part.

17 Claims, 24 Drawing Sheets

(56) References Cited

U.S. PATENT DOCUMENTS

| | | | | |
|---|---|---|---|---|
| 2002/0106924 | A1* | 8/2002 | Uehara | H01R 12/82<br>439/260 |
| 2006/0292911 | A1* | 12/2006 | Ning | H01R 12/79<br>439/260 |
| 2012/0171890 | A1 | 7/2012 | Kurachi | |
| 2017/0062962 | A1 | 3/2017 | Tagami et al. | |
| 2017/0331206 | A1 | 11/2017 | Manba | |
| 2020/0099148 | A1* | 3/2020 | Mizusawa | H01R 12/55 |

* cited by examiner

ELECTRIC CONNECTOR FOR CIRCUIT BOARD, AND PRODUCING METHOD FOR ELECTRIC CONNECTOR FOR CIRCUIT BOARD

CROSS-REFERENCE TO RELATED APPLICATION

This application claims priority from Japanese Patent Application No. 2018-178906 filed with the Japan Patent Office on Sep. 25, 2018, the entire content of which is hereby incorporated by reference.

BACKGROUND

1. Technical Field

Embodiments of the present disclosure relate to an electric connector for a circuit board and a producing method for the electric connector for a circuit board.

2. Related Art

As an electric connector for a circuit board that is mounted on a mount surface of a circuit board and has a flat conductor removably connected thereto, the following connector has been known. This connector includes a movable member that is movable relative to a housing between a first position where the removal of the flat conductor is inhibited and a second position where the removal of the flat conductor is allowed. In the connector with such a movable member, the housing keeping a terminal and the movable member are separate members. Therefore, in the production of this connector, usually, the housing and the movable member are molded in different steps and then, the housing and the movable member are assembled together. Thus, the molding of the housing, the molding of the movable member, and the assembling of the housing and the movable member are performed in separate steps. As a result, the production of the connector requires a number of steps and is complicated, and additionally, the production cost is high.

Japanese Patent No. 4859261 has disclosed a connector whose movable member and housing can be molded and produced at the same time. This connector includes a plurality of terminals (contacts) obtained by bending a metal piece with a belt shape into an approximately lateral U shape, a movable member (actuator) holding one end side part of the terminal by integral molding, and a housing holding the other end side part of the terminal by integral molding, i.e., by insert molding. The movable member and the housing are coupled together through the terminal.

In the production of this connector, one end side part of the metal piece with the belt shape, which is before the bending, is held by the movable member by the integral molding with the movable member. Additionally, the other end side part of the metal piece with the belt shape is held by the housing by the integral molding. After that, an intermediate part of the metal piece with the belt shape (part not held by the movable member or the housing) is bent in a plate thickness direction. Thus, the connector is produced. Therefore, in the production of the connector according to Japanese Patent No. 4859261, performing the molding of the movable member and the molding of the housing at the same time eliminates one molding step and also eliminates the step of assembling the housing and the movable member; thus, the producing work is simplified.

SUMMARY

An electric connector for a circuit board, including: a housing including a reception part corresponding to a space that is open so that a flat conductor to be removably connected to the electric connector for a circuit board in a front-rear direction can be inserted in the space toward front; a plurality of metal members that are held by the housing by integral molding; and a movable member that is movable relative to the housing, wherein: the movable member is movable between a first position and a second position; the movable member includes a movement restricted part whose movement in a direction perpendicular to a connector width direction that corresponds to a width direction of the flat conductor is restricted; the metal members include a plurality of terminals used to connect to the flat conductor; at least a part of the metal members is formed of a rolled metal plate, includes a rolled surface that is parallel to the connector width direction, and includes an exposed part that is exposed from the housing more than the movement restricted part in a range including the movement restricted part in the front-rear direction at a position corresponding to the movement restricted part in the connector width direction, the rolled surface of the exposed part faces the movement restricted part, and the exposed part includes a movement restricting part that restricts movement of the movement restricted part over a predetermined amount; the electric connector for a circuit board includes a housing part corresponding to a space for housing at least a part of the movement restricted part and at least a part of the movement restricting part in a range corresponding to the movement restricted part and the movement restricting part in the connector width direction; and the housing part is formed in at least one of a penetration space that penetrates the housing in a restricted direction corresponding to a direction where the movement of the movement restricted part is restricted by the movement restricting part and a space that communicates with the penetration space in the restricted direction outside the housing.

BRIEF DESCRIPTION OF THE DRAWINGS

FIG. 2A and FIG. 2B are perspective views illustrating the electric connector for a circuit board illustrated in FIG. 1 with a movable member at an open position, in which FIG. 2A is the perspective view of the connector viewed from the rear and FIG. 2B is the perspective view of the connector viewed from the front;

FIG. 3A and FIG. 3B are perspective views illustrating the electric connector for a circuit board illustrated in FIG. 2A and FIG. 2B with the movable member separated upward, in which FIG. 3A is the perspective view of the connector viewed from the rear and FIG. 3B is the perspective view of the connector viewed from the front;

FIG. 6A and FIG. 6B are longitudinal cross-sectional views of the electric connector for a circuit board illustrated in FIG. 2A and FIG. 2B at a position of the metal part in the connector width direction, in which FIG. 6A illustrates a state in which a die is released and FIG. 6B illustrates a state in which the die is disposed in integral molding;

FIG. 7A and FIG. 7B are longitudinal cross-sectional views of the electric connector for a circuit board illustrated in FIG. 2A and FIG. 2B at a position of an engaging part of the movable member in the connector width direction, in which FIG. 7A illustrates a state in which the die is released and FIG. 7B illustrates a state in which the die is disposed in the integral molding;

FIG. 8A, FIG. 8B, and FIG. 8C are longitudinal cross-sectional views of the electric connector for a circuit board according to the first embodiment just before the flat conductor is inserted, in which FIG. 8A illustrates the cross section at the position of the first terminal, FIG. 8B illustrates the cross section at the position of the second terminal, and FIG. 8C illustrates the cross section at the position of the engaging part of the movable member;

FIG. 9A, FIG. 9B, and FIG. 9C are longitudinal cross-sectional views of the electric connector for a circuit board according to the first embodiment after the flat conductor is inserted, in which FIG. 9A illustrates the cross section at the position of the first terminal, FIG. 9B illustrates the cross section at the position of the second terminal, and FIG. 9C illustrates the cross section at the position of the engaging part of the movable member;

FIG. 10A, FIG. 10B, and FIG. 10C are longitudinal cross-sectional views of the electric connector for a circuit board according to the first embodiment just before the flat conductor is removed, in which FIG. 10A illustrates the cross section at the position of the first terminal, FIG. 10B illustrates the cross section at the position of the second terminal, and FIG. 10C illustrates the cross section at the position of the engaging part of the movable member;

FIG. 12A and FIG. 12B are perspective views of the electric connector for a circuit board illustrated in FIG. 11 with the movable member at the open position, in which FIG. 12A is the perspective view of the connector viewed from the rear and FIG. 12B is the perspective view of the connector viewed from the front;

FIG. 13A and FIG. 13B are perspective views of the electric connector for a circuit board illustrated in FIG. 12A and FIG. 12B with the movable member separated upward, in which FIG. 13A is the perspective view of the connector viewed from the rear and FIG. 13B is the perspective view of the connector viewed from the front;

FIG. 16A and FIG. 16B are longitudinal cross-sectional views illustrating the electric connector for a circuit board illustrated in FIG. 12A and FIG. 12B at the position of the first metal part in the connector width direction, in which FIG. 16A illustrates a state in which the die is released and FIG. 16B illustrates a state in which the die is disposed in integral molding;

FIG. 17A and FIG. 17B are longitudinal cross-sectional views illustrating the electric connector for a circuit board illustrated in FIG. 12A and FIG. 12B at the position of the second metal part in the connector width direction, in which FIG. 17A illustrates a state in which the die is released and FIG. 17B illustrates a state in which the die is disposed in integral molding;

FIG. 18A and FIG. 18B are longitudinal cross-sectional views illustrating the electric connector for a circuit board according to the second embodiment just before the flat conductor is inserted, in which FIG. 18A illustrates the cross section at the position of the first metal part and FIG. 18B illustrates the cross section at the position of the engaging part of the movable member;

FIG. 19A and FIG. 19B are longitudinal cross-sectional views of the electric connector for a circuit board according to the second embodiment after the flat conductor is inserted, in which FIG. 19A illustrates the cross section at the position of the first metal part and FIG. 19B illustrates the cross section at the position of the engaging part of the movable member;

FIG. 20A and FIG. 20B are longitudinal cross-sectional views of the electric connector for a circuit board according to the second embodiment after connection with the flat conductor is completed, in which FIG. 20A illustrates the cross section at the position of the first metal part and FIG. 20B illustrates the cross section at the position of the engaging part of the movable member;

FIG. 23A and FIG. 23B are longitudinal cross-sectional views illustrating the electric connector for a circuit board illustrated in FIG. 21 at the position of the terminal in the connector width direction, in which FIG. 23A illustrates a state in which the die is released and FIG. 23B illustrates a state in which the die is disposed in integral molding; and FIG. 24A and FIG. 24B are longitudinal cross-sectional views illustrating the electric connector for a circuit board illustrated in FIG. 21 at the position of the metal part in the connector width direction, in which FIG. 24A illustrates a state in which the die is released and FIG. 24B illustrates a state in which the die is disposed in integral molding.

DETAILED DESCRIPTION

Figure 1:
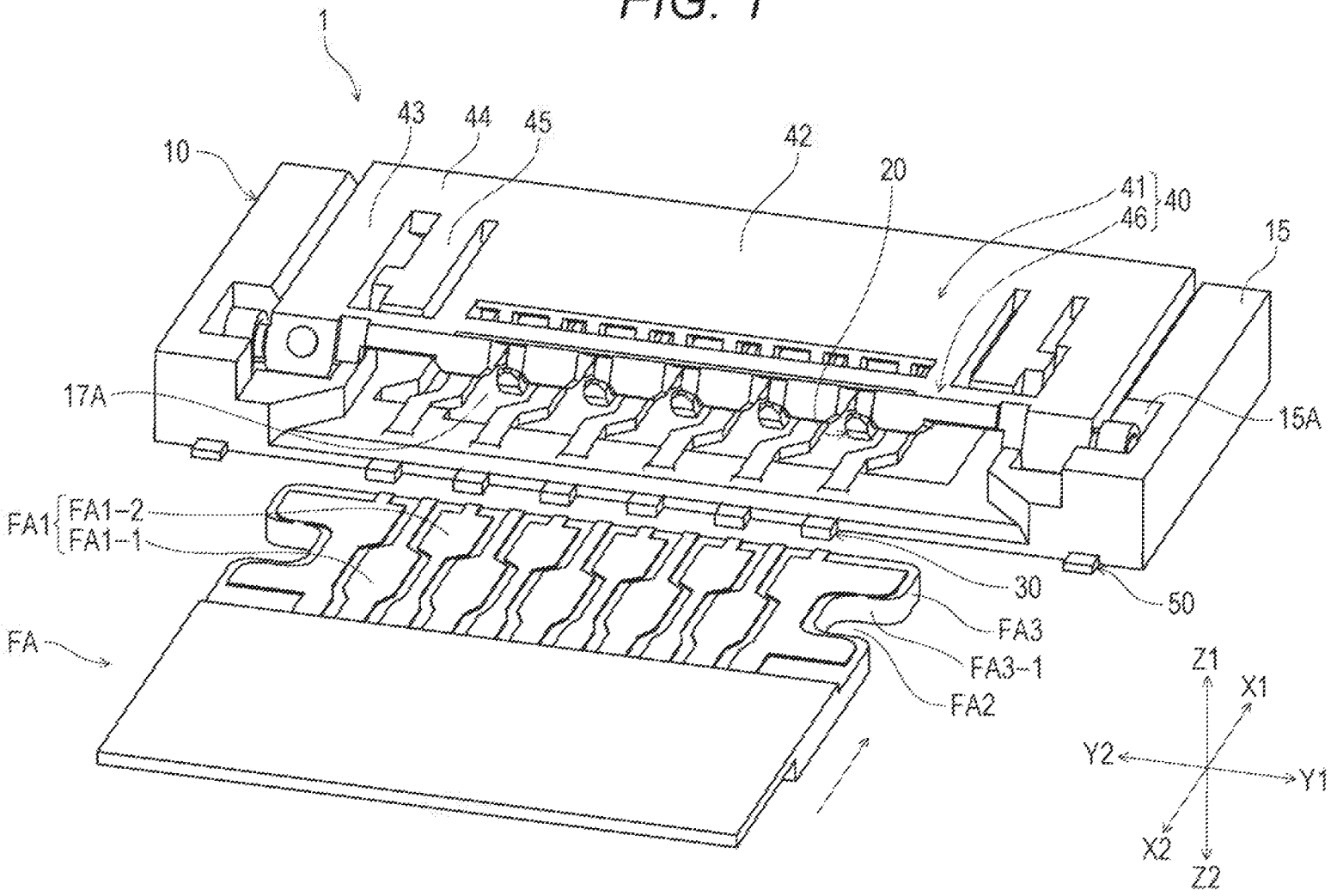
FIG. 1 is a perspective view illustrating a flat conductor and an electric connector for a circuit board according to a first embodiment of the present disclosure in a state just before the flat conductor is inserted.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the connector according to Japanese Patent No. 4859261, if the molding of the movable member and the molding of the housing are performed in the same step, it is later necessary to bend the metal piece with the belt shape and as a result, the number of steps increases.

It is an object of the present disclosure to provide an electric connector for a circuit board, and a producing method for this electric connector for a circuit board as below. In the electric connector for a circuit board, it is unnecessary to, after a terminal is molded integrally, i.e., after insert molding, with a housing and a movable member, process another member, and as a whole, the electric connector for a circuit board can be produced with fewer steps.

An electric connector for a circuit board according to a first aspect of the present disclosure, and a producing method for this electric connector for a circuit board according to a second aspect of the present disclosure are described.

(First Aspect)

An electric connector for a circuit board (the present connector) according to a first embodiment, includes: a housing including a reception part corresponding to a space that is open so that a flat conductor to be removably connected to the electric connector for a circuit board in a front-rear direction can be inserted in the space toward front; a plurality of metal members that are held by the housing by integral molding; and a movable member that is movable relative to the housing, wherein: the movable member is movable between a first position and a second position.

In the present connector, the movable member includes a movement restricted part whose movement in a direction perpendicular to a connector width direction that corresponds to a width direction of the flat conductor is restricted; the metal members include a plurality of terminals used to connect to the flat conductor; at least a part of the metal members is formed of a rolled metal plate, includes a rolled surface that is parallel to the connector width direction, and includes an exposed part that is exposed from the housing more than the movement restricted part in a range including the movement restricted part in the front-rear direction at a position corresponding to the movement restricted part in the connector width direction, the rolled surface of the exposed part faces the movement restricted part, and the exposed part includes a movement restricting part that restricts movement of the movement restricted part over a predetermined amount; the electric connector for a circuit board includes a housing part corresponding to a space for housing at least a part of the movement restricted part and at least a part of the movement restricting part in a range corresponding to the movement restricted part and the movement restricting part in the connector width direction; and the housing part is formed in at least one of a penetration space that penetrates the housing in a restricted direction corresponding to a direction where the movement of the movement restricted part is restricted by the movement restricting part and a space that communicates with the penetration space in the restricted direction outside the housing.

The present connector with the aforementioned structure can be produced in accordance with the following procedure. First, a plurality of the metal members are disposed in a die with a rolled surface of the metal member extended along a connector width direction. One part of the metal members is held by the die, while another part of the metal members is exposed within the die. Next, a melted electrically insulating material is injected into the die and then solidified. With a part of the metal members exposed, another part of the metal member is held by the housing by the integral molding. As a result, by the exposed part of the metal member, the movement restricting part is formed. In addition, in a part of the movable member, the movement restricted part is formed in a surface contact with the rolled surface of the movement restricting part. After the die is released, the movable member is moved between the first position and the second position. Thus, the movement restricted part of the movable member can be separated from the movement restricting part of the metal member, so as to be made movable. Thus, the electric connector for a circuit board is completed and becomes usable.

Thus, the present connector can be produced by integrally molding the metal member at the same time as the housing and the movable member, and moving the movable member between the first position and the second position. Thus, it is unnecessary to process the component of the connector at all after the integral molding. The present connector can be produced easily with fewer steps.

In the present connector, the movable member may be movable with rotation around a rotation axial line extended in the connector width direction between the first position and the second position, the movable member may include a rotation base part in a part including the rotation axial line, the rotation base part including a rotation shaft part, and the movement restricted part may be provided to the rotation shaft part. By this structure, the rolled surface of the movement restricting part of the metal member faces the movement restricted part provided to the rotation shaft part and restricts the movement of the rotation shaft part or the movable member over a predetermined amount.

In the present connector, the rolled surface of the movement restricting part of the metal member may have a shape extended along a peripheral surface of the rotation shaft part of the movable member and be in contact with the peripheral surface, and the movement restricting part may be able to guide rotation of the rotation shaft part. In this manner, the movement restricting part of the metal member has the function as the guiding part that guides the rotation of the rotation shaft part; therefore, it is unnecessary to provide the guiding part additionally.

In the present connector, the rotation shaft part of the movable member may include a large diameter part including a curved surface with an arc-like shape in a part of the rotation shaft part in a circumferential direction, and may include a small diameter part including a curved surface with an arc-like shape that is smaller in diameter than the large diameter part in another part in the circumferential direction, and the movement restricting part of the metal member may be curved with an arc-like shape along the curved surface of the large diameter part.

In the present connector, when the rotation shaft part is molded by the integral molding, one die is disposed on the rotation shaft part side relative to the movement restricting part in a direction perpendicular to the connector width direction. The other die is disposed on the opposite side. If the rotation shaft part keeps the equal diameter along the entire circumference, a part positioned in a space between the rolled surface of the movement restricting part and the outer peripheral surface of the rotation shaft part is formed at an end part of the one die. Therefore, the end part is thin and easily damaged. In the above structure, the present connector includes the large diameter part and the small diameter part in the rotation shaft part. Therefore, when the rotation shaft part is molded, the end part of the die is formed at the position corresponding to a step part formed at the border between the large diameter part and the small diameter part. The step part is formed so as to have the dimension corresponding to the difference between the large diameter part and the small diameter part in the radial direction of the rotation shaft part. Therefore, the end part of the die is also formed so as to have the corresponding thickness. Accordingly, the strength in accordance with the thickness of the end part of the die can be secured and the damage at the end part of the die can be suppressed.

In the present connector, the movable member may be movable along any one of an insertion/removal direction of the flat conductor, the connector width direction, and a connector thickness direction corresponding to a direction perpendicular to the front-rear direction and the connector width direction between the first position and the second position. In this manner, the movable member may be a slidable member that can move along a predetermined one direction.

In the present connector, the movement restricting part of the metal member may have a belt-like plate shape that is extended in a direction where opposite inner wall surfaces face each other in one direction in a plane perpendicular to the connector width direction in the housing part, and the metal member may be held by the housing at a position near both ends of the movement restricting part in the direction where the movement restricting part is extended. In this manner, the metal member is held by the housing at the position near both ends of the movement restricting part; therefore, the movement restricting part has a double fixed beam shape. As a result, when the movement of the movement restricted part of the movable member is restricted by the movement restricting part, the movement restricting part can resist with enough strength against the contact force from the movement restricted part.

In the present connector, the movable member may include an engaging part for inhibiting removal of the flat conductor, and the engaging part may include, in a rear part thereof, a guiding surface for guiding the flat conductor to the front in a process of inserting the flat conductor with the movable member present at the first position, and also include, in a front part thereof, an engaging surface that can be engaged with an engaged part provided to the flat conductor from the rear after the flat conductor is inserted, and the guiding surface may be extended to the connector thickness direction when viewed in the connector width direction with the movable member present at the second position. In this configuration, the guiding surface is extended to the connector thickness direction with the movable member present at the second position. Therefore, after the integral molding, the die can be released in the connector thickness direction along the guiding surface. Thus, the present connector can be produced using the die with a simple shape.

In the present connector, the terminal may include a contact arm part that is extended to the rear, the contact arm part including a contact part that is formed at a rear end part thereof and that can be in contact with the flat conductor, the rotation base part of the movable member may be positioned behind the contact part when viewed in the connector width direction, and the rotation base part of the movable member may include a groove part for housing a rear end of at least a part of the terminals at a position corresponding to the contact arm part of the terminal in the connector width direction. In this configuration, the rear end of the terminal is housed in the groove part of the rotation base part of the rotation member. Thus, the flat conductor is less easily brought into contact with the rear end of the terminal in the process of inserting the flat conductor into the present connector. As a result, the damage of the terminal due to buckling or the like can be suppressed.

In the present connector, the terminals may include a first terminal and a second terminal with different shapes to each other, the first terminal may have its rear end housed in the groove part of the movable member, and a second contact arm part corresponding to the contact arm part of the second terminal may have its rear end positioned ahead of a rear end of a first contact arm part corresponding to the contact arm part of the first terminal, the rear end of the second contact arm part being positioned in a range of the first contact arm part in the connector thickness direction. In this configuration, the rear end of the first terminal is housed in the groove part of the rotation base part of the rotation member. In addition, the rear end of the second terminal is positioned in the range of the first contact arm part in the connector thickness direction. Thus, the flat conductor is less easily brought into contact with the rear end of both the first terminal and the second terminal in the process of inserting the flat conductor into the connector. As a result, the damage of the terminals due to buckling or the like can be suppressed.

In the present connector, at least a part of the terminals may include a held arm part that is held by the housing and that is extended to the rear along the contact arm part in a range including the rear end of the contact arm part in the front-rear direction, the held arm part may be positioned displaced in the connector width direction from the groove part in the range including the groove part of the movable member in the front-rear direction, and in the housing, a space that penetrates in the connector thickness direction in the range including the groove part may be formed at a wall part that is positioned opposite to the contact arm part with respect to the held arm part in the connector thickness direction.

In this configuration, the held arm part of the terminal is positioned displaced in the connector width direction from the groove part of the movable member. In addition, the wall part of the housing includes the space in the range including the groove part. Thus, in the production of the connector, with the terminals disposed in the die, a part of the die can be disposed at a position corresponding to the groove part of the movable member through the space of the wall part in the connector thickness direction while the interference with the held arm part is suppressed. Therefore, the groove part can be formed easily by the die.

In the present connector, at least a part of the terminals may include a held arm part that is held by the housing and that is extended to the rear along the contact arm part in a range including the contact part of the contact arm part in the front-rear direction, the held arm part may be positioned displaced in the connector width direction from the contact part in the range including the contact part in the front-rear direction, and in the housing, a space that penetrates in the connector thickness direction in the range including the contact part may be formed at a wall part that is positioned opposite to the contact arm part with respect to the held arm part in the connector thickness direction.

In this configuration, the held arm part of the terminal is positioned displaced from the contact part of the terminal. Moreover, the wall part of the housing includes the space in the range including the contact part. Thus, in a case of plating the contact part in the production of the connector, the contact part can be plated easily through the space.

In the present connector, the movable member may be movable with rotation around a rotation axial line extended in the connector width direction between the first position and the second position, the movable member may include a rotation base part in a part including the rotation axial line, the rotation base part including a rotation shaft part, the metal members may include a plurality of metal parts in addition to the terminals, the terminals may be arranged in the connector width direction, the metal parts may include a first metal part that is positioned in a range where the terminals are arranged in the connector width direction, the rotation shaft part of the movable member may include a first shaft part corresponding to the movement restricted part that is provided at a position corresponding to the first metal part in the connector width direction, and a first metal part side restricting part corresponding to the movement restricting part of the first metal part may be positioned on one side with respect to the first shaft part of the movable member in the connector thickness direction.

In this configuration, the first metal part side restricting part is positioned on one side with respect to the first shaft part. Thus, the movement of the movable member over a predetermined amount toward one side in the connector thickness direction can be restricted.

In the present connector, the metal parts may include, in addition to the first metal part, a second metal part positioned outside the range where the terminals are arranged, the rotation shaft part of the movable member may include, in addition to the first shaft part, a second shaft part corresponding to the movement restricted part that is provided at a position corresponding to the second metal part in the connector width direction, and a second metal part side restricting part corresponding to the movement restricting part of the second metal part may be positioned on the other side with respect to the second shaft part of the movable member in the connector thickness direction.

In this configuration, the first metal part side restricting part is positioned on one side with respect to the first shaft part. In addition, the second metal part side restricting part is positioned on the other side with respect to the second shaft part. Thus, the movement of the movable member over a predetermined amount toward one side or the other side in the connector thickness direction can be restricted.

In the present connector, a penetration allowing part that allows penetration of the first metal part side restricting part of the first metal part may be formed at a position corresponding to the first shaft part in the connector width direction in the rotation base part of the movable member, and the first metal part side restricting part may be penetrated into the penetration allowing part, the first metal part side restricting part may include a free end part positioned outside the penetration allowing part, the free end part may include a protrusion protruding to the connector width direction, and the first metal part side restricting part may be configured to be engaged with the rotation base part with the protrusion. In this configuration, the first metal part side restricting part held by the housing is engaged with the rotation base part by the protrusion. Thus, the movable member is disconnected from the housing less easily.

In the present connector, the movable member may be movable with rotation around a rotation axial line extended in the connector width direction between the first position and the second position, the movable member may include a rotation base part in a part including a rotation axial line, the rotation base part including a rotation shaft part, the terminals may be arranged in the connector width direction, the rotation shaft part of the movable member may include a first shaft part corresponding to the movement restricted part that is provided at a position corresponding to the terminal in the connector width direction, and a terminal side restricting part corresponding to the movement restricting part of the terminal may be positioned on one side with respect to the first shaft part of the movable member in the connector thickness direction.

In this configuration, the terminal side restricting part is positioned on one side with respect to the first shaft part. Thus, the movement of the movable member over a predetermined amount toward one side in the connector thickness direction can be restricted.

In the present connector, the metal members may include, in addition to the terminals, a plurality of metal parts positioned outside the range where the terminals are arranged in the connector width direction, the rotation shaft part of the movable member may include, in addition to the first shaft part, a second shaft part corresponding to the movement restricted part that is provided at a position corresponding to the metal part in the connector width direction, and a metal part side restricting part corresponding to the movement restricting part of the metal part may be positioned on the other side with respect to the second shaft part of the movable member in the connector thickness direction.

In this configuration, the terminal side restricting part is positioned on one side with respect to the first shaft part. In addition, the metal part side restricting part is positioned on the other side with respect to the second shaft part. Thus, the movement of the movable member over a predetermined amount toward one side or the other side in the connector thickness direction can be restricted.

<Second Aspect>

A producing method for an electric connector for a circuit board (the present method) according to a second aspect includes: disposing a plurality of metal members formed of a rolled metal plate in a die so that rolled surfaces of the metal members are parallel to a connector width direction corresponding to a width direction of a flat conductor that is removably connected to the electric connector for a circuit board; holding a part of the metal members by the die and exposing another part of the metal members into the die; molding a housing and a movable member by injecting an electrically insulating material that is melted into the die and solidifying the material, and with a part of the metal members exposed, holding another part of the metal members by the housing by integral molding; forming a movement restricting part that restricts movement of the movable member in a direction perpendicular to the connector width direction with the exposed part of the metal member; forming a movement restricted part whose movement is restricted by the movement restricting part in a part of the movable member in surface contact with the rolled surface of the movement restricting part; and after releasing the die, moving the movable member between a first position and a second position so that the movement restricted part of the movable member is separated from the movement restricting part of the metal member and the movable member is made movable.

By the present producing method, the electric connector for a circuit board can be produced by molding integrally the terminals at the same time as the housing and the movable member and by moving the movable member between the first position and the second position. Therefore, it is unnecessary to process the components of the connector at all after the integral molding. By the present producing method, the connector can be produced easily with fewer steps.

According to one aspect of the present disclosure, as described above, the electric connector for a circuit board can be produced by molding integrally the metal member including the terminals at the same time as the housing and the movable member and by moving the movable member between the first position and the second position. Therefore, it is unnecessary to process the components of the connector at all after the integral molding. In one aspect of the present disclosure, the connector can be produced easily with fewer steps. Since the steps are fewer, the connector can be produced at lower cost.

Embodiments of the present disclosure are hereinafter described with reference to the attached drawings.

First Embodiment

FIG. 1 is a perspective view illustrating a flat conductor FA and an electric connector 1 for a circuit board according to the present embodiment (hereinafter referred to as "connector 1") in a state just before the flat conductor FA is inserted. The connector 1 is mounted on a mount surface of a circuit board (no shown). The connector 1 is configured to be able to have the flat conductor FA removably connected thereto in a front-rear direction (X-axis direction) that is parallel to the mount surface. The connector 1, when the flat conductor FA is connected thereto, electrically connects between the circuit board and the flat conductor FA. In the present embodiment, in the X-axis direction (front-rear direction), an X1 direction is the front and an X2 direction is rear. In addition, a Y-axis direction that is perpendicular to the front-rear direction (X-axis direction) in a plane (XY plane) parallel to the mount surface of the circuit board is a connector width direction. A Z-axis direction (up-down direction) that is perpendicular to the mount surface of the circuit board is a connector thickness direction.

The flat conductor FA has a belt-like shape that is extended in the front-rear direction (X-axis direction) and has its width direction coinciding with the connector width direction (Y-axis direction). In the flat conductor FA, a plurality of circuit parts (not shown) extended in the front-rear direction are arranged and formed in the connector width direction. The circuit parts are embedded in an insulating layer of the flat conductor FA and extended in the front-rear direction. The circuit part is extended to reach a front end position of the flat conductor FA. The circuit part includes connection circuit parts FA1 whose only a front end part is exposed at an upper surface of the flat conductor FA. The circuit part can be in contact with first terminals 20 and second terminals 30 of the connector 1, which are described below. In addition, in the flat conductor FA, a cut part FA2 is formed at each side edge of the front end part. The cut part FA2 includes an ear part FA3 at the front. A rear edge of the ear part FA3 functions as an engaged part FA3-1 to be engaged with an engaging part of the connector 1 to be described below. Each connection circuit part FA1 includes a first connection circuit part FA1-1 to be in contact with the first terminal 20 and a second connection circuit part FA1-2 to be in contact with the second terminal 30. The first connection circuit parts FA1-1 and the second connection circuit parts FA1-2 are displaced from each other in the front-rear direction and positioned alternately along the connector width direction.

The connector 1 includes a housing 10 made of an electrically insulating material, the first terminals 20 and the second terminals 30 (see FIG. 4A to FIG. 4C), a movable member 40 made of an electrically insulating material, and metal parts 50. The first terminals 20 and the second terminals 30 are metal members that are arranged and held by the housing 10 by integral molding. The movable member 40 is rotatable relative to the housing 10 between a closed position and an open position to be described below. The metal parts 50 are the metal members that are held by the housing 10 by the integral molding.

The connector 1 is configured to have the flat conductor FA inserted and connected thereto from the rear in an arrow direction as illustrated in FIG. 1. The first terminals 20 and the second terminals 30 are collectively referred to as "terminals 20, 30" unless they need to be distinguished.

Before the detailed description of the connector 1, the summary of the operation of inserting and removing the flat conductor FA to and from the connector 1 is described first. The movable member 40 of the connector 1 is movable by rotation between a closed position corresponding to a first position where the removal of the flat conductor FA is inhibited and an open position corresponding to a second position where the removal of the flat conductor FA is allowed. Before the flat conductor FA is inserted into the connector 1, the movable member 40 of the connector 1 is at the closed position corresponding to the first position where the movable member 40 has a posture parallel to the mount surface of the circuit board (not shown) as illustrated in FIG. 1, and at this position, the insertion of the flat conductor FA is allowed. The flat conductor FA has its front edge in contact with the terminals 20, 30 to elastically deform the contact part of the terminals 20, 30. Thus, the flat conductor FA can be inserted to a predetermined position.

Figure 2A:
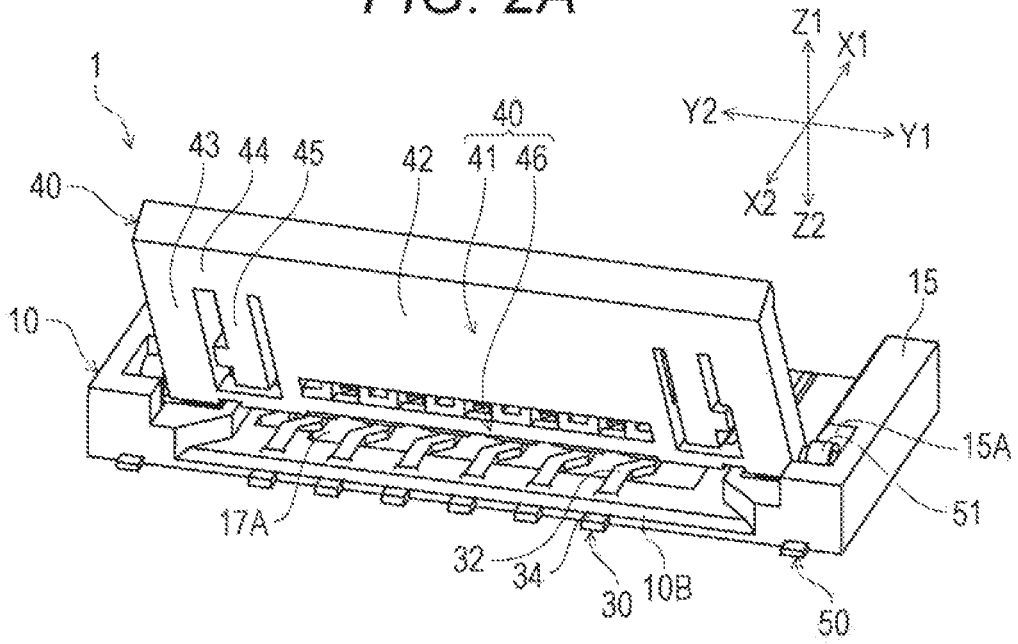
Figure 2B:
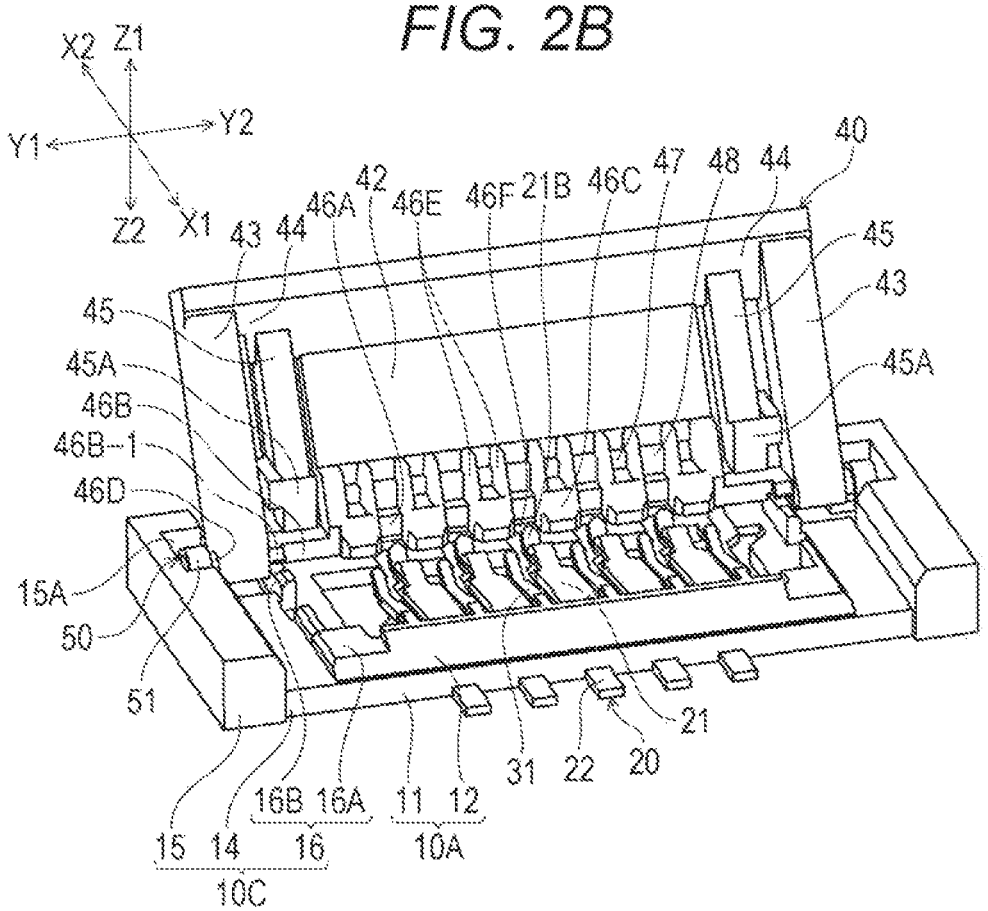

Even after the flat conductor FA is inserted and connected, the movable member 40 remains at the closed position during the use of the connector 1. Therefore, as will be described below, while an engaging part 45A of the movable member 40 and an engaged part FA3-1 of the flat conductor FA are disposed at a position where these parts can be engaged with each other, the movement of the flat conductor FA to the rear (X2 direction) is suppressed and the unnecessary removal of the flat conductor FA is inhibited (see also FIG. 9C). In addition, when the flat conductor FA is removed, that is, when the connector 1 is unused, the movable member 40 is rotated in a rising direction to come to the open position corresponding to the second position where the movable member 40 has a posture with an angle from the mount surface of the circuit board as illustrated in FIG. 2A and FIG. 2B. Thus, the engaged state between the engaged part FA3-1 of the flat conductor FA and the engaging part 45A of the movable member 40 is canceled. As a result, the movement of the flat conductor FA to the rear, that is, the removal of the flat conductor FA is allowed (see also FIG. 10C).

Figure 3A:
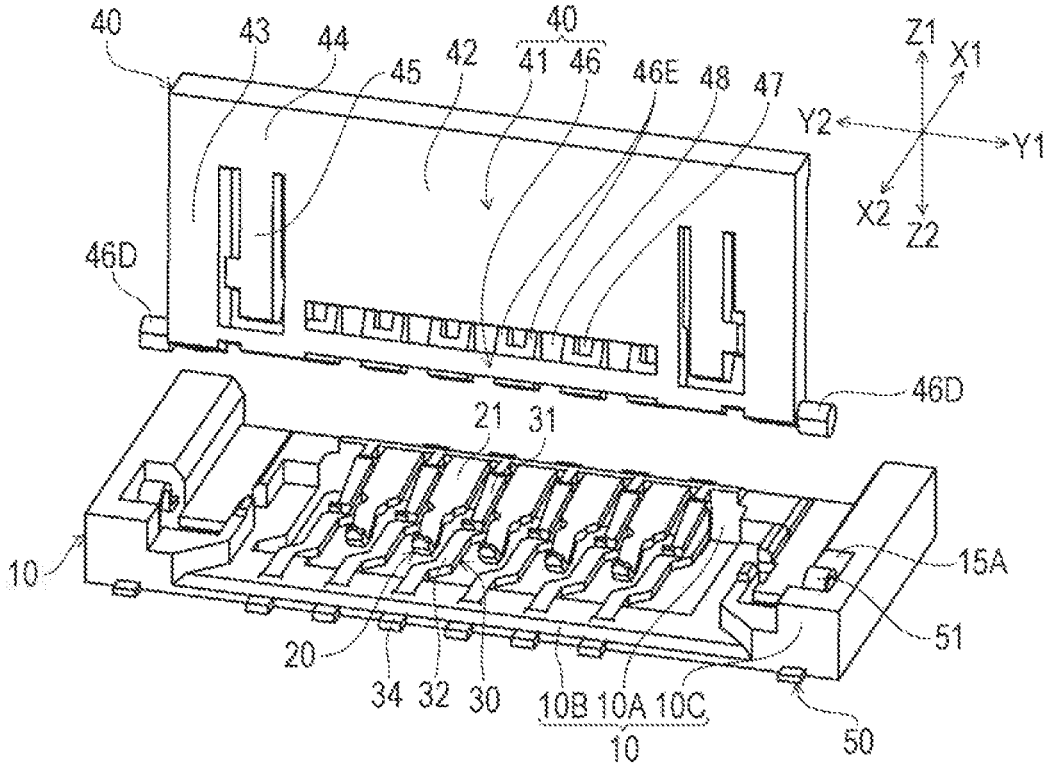
Figure 3B:
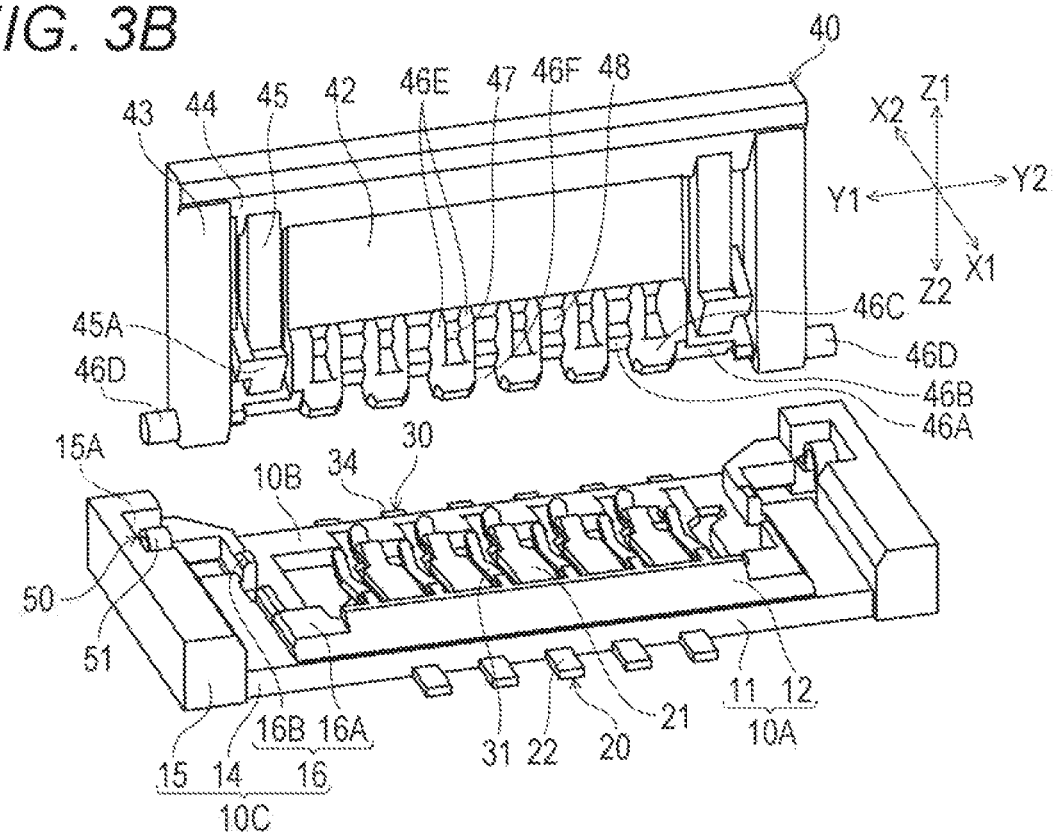

The description of the structure of the connector 1 is continued. FIG. 2A and FIG. 2B are perspective views illustrating the connector 1 with the movable member 40 at the open position. FIG. 2A is the perspective view of the connector viewed from the rear and FIG. 2B is the perspective view of the connector viewed from the front. FIG. 3A and FIG. 3B are perspective views illustrating the connector 1 with the movable member 40 separated upward. FIG. 3A is the perspective view of the connector viewed from the rear and FIG. 3B is the perspective view of the connector viewed from the front.

As illustrated in FIG. 3A, the housing 10 has a rectangular frame shape whose longitudinal direction corresponds to the connector width direction (Y-axis direction) when viewed from above. The housing 10 includes a front frame part 10A and a rear frame part 10B, which are parallel to each other and extended in the connector width direction, and a pair of side frame parts 10C. The pair of side frame parts 10C is positioned symmetrically in the connector width direction, and couples between an end part of the front frame part 10A and an end part of the rear frame part 10B.

The front frame part 10A includes a front base part 11 that constitutes a lower part facing the circuit board (not shown), and a front wall 12 as illustrated in FIG. 2B and FIG. 3B. The front wall 12 is formed so as to rise upward vertically from the front base part 11 and extended along the connector width direction in the range where the terminals are arranged. The front base part 11 and the front wall 12 of the front frame part 10A hold the first terminals 20 and the second terminals 30 by the integral molding. The front wall 12 has its upper surface facing a lower surface of the movable member 40 present at the closed position so that the contact is possible (see FIG. 8A, FIG. 8B, FIG. 9A, and FIG. 9B). Thus, the front wall 12 restricts excessive downward displacement of the movable member 40. The rear frame part 10B is extended along the connector width direction in the range where the terminals are arranged. The rear frame part 10B and the front frame part 10A together hold the first terminals 20 by the integral molding.

The side frame part 10C includes a side base part 14 with a plate shape, side walls 15, and side supporting parts 16 as illustrated in FIG. 3B. The side base part 14 couples between an end part of the front base part 11 and an end part of the rear frame part 10B in the connector width direction. The side wall 15 is positioned at an external end part of the side base part 14 in the connector width direction, and rises from the side base part 14. The side supporting part 16 is positioned more on the inside than the side wall 15 (on the side of the range where the terminals are arranged) in the connector width direction, and protrudes upward from the side base part 14.

The side wall 15 includes a housing hole part 15A formed near a rear end and penetrating in the up-down direction. The housing hole part 15A is a housing part corresponding to a space for housing a rotation shaft part 46D of the movable member 40, which is described below, and a movement restricting part 51 of the metal part 50, which is described below. The side supporting part 16 includes a side front support 16A on a front end side as illustrated in FIG. 3B. The side front support part 16A supports an engaging arm part 45 of the movable member 40, which is described below, from below when the movable member 40 is present at the closed position. The side supporting part 16 further includes a side rear support part 16B. The side rear support part 16B supports from below, a sub-base part 46B of the movable member 40, which is described below.

Figure 5A:
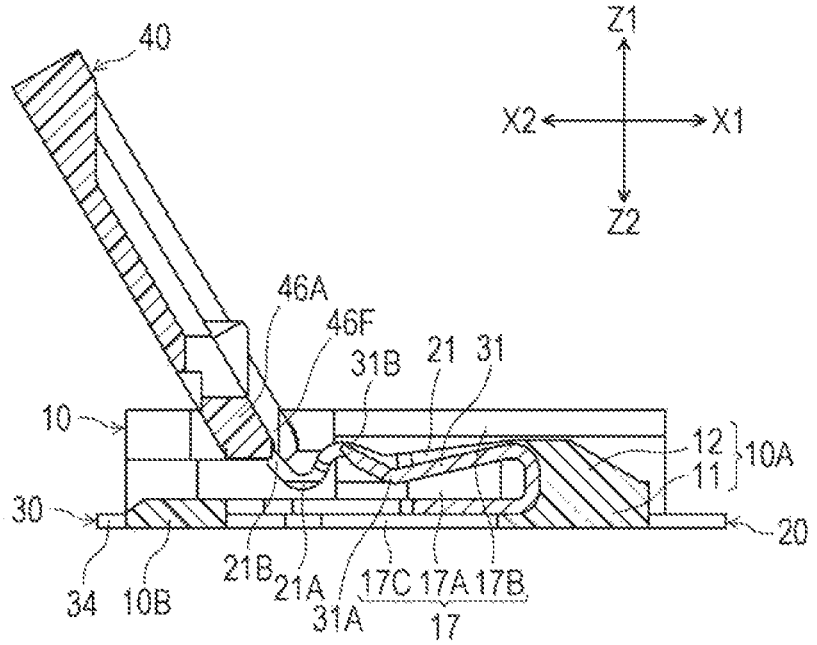
FIG. 5A is a longitudinal cross-sectional view of the electric connector for a circuit board illustrated in FIG. 2A and FIG. 2B at a position of the second terminal in a connector width direction.

As illustrated in FIG. 5A, the housing 10 includes a space 17. The space 17 includes a reception part 17A, a housing concave part 17B, and a bottom hole part 17C. That is to say, as indicated in FIG. 5A, the space 17 includes the reception part 17A, the housing concave part 17B, and the bottom hole part 17C positioned below the reception part 17A. The reception part 17A receives the flat conductor FA that is inserted toward the front. The housing concave part 17B is positioned above the reception part 17A and houses the movable member 40 that is present at the closed position.

The reception part 17A is positioned above the rear frame part 10B and below a cover plate part 42, which is described below, of the movable member 40 present at the closed position in the up-down direction (Z-axis direction). In the front-rear direction (X-axis direction), the reception part 17A is formed extending from the rear end of the connector 1 to the rear surface of the front wall 12 of the housing 10. The reception part 17A is formed between the two side supporting parts 16 in the connector width direction (Y-axis direction). The reception part 17A is open to the rear, and also open to the upward direction. Thus, the reception part 17A can receive the front end part of the flat conductor FA from the rear. Since the reception part 17A is open not just to the rear but also to the upward direction, the reception part 17A can receive the flat conductor FA in an oblique posture at the rear part thereof.

The housing concave part 17B is positioned above the reception part 17A and communicates with the reception part 17A. The housing concave part 17B is formed along the connector width direction between the two side walls 15. The housing concave part 17B is open upward and can house the movable member 40 that is present at the closed position. Regarding the front-rear direction, the housing concave part 17B is formed extending from a position near a rear end 21B of a first contact arm part 21 of the first terminal 20, which is described below, to the front end of the housing 10. In the present embodiment, the housing concave part 17B is positioned above the reception part 17A. The term "positioned above" includes a state in which a part of the housing concave part 17B is formed to overlap with the reception part 17A in the up-down direction.

In addition, the bottom hole part 17C is formed as a space that is surrounded by the rectangular frame part of the housing 10 (including the front frame part 10A, the rear frame part 10B, and the side frame part 10C) and penetrates in the up-down direction.

Figures 4A, 4B, 4C:
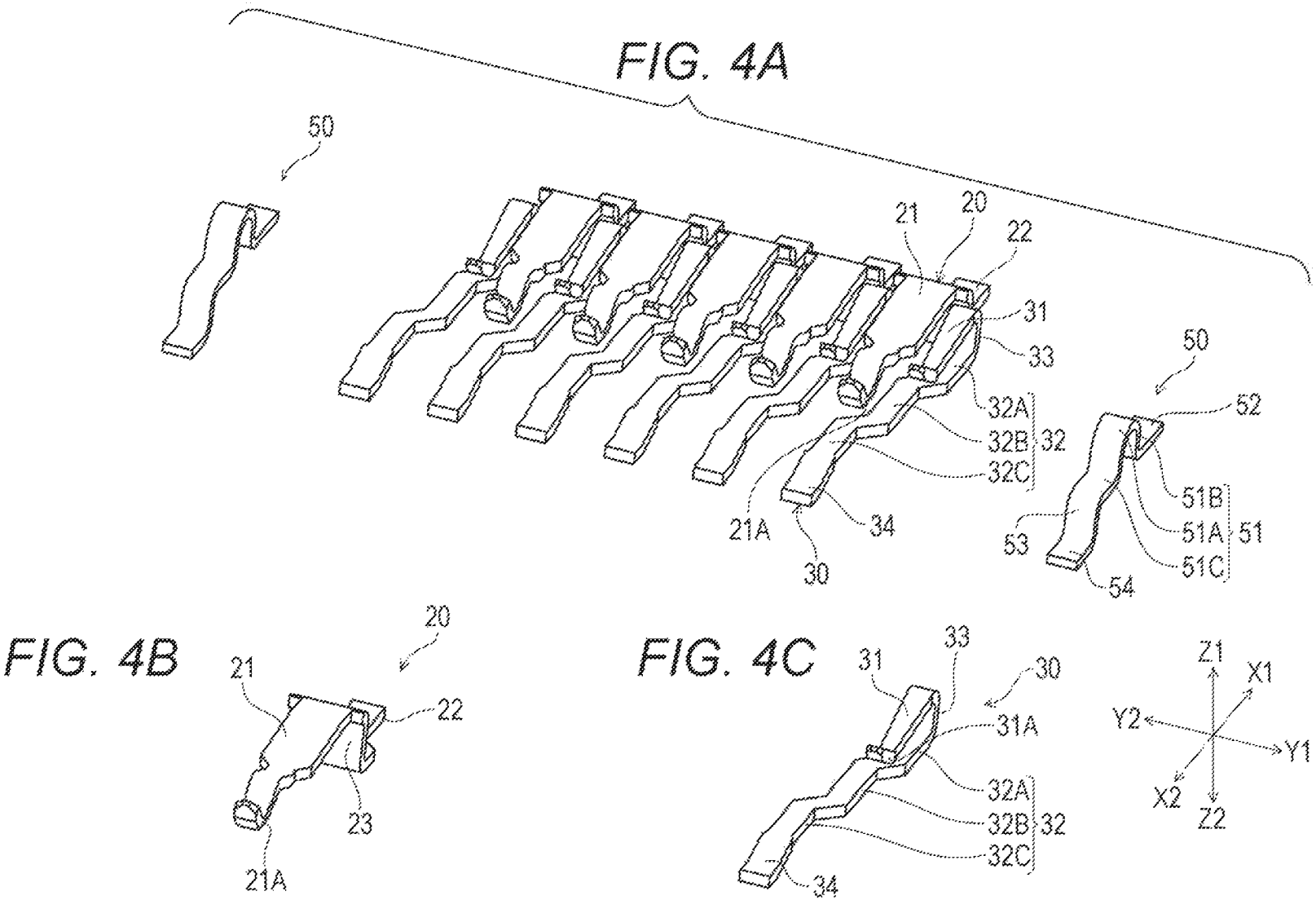
FIG. 4A is a perspective view illustrating first terminals, second terminals, and metal parts extracted from the electric connector for a circuit board in FIG. 1.
FIG. 4B is a perspective view of the first terminal alone.
FIG. 4C is a perspective view of the second terminal alone.

In the present embodiment, the two kinds of terminals with different terminal shapes, the first terminals 20 and the second terminals 30, are used. FIG. 4A is a perspective view illustrating the first terminals 20, the second terminals 30, and the metal parts 50 extracted from the connector 1 in FIG. 1. FIG. 4B is a perspective view of the first terminal 20 alone. FIG. 4C is a perspective view of the second terminal 30 alone. The first terminals 20 and the second terminals 30 have the shape as illustrated in the perspective views of FIG. 4A to FIG. 4C. As illustrated in FIG. 4A, the first terminals 20 and the second terminals 30 are arranged alternately along the connector width direction.

The first terminal 20 is formed in a manner that a metal plate with a belt shape whose terminal width direction coincides with the connector width direction (Y-axis direction) is bent in a plate thickness direction as illustrated in FIG. 4A and FIG. 4B. The first terminal 20 includes an approximately crank shape as a whole, and includes the first contact arm part 21, a first connection part 22, and a first coupling part 23. The first contact arm part 21 is extended in a front-rear direction (X-axis direction) and elastically deformable in the up-down direction (Z-axis direction). The first connection part 22 is disposed below the first contact arm part 21 and extended to the front. The first coupling part 23 couples between a front end of the first contact arm part 21 and a rear end of the first connection part 22.

In the first contact arm part 21 of the first terminal 20, a latter half part in the front-rear direction (part on X2 side) is narrower in width than a first half part (part on X1 side). The first contact arm part 21 includes a first contact part 21A that is bent to protrude downward at a position near the rear end. When the flat conductor FA is inserted into the connector 1, the first contact arm part 21 facing upward is elastically deformed, so that the first contact part 21A can be in contact with a first connection circuit part FA1-1 in a rear row of the flat conductor FA (see FIG. 9A).

As illustrated in FIG. 2B, when the first contact arm part 21 is in a free state, the rear end 21B of the first contact arm part 21 is housed in a groove part 46F formed in a rotation base part 46 of the movable member 40, which is described below (see also FIG. 5A and FIG. 8A). In this manner, the rear end 21B of the first contact arm part 21 is housed in the groove part 46F of the movable member 40. This makes it difficult for the flat conductor FA to be in contact with the rear end 21B of the first contact arm part 21 in a process of inserting the flat conductor FA into the connector 1. Therefore, the damage of the first terminals 20 due to buckling or the like can be suppressed.

Figure 8A:
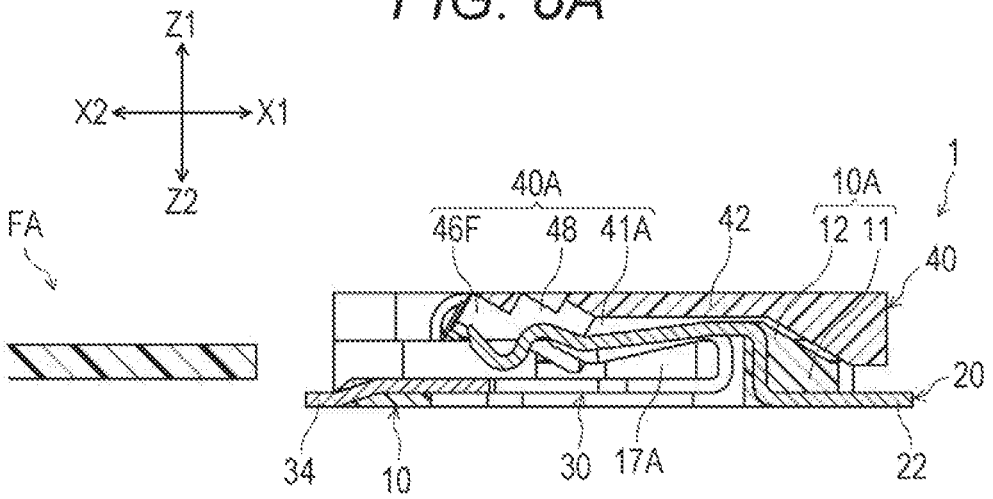

The rear end part of the first connection part 22 of the first terminal 20 and the first coupling part 23 are held by the front frame part 10A of the housing 10 by the integral molding (see also FIG. 8A). As illustrated in FIG. 2B and FIG. 3B, a front end part of the first connection part 22 of the first terminal 20 is extended to the front from the front frame part 10A of the housing 10 (see also FIG. 8A). The first connection part 22 of the first terminal 20 is soldered to be connected to a circuit part of the circuit board (not shown) on a lower surface of the front end part.

The second terminal 30 is formed similarly to the first terminal 20 in a manner that a metal plate with a belt shape whose terminal width direction coincides with the connector width direction is bent in the plate thickness direction as illustrated in FIG. 3A and FIG. 3B. The second terminal 30 includes a second contact arm part 31, a held arm part 32, a second coupling part 33 that is curved, and a second connection part 34. The second contact arm part 31 is extended in the front-rear direction and elastically deformable in the up-down direction. The held arm part 32 is extended in the front-rear direction at a position lower than the second contact arm part 31, and is held by the housing 10 at the front and rear ends. The second coupling part 33 couples between a front end of the second contact arm part 31 and a front end of the held arm part 32 (FIG. 4A and FIG. 4C). The second connection part 34 is extended to the rear from the held arm part 32.

The second terminal 30 includes the second contact arm part 31, the held arm part 32, and the second coupling part 33 as described above. Thus, the second terminal 30 forms an approximately lateral U shape that is open to the rear (see also FIG. 8B). The second terminal 30 can receive the flat conductor FA from the rear at part with the lateral U shape, and this is described below. In addition, when receiving the flat conductor FA, the second contact arm part 31 of the second terminal 30 is elastically deformed, so that the second contact arm part 31 and the held arm part 32 can hold the flat conductor FA with pressure.

The second contact arm part 31 of the second terminal 30 has the width reducing from an upper end of the second coupling part 33 to the rear, and is extended inclined a little to the downward direction. The second contact arm part 31 includes a second contact part 31A that is formed to bend so as to protrude downward at the position near the rear end. The second contact arm part 31 is formed to have narrower width than the first contact arm part 21 of the first terminal 20 as illustrated in FIG. 4A. The second contact part 31A is positioned ahead of the first contact part 21A of the first terminal 20. The second contact part 31A is connected to the second connection circuit part FA1-2 in a front row of the flat conductor FA.

As illustrated in FIG. 5A, when the second contact arm part 31 is in a free state, the rear end 31B of the second contact arm part 31 is positioned ahead of the rear end 21B of the first contact arm part 21 of the first terminal 20. In addition, the rear end 31B of the second contact arm part 31 is positioned in the range of the plate thickness of the first contact arm part 21 in the up-down direction. Thus, the rear end 31B of the second contact arm part 31 is positioned in the range of the plate thickness of the first contact arm part 21. This makes it difficult for the flat conductor FA to be in contact with the rear end 31B of the second terminal 30 in a process of inserting the flat conductor FA into the connector 1. Therefore, the damage of the second terminals 30 due to buckling or the like can be suppressed.

The held arm part 32 of the second terminal 30 is extended from the lower end of the second coupling part 33 to the rear in parallel to the second contact arm part 31, and reaches the position of the rear frame part 10B of the housing 10. The part of the held arm part 32 that is near the rear end is held by the rear frame part 10B of the housing 10 by the integral molding. In addition, the part of the held arm part 32 that is near the front end, and the second coupling part 33 are held by the front frame part 10A by the integral molding (see also FIG. 5A). That is to say, as illustrated in FIG. 5A, the held arm part 32 is held in a double fixed beam shape by the housing 10.

Figure 5B:
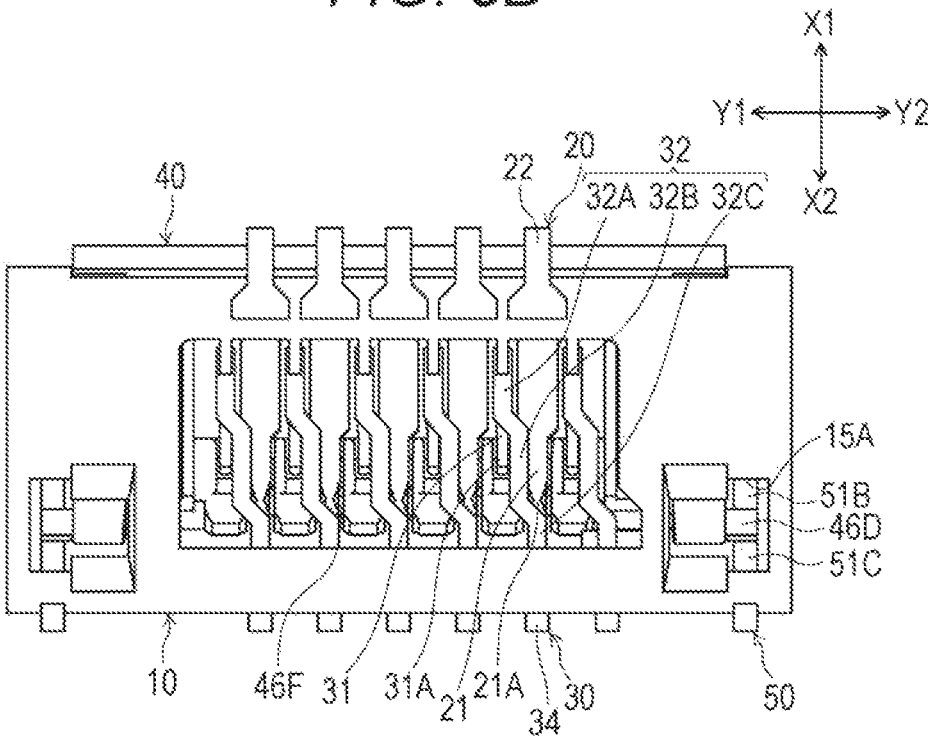
FIG. 5B is a bottom view of the electric connector for a circuit board.

The held arm part 32 is bent to the Y2 side in the connector width direction at a position a little to the front compared to the second contact part 31A of the second contact arm part 31 in the front-rear direction as illustrated in FIG. 4A and FIG. 4C. Furthermore, the held arm part 32 is bent to the Y2 side at the position a little to the rear compared to the first contact part 21A of the first terminal 20 (see also FIG. 5B). With the two bending positions as a border, the held arm part 32 of the second terminal 30 is sectioned into three parts in the front-rear direction (X-axis direction); a front end part 32A (part on X1 side), an intermediate part 32B, and a rear end part 32C (part on X2 side). In this case, as illustrated in FIG. 4A and FIG. 5B, the front end part 32A is positioned to overlap with the front end part of the second contact arm part 31 of the second terminal 30 in both the front-rear direction and the connector width direction. The intermediate part 32B is positioned to overlap with the rear end part of the second contact arm part 31 in the front-rear direction. On the other hand, the intermediate part 32B is positioned to be displaced to the Y2 side with respect to the rear end part of the second contact arm part 31 in the connector width direction. The rear end part 32C is positioned behind the second contact arm part 31 in the front-rear direction. In the connector width direction, the rear end part 32C is positioned to be displaced to the Y2 side with respect to the second contact arm part 31.

As described above, the intermediate part 32B of the held arm part 32 of the second terminal 30 is positioned so as to overlap in the front-rear direction with, but be displaced in the connector width direction from the rear end part of the second contact arm part 31, that is, the part including the second contact part 31A. Therefore, as illustrated in FIG. 5B, when the connector 1 is viewed from below, the second contact part 31A is visible through the bottom hole part 17C of the housing 10.

Moreover, as illustrated in FIG. 4A and FIG. 5B, the front end part 32A of the held arm part 32 of the second terminal 30 is positioned so as to overlap in the front-rear direction with, but be displaced to the Y1 side in the connector width direction from the front end part (wide part) of the first contact arm part 21 of the first terminal 20 adjacent to the second terminal 30 on the Y2 side. The intermediate part 32B of the second terminal 30 is positioned so as to overlap in the front-rear direction with, but be displaced to the Y2 side in the connector width direction from the rear end part (narrow part) of the first contact arm part 21 of the first terminal 20. In the front-rear direction, the rear end part 32C of the second terminal 30 is positioned behind the first contact arm part 21 of the first terminal 20. In the connector width direction, the rear end part 32C is positioned to overlap with the first contact arm part 21.

As described above, the intermediate part 32B of the second terminal 30 is positioned so as to overlap in the front-rear direction with, but be displaced in the connector width direction from the rear end part of the first contact arm part 21 of the first terminal 20, that is, the part of the first contact arm part 21 that includes the rear end 21B and the first contact part 21A. As illustrated in FIG. 5B, the intermediate part 32B is positioned so as to overlap in the front-rear direction with, but be displaced in the connector width direction from the groove part 46F of the movable member 40, which is described below, for housing the rear end 21B of the first contact arm part 21. Therefore, as illustrated in FIG. 5B, when the connector 1 is viewed from below, the rear end 21B and the first contact part 21A of the first contact arm part 21 in the first terminal 20 and the groove part 46F of the movable member 40 are visible through the bottom hole part 17C of the housing 10.

In the present embodiment, as described above, the intermediate part 32B of the held arm part 32 of the second terminal 30 is disposed at a position different (displaced) in the connector width direction from both the first contact part 21A of the first terminal 20 and the second contact part 31A of the second terminal 30. Therefore, the first contact part 21A and the second contact part 31A are visible through the bottom hole part 17C of the housing 10. Therefore, in the production of the connector 1, if the first contact part 21A and the second contact part 31A are plated, the first contact part 21A and the second contact part 31A can be easily plated through the bottom hole part 17C.

In the present embodiment, as described above, the intermediate part 32B of the held arm part 32 of the second terminal 30 is present at the position different (displaced) in the connector width direction from the groove part 46F of the movable member 40. Thus, the groove part 46F is visible through the bottom hole part 17C of the housing 10. Therefore, as described below, when the terminals are arranged in the die in the production of the connector 1, a part of a lower die can be disposed at a position corresponding to the groove part 46F of the movable member 40 while the interference with the intermediate part 32B is suppressed. Therefore, by the lower die, the groove part 46F can be easily formed.

The second connection part 34 is extended to the rear from the rear frame part 10B as illustrated in FIG. 5A (see also FIG. 8A). The second connection part 34 is soldered to be connected to the circuit part of the circuit board (not shown) on a lower surface thereof.

In FIG. 1, the movable member 40 has the posture of the closed position. As illustrated in FIG. 1, the movable member 40 includes a main body part 41 with an approximately plate shape that expands in the front-rear direction (X-axis direction) and the connector width direction (Y-axis direction), and the rotation base part 46 that is extended in the connector width direction on the rear side (X2 side) relative to the main body part 41 and includes a rotation axial line.

As illustrated in FIG. 1, the main body part 41 includes the cover plate part 42, an end arm part 43, a linking part 44, and the engaging arm part 45. The cover plate part 42 is extended in the range where the terminals are arranged in the connector width direction, and covers the terminals 20, 30 at the closed position (see also FIG. 8A and FIG. 8B). The end arm part 43 is extended to the rear at external positions on both sides of the cover plate part 42. The linking part 44 links between a front end of the cover plate part 42 and a front end of the end arm part 43. The engaging arm part 45 is extended in a cantilever beam shape from the linking part 44 to the rear (see also FIG. 2A FIG. 2B. FIG. 3A, and FIG. 3B).

As illustrated in FIG. 2B and FIG. 3B, the engaging arm part 45 includes the engaging part 45A that protrudes to the front at a lower end part, that is, a free end. The engaging part 45A protrudes into the reception part 17A of the housing 10 from above when the movable member 40 is at the closed position as illustrated in FIG. 8C. The engaging part 45A includes a guiding surface 45A-1 in a rear part, and an engaging surface 45A-2 in a front part as illustrated in FIG. 8C (see also FIG. 9C). The guiding surface 45A-1 guides the flat conductor FA to the front in the process of inserting the flat conductor FA when the movable member 40 is at the closed position. The engaging surface 45A-2 can be engaged from the rear with the engaged part FA3-1 provided to the flat conductor FA after the flat conductor FA is inserted.

As illustrated in FIG. 8C, the guiding surface 45A-1 is an inclined surface that is inclined downward to the front when the movable member 40 is at the closed position. The engaging arm part 45 functions as an elastic arm part. That is to say, when the front end part of the ear part FA3 of the flat conductor FA is in contact with the guiding surface 45A-1 in the process of inserting the flat conductor FA, the engaging arm part 45 receives the contact force and is elastically deformed upward easily.

Figure 7A:
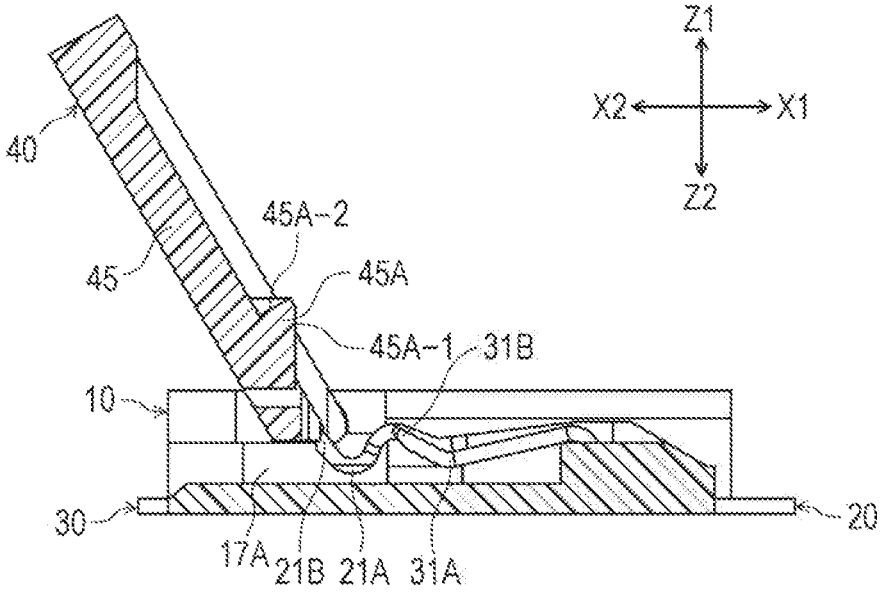
Figure 10A:
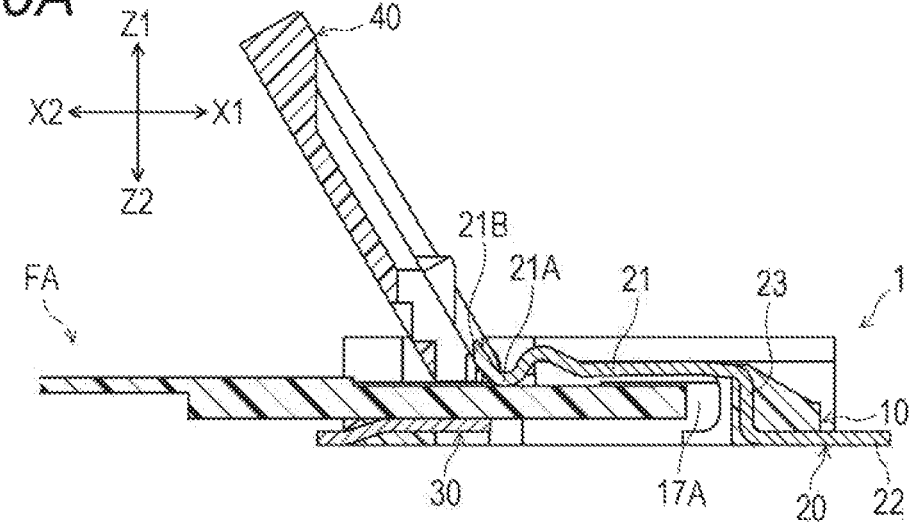
Figure 10B:
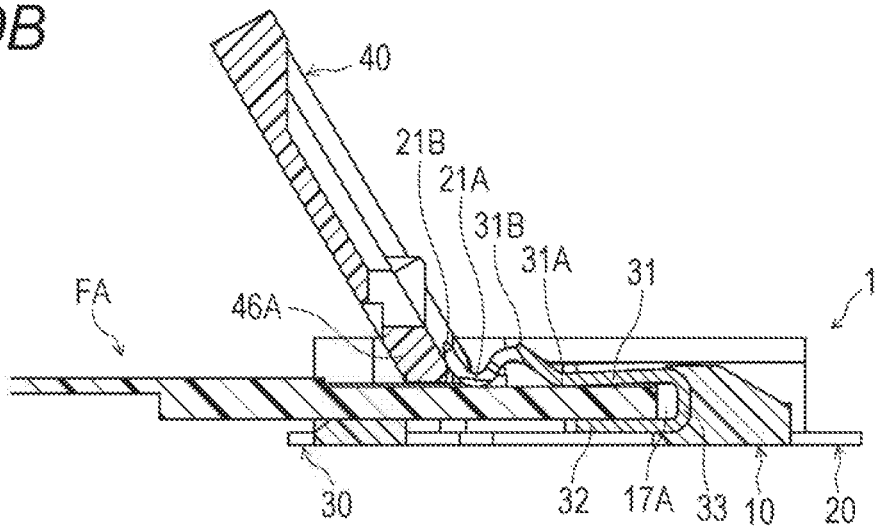
Figure 10C:
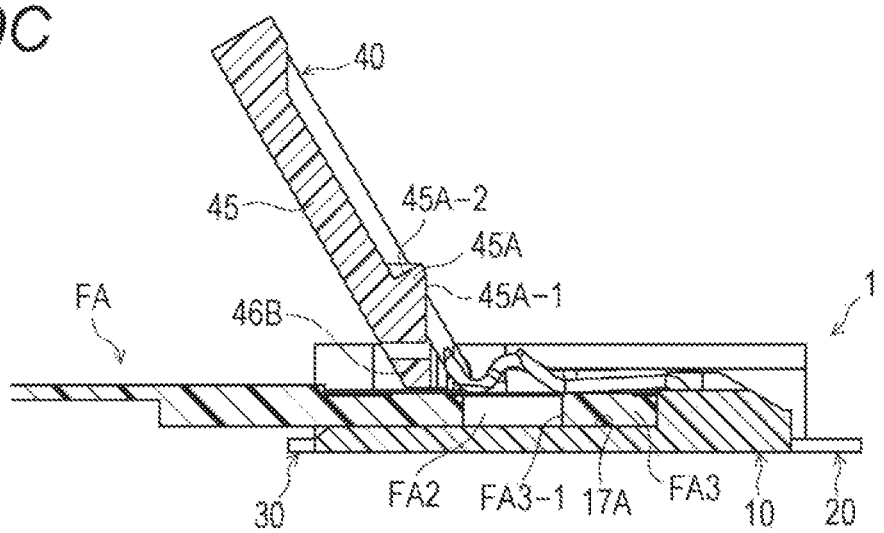

In addition, when the movable member 40 is at the open position, the guiding surface 45A-1 is extended in the up-down direction without inclination in the connector width direction as illustrated in FIG. 7A and FIG. 10C. In other words, the guiding surface 45A-1 constitutes a plane perpendicular to the front-rear direction when the movable member 40 is at the open position. In this manner, when the movable member 40 is at the open position, the guiding surface 45A-1 is extended in the up-down direction. Thus, after the movable member 40 is molded, the upper die can be released upward at the right angle (see also FIG. 7B).

Figure 8B:
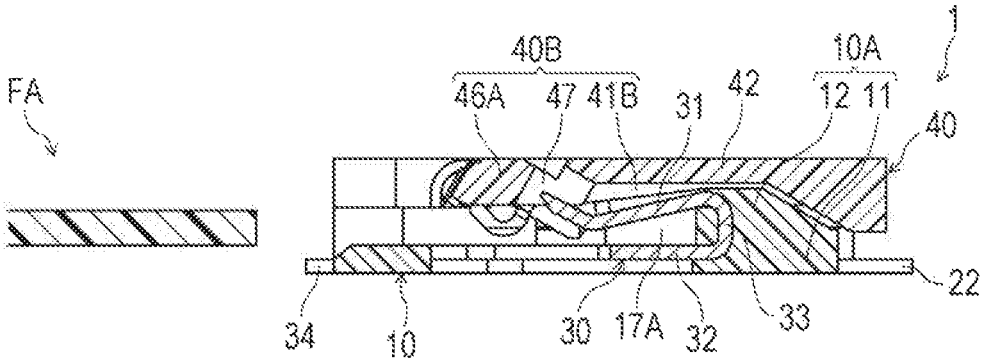
Figure 8C:
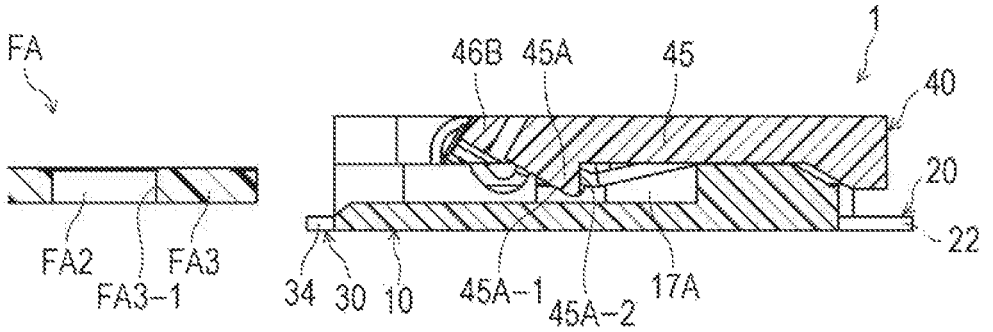
Figure 9A:
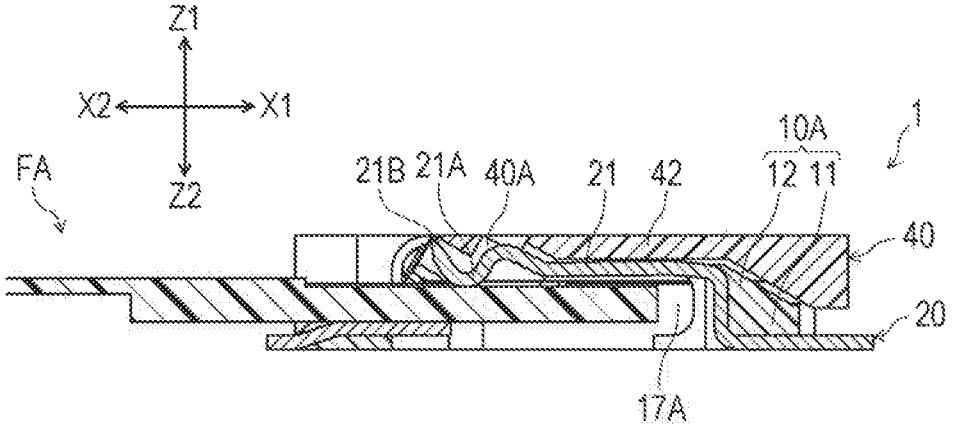
Figure 9B:
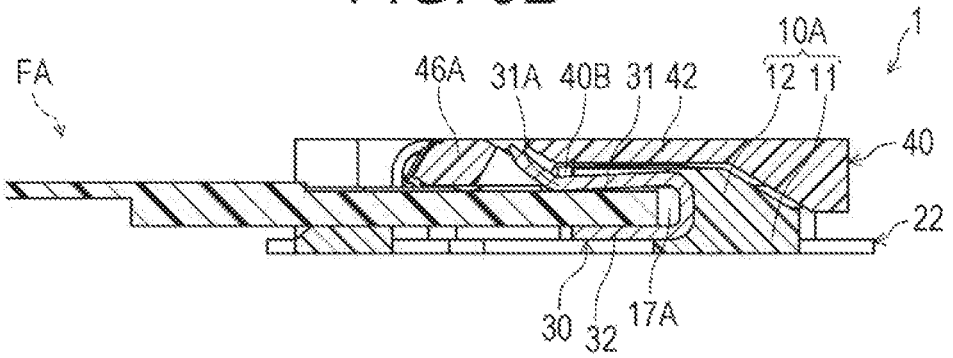
Figure 9C:
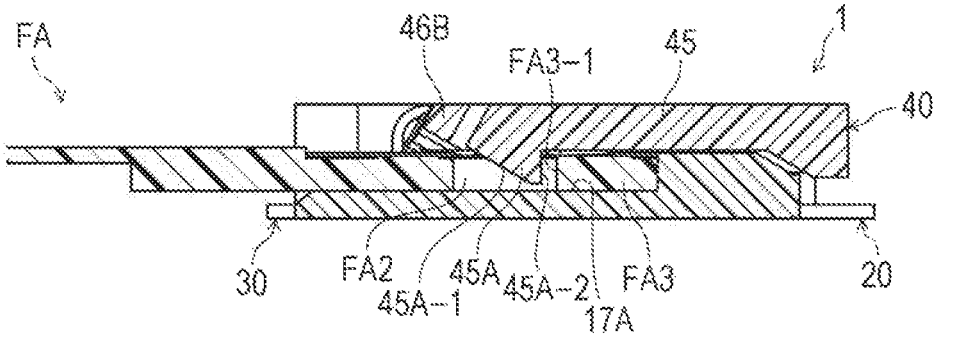

In addition, when the movable member 40 is at the closed position, the engaging surface 45A-2 is extended in the up-down direction without inclination in the connector width direction as illustrated in FIG. 8C and FIG. 9C. In other words, the engaging surface 45A-2 constitutes a plane perpendicular to the front-rear direction when the movable member 40 is at the closed position. As a result, the engaging surface 45A-2 is positioned behind the engaged part FA3-1 of the flat conductor FA and engages with the engaged part FA3-1 from behind smoothly. Thus, the engaging surface 45A-2 can suppress the unnecessary removal of the flat conductor FA.

The rotation base part 46 includes a main base part 46A, the sub-base part 46B, a protrusion part 46C, the rotation shaft part 46D, and a plurality of coupling parts 46E as illustrated in FIG. 3B. The main base part 46A is extended in the range where the terminals are arranged in the connector width direction. The sub-base part 46B is extended outward in the terminal arranging direction from both sides of the main base part 46A. The protrusion part 46C protrudes to the front from the main base part 46A when the movable member 40 is at the open position (see FIG. 2B). The rotation shaft part 46D is extended outward in the terminal arranging direction from both end surfaces of the end arm part 43. The coupling parts 46E couple the main base part 46A to the cover plate part 42 of the main body part 41.

As illustrated in FIG. 2B and FIG. 3B, when the movable member 40 is at the open position, the part of the sub-base part 46B that is positioned in accordance with the side supporting part 16 of the housing 10 in the connector width direction protrudes more to the front than the other part. That part constitutes a side supported part 46B-1 that is supported by the side supporting part 16 from below. The side supported part 46B-1 is supported by the side rear support part 16B of the side supporting part 16 wherever the movable member 40 is present in the rotating range from the open position to the closed position.

The protrusion part 46C is formed in the range corresponding to the pair of coupling parts 46E in the connector width direction as illustrated in FIG. 2B. Between a pair of protrusion parts 46C that is adjacent to each other in the connector width direction, in other words, at the position corresponding to the first contact arm part 21 of the first terminals 20, the groove part 46F is formed.

Figure 6A:
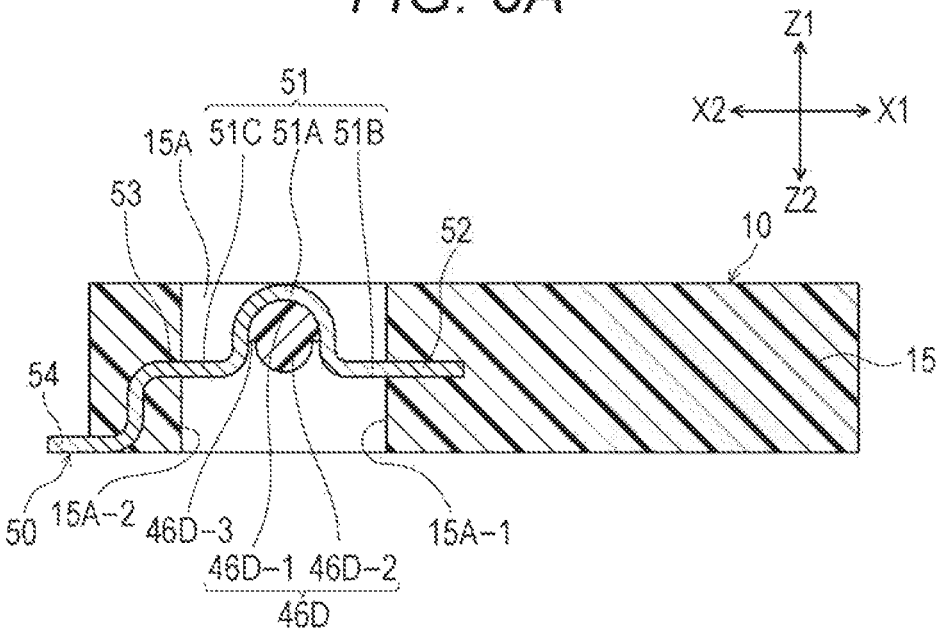

The rotation shaft part 46D is positioned in accordance with the housing hole part 15A of the housing 10 in the connector width direction. The rotation shaft part 46D is housed in the housing hole part 15A with the movement restricting part 51 of the metal part 50, which is described below. As illustrated in FIG. 6A, the rotation shaft part 46D includes a large diameter part 46D-1 having a curved surface with an arc-like shape in an upper half part of the rotation shaft part 46D in a circumferential direction. In addition, the rotation shaft part 46D includes a small diameter part 46D-2 having a curved surface with an arc-like shape, which is smaller in diameter than the large diameter part 46D-1, in a lower half part of the rotation shaft part 46D in the circumferential direction. That is to say, the cross section of the rotation shaft part 46D in a plane perpendicular to the connector width direction has a shape that a semicircle with large diameter and a semicircle with small diameter are connected in the up-down direction using the center of each semicircle in common. Therefore, at a border between the large diameter part 46D-1 and the small diameter part 46D-2, a step part 46D-3 corresponding to the difference between both radiuses is formed.

As illustrated in FIG. 6A, a peripheral surface of the large diameter part 46D-1 faces a curved part 51A of the movement restricting part 51 of the metal part 50, which is described below. The large diameter part 46D-1 functions as a movement restricted part of the rotation shaft part 46D or the movable member 40 whose movement to an upward, front, or rear direction is restricted. The peripheral surface of the large diameter part 46D-1 functions as a rotation guided part that is guided so as to be rotatable by the curved part 51A of the metal part 50.

As illustrated in FIG. 2B, the coupling parts 46E are formed at a plurality of positions (12 positions in the present embodiment) in the range of the cover plate part 42 in the connector width direction while the movable member 40 is at the open position. The coupling part 46E is formed to be extended in the up-down direction, and couples between a front surface of a lower part of the cover plate part 42 and an upper surface of the main base part 46A. In the present embodiment, the two coupling parts 46E that are adjacent to each other constitute a pair. Between the pair of coupling parts 46E, a narrow hole part 47 penetrating in the front-rear direction is formed. In addition, between the adjacent coupling parts belonging to the different pairs, a wide hole part 48 that is wider than the narrow hole part 47 in the connector width direction is formed.

The two coupling parts 46E that constitute one pair are formed adjacent to the second contact arm part 31 on both sides of the second contact arm part 31 of the second terminal 30 in the connector width direction as illustrated in FIG. 2B. Therefore, the narrow hole part 47 formed between the two coupling parts 46E is positioned in accordance with the second contact arm part 31 in the connector width direction. In addition, the wide hole part 48 formed between the pair of coupling parts 46E is positioned in accordance with the first contact arm part 21 of the first terminal 20 in the connector width direction.

In the present embodiment, as indicated in FIG. 8A illustrating the movable member 40 at the closed position, the groove part 46F, the wide hole part 48, and a space 41A along the lower surface of the main body part 41 form a first elastic deformation allowing part 40A that is continuous in the front-rear direction at the position in accordance with the first contact arm part 21 of the first terminal 20 in the connector width direction. As illustrated in FIG. 9A, the first elastic deformation allowing part 40A allows the first terminal 20 to be elastically deformed above the first contact arm part 21 when the flat conductor FA is inserted into the connector 1.

As indicated in FIG. 8B illustrating the movable member 40 at the closed position, the narrow hole part 47 and a space 41B along the lower surface of the main body part 41 form, in the movable member 40, a second elastic deformation allowing part 40B that is continuous in the front-rear direction. As illustrated in FIG. 9B, the second elastic deformation allowing part 40B allows the second terminal 30 to be elastically deformed above the second contact arm part 31 when the flat conductor FA is inserted into the connector 1.

The metal parts 50 are held by the integral molding by the side walls 15 of the housing 10 at the positions corresponding to the housing hole parts 15A of the housing 10 and the rotation shaft part 46D of the movable member 40 in the connector width direction. The metal part 50 is formed in a manner that a belt-shaped piece made of a rolled metal plate is bent in a thickness direction thereof. The rolled surface (plate surface) of the metal part 50 is held by the side wall 15 in a posture parallel to the connector width direction.

As illustrated in FIG. 4A and FIG. 6A, the metal part 50 includes the movement restricting part 51, a front held part 52, a rear held part 53, and a fixing part 54. The movement restricting part 51 has an approximately O-like shape when viewed in the connector width direction. The front held part 52 is extended linearly to the front from a front end of the movement restricting part 51, and held by the housing 10. The rear held part 53 is extended in a crank shape from the movement restricting part 51 to the rear, and held by the housing 10. The fixing part 54 is extended out of the housing 10 from the rear held part 53 to the rear.

As illustrated in FIG. 6A, the movement restricting part 51 is, within the housing hole part 15A of the housing 10, extended more to the front and to the rear than the rotation shaft part 46D of the movable member 40 in the front-rear direction (one direction in a plane perpendicular to the connector width direction), that is, a direction where opposite inner wall surfaces 15A-1 and 15A-2 of the housing hole part 15A face each other. The movement restricting part 51 constitutes a part of an exposed part that is exposed out of the housing 10. The movement restricting part 51 has a belt-like plate shape, and includes the curved part 51A, a front straight part 51B, and a rear straight part 51C. The curved part 51A is curved like an approximately semicircular shape. The front straight part 51B is extended straight to the front from a front end of the curved part 51A. The rear straight part 51C is extended straight to the rear from a rear end of the curved part 51A.

A rolled surface of the curved part 51A has a shape along a peripheral surface of the large diameter part 46D-1 of the rotation shaft part 46D, and is in contact with the peripheral surface. The rolled surface of the curved part 51A faces the large diameter part 46D-1 of the rotation shaft part 46D. The curve part 51A is configured to restrict the movement of the rotation shaft part 46D or the movable member 40 in the upward, front, or rear direction. The curved part 51A also functions as a rotation guiding part that can guide the rotation of the rotation shaft part 46D by being in contact with the peripheral surface of the large diameter part 46D-1 through the rolled surface. Thus, making the curved part 51A of the movement restricting part 51 function as the guiding part that guides the rotation of the rotation shaft part 46D eliminates the necessity of providing the guiding part additionally.

In the present embodiment, the curve part 51A is positioned in contact with the rotation shaft part 46D. Instead of this, the curved part 51A may be positioned with some space from the rotation shaft part 46D. In this case, the curved part 51A restricts the upward movement of the rotation shaft part 46D over a predetermined amount corresponding to the size of the space.

The front held part 52 is extended straight further to the front from a front end of the front straight part 51B as illustrated in FIG. 6A. The front held part 52 is embedded in and held by the housing 10. The rear held part 53 is extended to the rear from the rear straight part 51C and extended downward and further to the rear as illustrated in FIG. 6A. The rear held part 53 has a crank shape as a whole, and is embedded in and held by the housing 10. The fixing part 54 is extended straight from the rear held part 53 to the rear and is extended from the side wall 15. The fixing part 54 is positioned so that its lower surface comes to substantially the same height as the lower surface of the housing 10. The fixing part 54 is fixed through solder connection to the corresponding part on the mount surface of the circuit board.

In the present embodiment, the metal part 50 is held by the housing 10 through the front held part 52 and the rear held part 53. Thus, the metal part 50 can be held by the housing 10 at a position of the movement restricting part 51 that is close to both ends in a longitudinal direction. That is to say, the movement restricting part 51 is held by a double fixed beam shape. Therefore, when the movement of the rotation shaft part 46D of the movable member 40 is restricted by the movement restricting part 51, the movement restricting part 51 can resist with enough strength against the contact force from the rotation shaft part 46D.

The connector 1 with the above structure is produced in accordance with the following procedure.

Figure 6B:
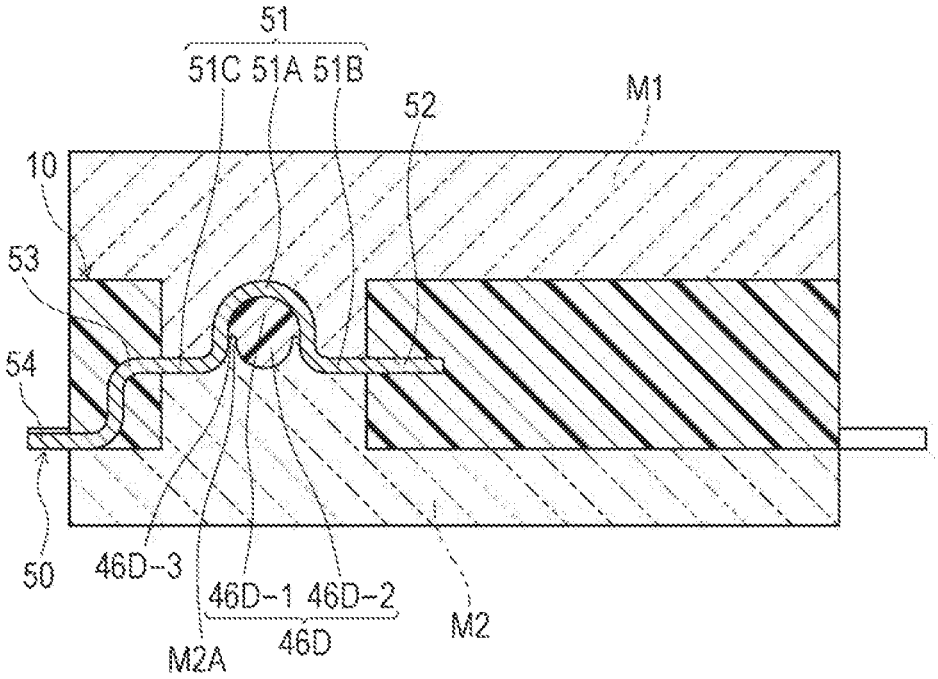

First, the terminals 20, 30 and the metal parts 50 are disposed in a die (upper die M1, lower die M2, and rear die M3 to be described below) and held by the die in a manner that the rolled surfaces of the terminals 20, 30 and the metal parts 50 are parallel to the connector width direction (see FIG. 4A). Specifically, the first contact arm part 21 of the first terminal 20, the held arm part 32 of the second terminal 30, and the movement restricting part 51 of the metal part 50 are held by the upper die M1 disposed from above, the lower die M2 disposed from below, and the rear die M3 disposed from behind (see FIG. 7B). Here, the upper die M1 is brought into contact with the upper surface of the entire movement restricting part 51 at the position of the metal part 50 in the connector width direction as illustrated in FIG. 6B. Furthermore, the lower die M2 is in contact with the lower surface of the curved part 51A of the movement restricting part 51 except the upper half part. In this manner, the upper surface and the lower surface corresponding to the flat rolled surface of the movement restricting part 51 are used as the contact surfaces with the dies.

In the present embodiment, as illustrated in FIG. 6B, an end part M2A of the lower die M2 is disposed at a position corresponding to the step part 46D-3 formed at the border between the large diameter part 46D-1 and the small diameter part 46D-2 in the rotation shaft part 46D. The step part 46D-3 is formed to have the dimension corresponding to the difference between the radius of the large diameter part 46D-1 and the radius of the small diameter part 46D-2 in the front-rear direction (X-axis direction). Therefore, the end part M2A of the lower die M2 is also formed to have the corresponding thickness. Thus, the strength in accordance with the thickness at the end part M2A of the lower die M2 can be secured. Accordingly, the damage in the end part M2A can be suppressed as appropriate.

Figure 7B:
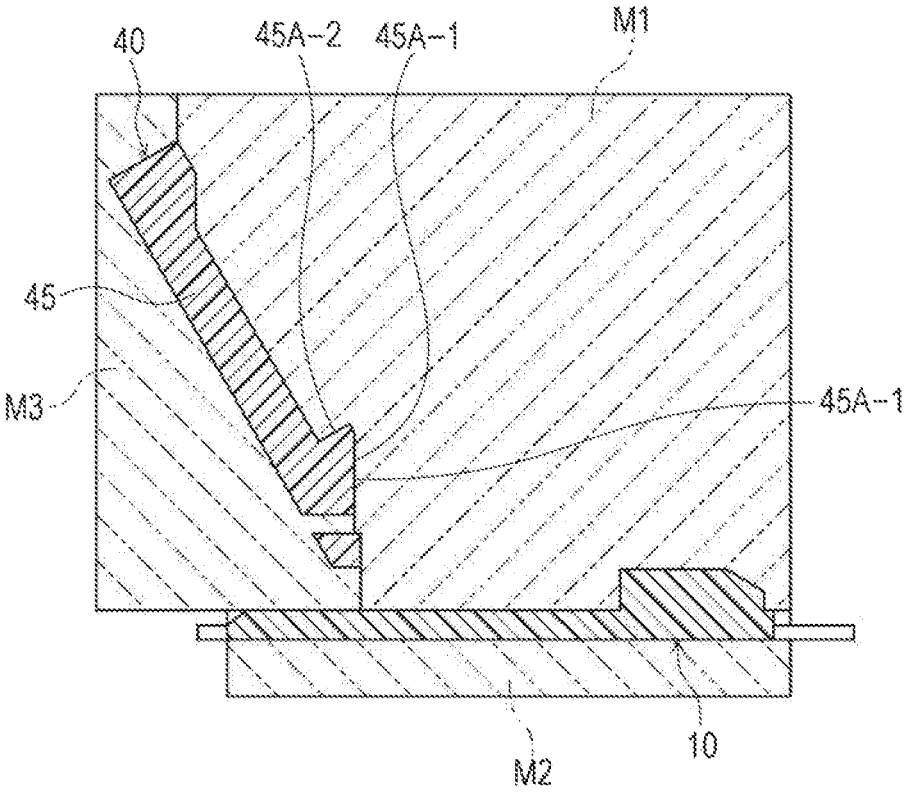

Next, an electrically insulating material that is melted is injected into the die and solidified, and thus the housing 10 and the movable member 40 are molded at the same time. In addition, the terminals 20, 30 and the metal parts 50 are held by the housing 10 by the integral molding. As a result of this integral molding, the movement restricting part 51 of the metal part 50 is formed within the housing hole part 15A of the housing 10 (see FIG. 6A) at the position of the metal part 50 in the connector width direction as illustrated in FIG. 6B. Furthermore, the rotation shaft part 46D of the movable member 40 is formed in the space surrounded by an inner rolled surface of the curved part 51A of the movement restricting part 51 and the lower die M2 in a state where an outer peripheral surface of the large diameter part 46D-1 is in contact with the inner rolled surface of the curved part 51A. As illustrated in FIG. 7B, the movable member 40 is molded in a state of being present at the open position.

Next, the upper die M1 is moved upward (Z1 direction), the lower die M2 is moved downward (Z2 direction), and the rear die M3 is moved to the rear (X2 direction), all of which are moved straight, so that the dies M1, M2, and M3 are released. In the present embodiment, the movable member 40 is molded in the state of being present at the open position as described above. Therefore, just after the molding, the guiding surface 45A-1 of the engaging part 45A is extended straight in the up-down direction when the movable member 40 is viewed in the connector width direction as illustrated in FIG. 7B. Thus, when the upper die M1 is released, the upper die M1 can be removed upward along the guiding surface 45A-1. Therefore, the connector 1 can be produced by the use of the upper die M1 with a simple shape.

After the dies M1, M2, and M3 are released, the operation of rotating the movable member 40 from the open position to the closed position is performed. This operation can cause the rotation shaft part 46D of the movable member 40 to be separated from the inner rolled surface of the curved part 51A of the metal part 50. Thus, the movable member 40 becomes movable. Thus, the connector 1 is completed and becomes usable. Here, since the inner rolled surface of the curved part 51A is smooth, it is easy to separate the rotation shaft part 46D. This operation of rotating the movable member 40 may be performed in any stage after the dies M1, M2, and M3 are released. This rotating operation may be performed by a producer before the connector 1 is shipped or by a user after the connector is shipped and before the connector is used.

The connector 1 according to the present embodiment can be produced by integrally molding the terminals 20, 30 and the metal parts 50 at the same time as the housing 10 and the movable member 40 and by moving the movable member 40 between the open position and the closed position. Therefore, it is no longer necessary to process the components of the connector at all after the integral molding. In the present embodiment, the connector 1 can be produced easily with fewer steps. Since the steps are fewer, the connector 1 can be produced at lower cost.

Next, the operation of connecting the connector 1 and the flat conductor FA is described with reference to FIG. 8A to FIG. 8C, FIG. 9A to FIG. 9C, and FIG. 10A to FIG. 10C. FIG. 8A to FIG. 8C are longitudinal cross-sectional views of the connector 1 just before the flat conductor FA is inserted, which is taken along a plane (XZ plane) perpendicular to the connector width direction. FIG. 9A to FIG. 9C are longitudinal cross-sectional views of the connector 1 after the flat conductor FA is inserted, which is taken along the XZ plane. FIG. 10A to FIG. 10C are cross-sectional views of the connector 1 just before the flat conductor FA is removed, which is taken along the XZ plane. FIG. 8A, FIG. 9A, and FIG. 10A are cross-sectional views at the position of the first terminal 20. FIG. 8B, FIG. 9B, and FIG. 10B are cross-sectional views at the position of the second terminal 30. FIG. 8C, FIG. 9C, and FIG. 10C are cross-sectional views at the position of the engaging part 45A of the movable member 40.

First, the first connection part 22 of the first terminal 20 and the second connection part 34 of the second terminal 30 in the connector 1 are connected by soldering to the corresponding circuit part of the circuit board (not shown). In addition, the fixing part 54 of the metal part 50 is connected by soldering to the corresponding part of the circuit board. By the solder connection of the first connection part 22, the second connection part 34, and the fixing part 54, the connector 1 is attached to the circuit board.

Next, as illustrated in FIG. 8A to FIG. 8C, the flat conductor FA is positioned so as to be extended in the front-rear direction along the mount surface of the circuit board (not shown) behind the connector 1 with the movable member 40 at the closed position (see also FIG. 1). Next, the flat conductor FA facing forward is inserted into the reception part 17A of the connector 1.

In the process of inserting the flat conductor FA into the reception part 17A, the front end of the flat conductor FA is first brought into contact with the first contact part 21A of the first contact arm part 21 of the first terminal 20 as illustrated in FIG. 9A. The front end of the flat conductor FA having received the upward component force of the contact force pushes up the first contact part 21A to deform the first contact part 21A elastically upward. Here, the first contact arm part 21 having been elastically deformed is housed in the first elastic deformation allowing part 40A of the movable member 40 as illustrated in FIG. 9A. As the flat conductor FA is inserted further, the front end of the flat conductor FA is brought into contact with the second contact part 31A of the second contact arm part 31 of the second terminal 30 as illustrated in FIG. 9B. The front end of the flat conductor FA pushes up the second contact part 31A, so that the second contact part 31A is elastically deformed upward. The front end of the flat conductor FA advances so as to spread out a space between the second contact arm part 31 and the held arm part 32. Here, the second contact arm part 31 having been elastically deformed is housed in the second elastic deformation allowing part 40B of the movable member 40 as illustrated in FIG. 9B.

As illustrated in FIG. 9A and FIG. 9B, the first contact arm part 21 of the first terminal 20 and the second contact arm part 31 of the second terminal 30 remain elastically deformed even after the insertion of the flat conductor FA is completed. As a result, the first contact part 21A and the second contact part 31A remain in pressure contact with the first connection circuit part FA1-1 and the second connection circuit part FA1-2 of the flat conductor FA, respectively (see FIG. 1).

In addition, in the process of inserting the flat conductor FA into the reception part 17A, the ear part FA3 positioned near each end in the width direction of the flat conductor FA is in contact and sliding contact with the guiding surface 45A-1 of the engaging part 45A provided to the engaging arm part 45 of the movable member 40. Thus, the flat conductor FA is guided to the correct inserting position in the up-down direction. In addition, the ear part FA3 causes the engaging arm part 45 to be elastically deformed upward with the component force in the up-down direction of the contact force with the guiding surface 45A-1. Thus, the engaging arm part 45 is disposed at the position where the insertion of the flat conductor FA is allowed. In addition, as the flat conductor FA is inserted and the ear part FA3 passes the position of the engaging part 45A, the engaging arm part 45 is displaced downward so that the amount of elastic deformation is reduced, returned to the free state, and enters the cut part FA2 of the flat conductor FA. As a result, the engaged part FA3-1 of the flat conductor FA in the state where the flat conductor FA is completely inserted as illustrated in FIG. 9C is positioned so as to be engaged with the engaging surface 45A-2 ahead of the engaging surface 45A-2 of the engaging part 45A. Thus, the removal of the flat conductor FA to the rear is inhibited. Note that the engaging arm part 45 does not need to be returned to the free state completely. In one example, the engaging part 45A may be positioned to be engaged with the engaged part FA3-1 with the engaging part 45A entering the cut part FA2 of the flat conductor FA in a state where the amount of elastic deformation of the engaging arm part 45 is left only a little.

When the flat conductor FA in the state illustrated in FIG. 9A to FIG. 9C, that is, the state where the flat conductor FA connected to the connector 1 is removed from the connector 1 on purpose, the movable member 40 at the closed position is rotated to bring the movable member 40 to the open position as illustrated in FIG. 10A to FIG. 10C. As illustrated in FIG. 10C, when the movable member 40 is at the open position, the engaging part 45A of the engaging arm part 45 of the movable member 40 is positioned to be released upward from the cut part FA2 of the flat conductor FA. That is to say, the engaged state of the engaging part 45A with the engaged part FA3-1 of the flat conductor FA is canceled to allow the flat conductor FA to be released to the rear. Pulling the flat conductor FA to the rear in this state can easily remove the flat conductor FA from the connector 1 easily.

Second Embodiment

A connector according to a second embodiment is a connector that is disposed on the mount surface of the circuit board and has the flat conductor removably connected thereto in a front-rear direction that is parallel to the mount surface. The connector according to the second embodiment includes the housing to which the flat conductor is inserted, the terminals and metal parts held by the housing, and the movable member that is rotatable relative to the housing. The connector according to the second embodiment is common to the connector according to the first embodiment in these points. On the other hand, the connector according to the second embodiment is different from the connector according to the first embodiment in point of having just one kind of terminals and having three kinds of metal parts. The structure of the connector according to the second embodiment is described mainly about the point different from the connector according to the first embodiment.

Figure 11:
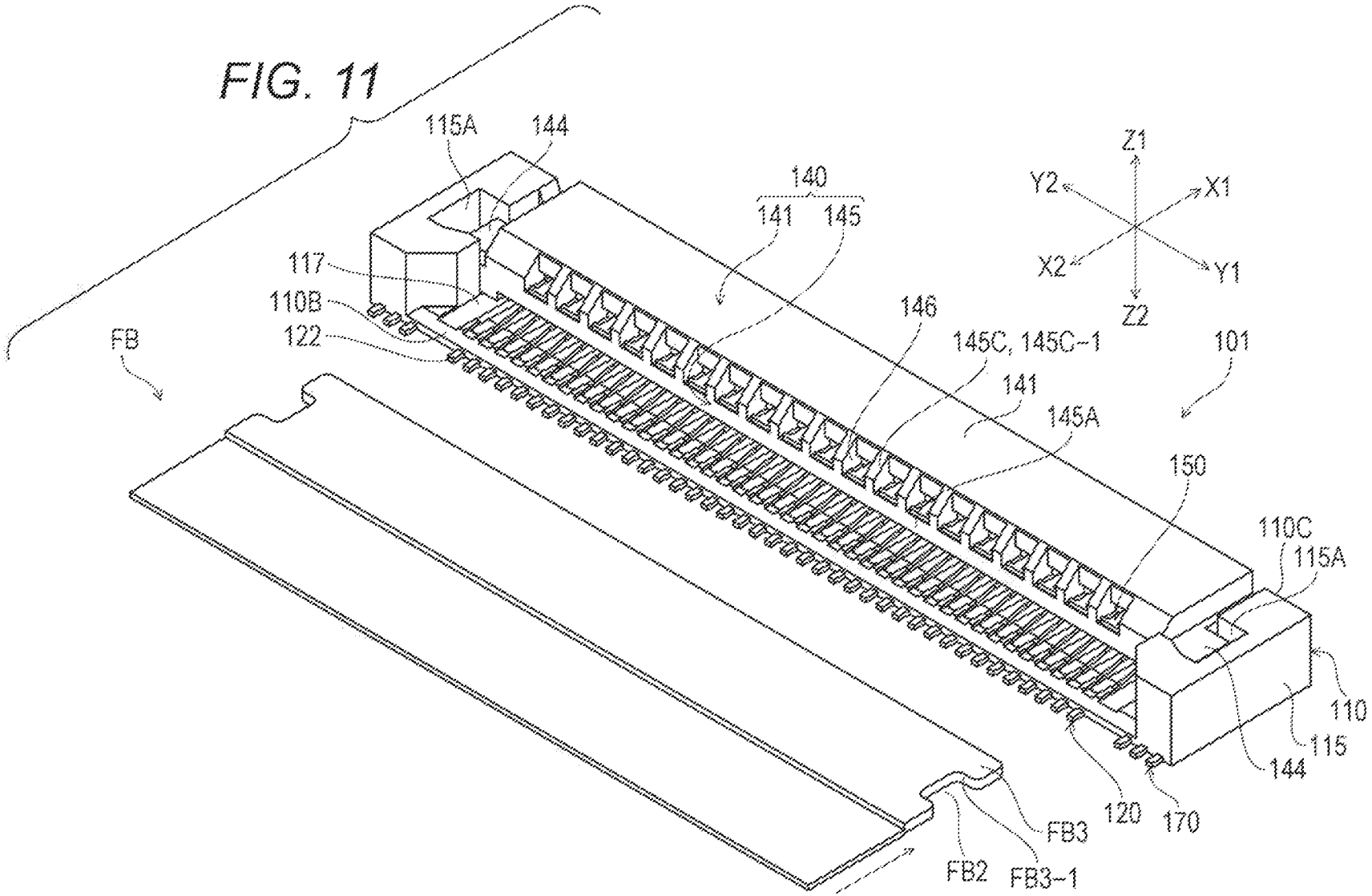
FIG. 11 is a perspective view of a flat conductor and an electric connector for a circuit board according to a second embodiment in a state just before the flat conductor is inserted.

FIG. 11 is a perspective view illustrating a flat conductor FB and an electric connector for a circuit board according to the present embodiment (this connector is hereinafter referred to as "connector 101") just before the flat conductor FB is inserted. In the flat conductor FB according to the present embodiment, a cut part FB2 is formed at each side edge of a front end part similarly to the flat conductor FA according to the first embodiment. The cut part FB2 includes an ear part FB3 at the front. A rear edge of the ear part FB3 functions as an engaged part FB3-1 to be engaged with an engaging part of the connector 101 to be described below. In the flat conductor FB according to the present embodiment, a connection circuit part (not shown) is exposed from a lower surface of a front end part of the flat conductor FB. In this point, the second embodiment is different from the first embodiment in which the connection circuit part FA1 is formed on the upper surface of the flat conductor FA.

Figures 14A, 14B:
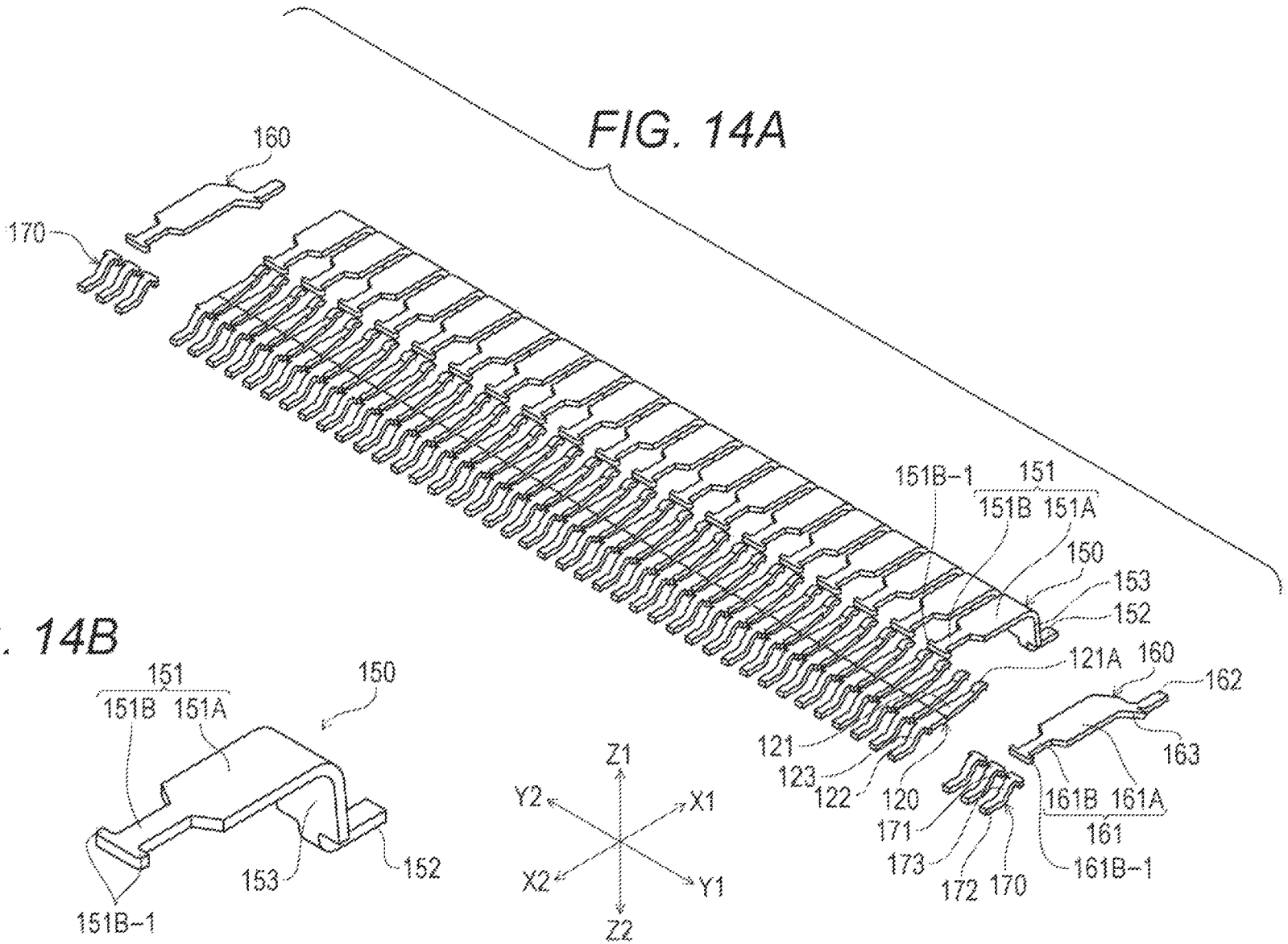
FIG. 14A is a perspective view illustrating terminals, first metal parts, second metal parts, and third metal parts extracted from the electric connector for a circuit board illustrated in FIG. 11.
FIG. 14B is a perspective view illustrating the first metal part alone.

The connector 101 includes a housing 110 and a movable member 140, each of which is formed of an electrically insulating material, and terminals 120, first metal parts 150, second metal parts 160, and third metal parts 170, each of which is formed of a metal member held by the housing 110 by the integral molding (see also FIG. 14A and FIG. 14B).

Figure 13A:
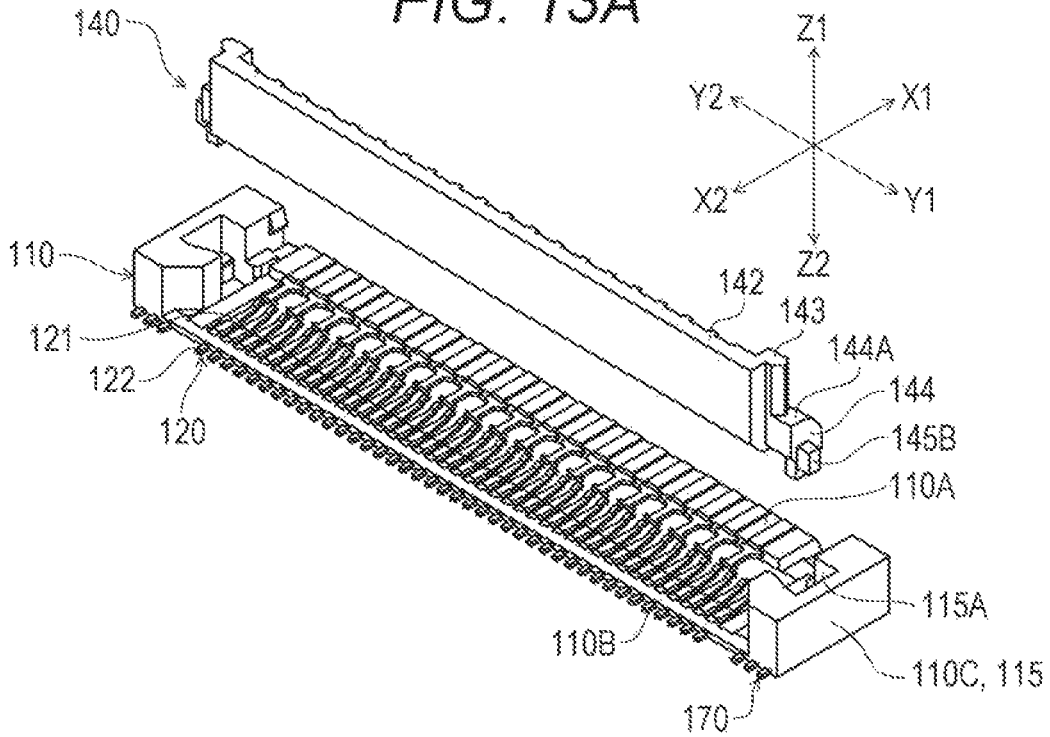
Figure 13B:
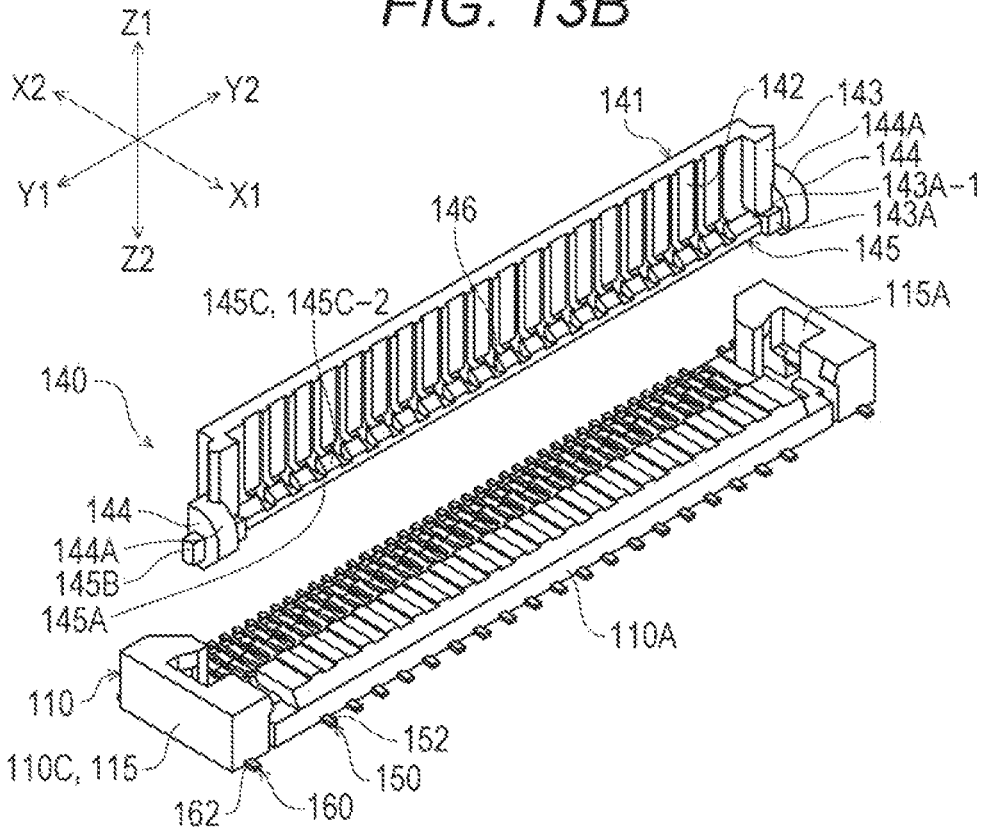

The housing 110 includes a front frame part 110A, a rear frame part 110B, and a side frame part 110C as illustrated in FIG. 13A and FIG. 13B in a manner similar to the housing 10 according to the first embodiment. The side frame part 110C includes a housing hole part 115A for housing an end plate part 144 and a second shaft part 145B of the movable member 140, which are described below. The housing hole part 115A is formed as a space at a position near a rear end of a side wall 115 of the side frame part 110C, the space penetrating in the up-down direction and being open inward in the connector width direction. As illustrated in FIG. 11, the housing 110 includes a reception part 117A for receiving the front end part of the flat conductor FB. The reception part 117A is formed to open to the rear at the position above the rear frame part 110B and below the movable member 140 (FIG. 16A).

Figure 16A:
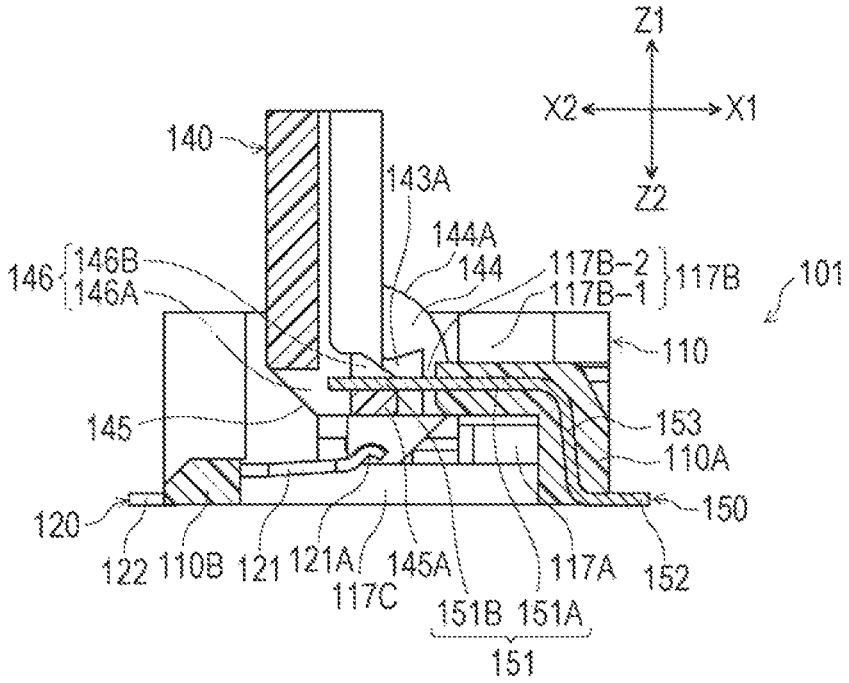
Figure 20A:
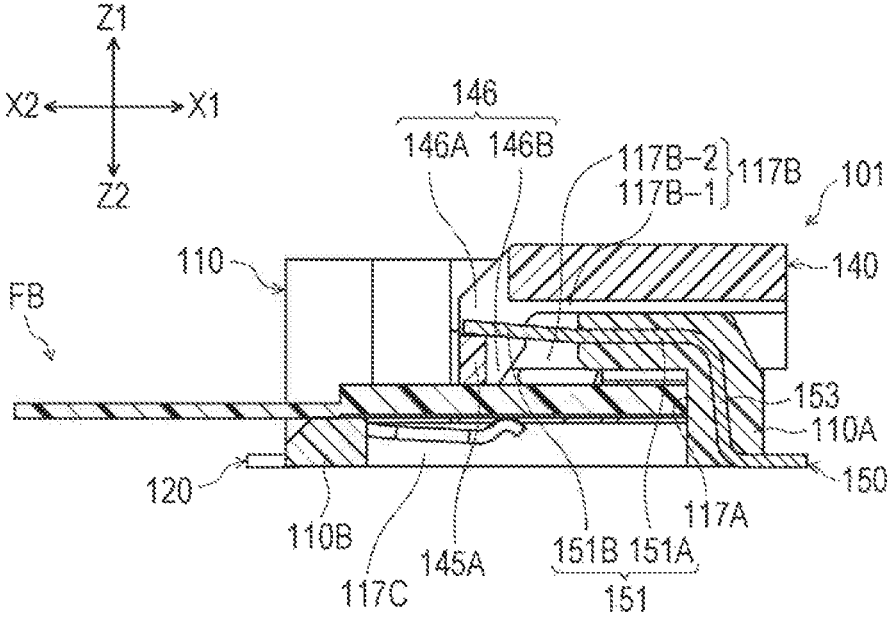

The housing 110 includes a housing concave part 117B for housing the movable member 140 above the reception part 117A (see FIG. 16A and FIG. 20A). The housing concave part 117B includes an upper concave part 117B-1 that is formed above the front frame part 110A and a lower concave part 117B-2 that is formed below the upper concave part 117B-1 and behind the front frame part 110A as illustrated in FIG. 16A. The lower concave part 117B-2 is formed as a space penetrating in the up-down direction and being open to the rear. The lower concave part 117B-2 communicates with the reception part 117A and the upper concave part 117B-1 in the up-down direction and houses the most part of a rotation base part 145 of the movable member 140. At the position corresponding to an upper arm part 151, which is described below, of the terminal 120 in the terminal arranging direction, the lower concave part 117B-2 serves as the housing part for housing a first shaft part 145A corresponding to the movement restricted part of the movable member 140 and a first narrow arm part 151B of the upper arm part 151 of the terminal 120 corresponding to a first metal part side restricting part as illustrated in FIG. 16A and FIG. 20A.

The connector 101 according to the present embodiment includes one kind of terminals 120. In this point, the connector 101 is different from the connector 1 according to the first embodiment in which the two kinds of terminals 20 and 30 are provided. As illustrated in FIG. 11, the terminals 120 are arranged and held by the housing 110 in the range of the reception part 117A of the housing 110 in the connector width direction. The terminal 120 has an approximately crank shape as illustrated in FIG. 13A, and includes a contact arm part 121, a connection part 122, and a coupling part 123 (see FIG. 14A). The contact arm part 121 is extended in the front-rear direction (X-axis direction) in a latter half part (part on X2 side) of the connector 101 and is elastically deformable in the up-down direction (Z-axis direction). The connection part 122 is extended to the rear at a position below the contact arm part 121. The coupling part 123 couples between a rear end of the contact arm part 121 and a front end of the connection part 122.

As illustrated in FIG. 14A, the contact arm part 121 of the terminal 120 becomes narrower toward the front. The contact arm part 121 includes a contact part 121A that is bent so as to protrude upward at the position near the front end. When the flat conductor FB is inserted into the connector 101, the contact arm part 121 facing downward is elastically deformed, so that the contact part 121A can be in contact with a connection circuit part (not shown) of the flat conductor FB (see FIG. 19A). The connection part 122 is extended to the rear from the rear frame part 110B of the housing 110 as illustrated in FIG. 11. The connection part 122 is connected by soldering to a circuit part of a circuit board (not shown) on the lower surface thereof. The coupling part 123 is held by the rear frame part 110B of the housing 110 by the integral molding.

In FIG. 11, the movable member 140 has the posture of the closed position. As illustrated in FIG. 11, the movable member 140 includes a main body part 141 with an approximately plate shape that expands in the front-rear direction (X-axis direction) and the connector width direction (Y-axis direction), and the rotation base part 145 that is extended in the connector width direction on the rear side (X2 side) and the lower side (Z2 side) relative to the main body part 141 and includes a rotation axial line.

As illustrated in FIG. 11, the main body part 141 includes a cover plate part 142, end wall parts 143, and the end plate parts 144. The cover plate part 142 is extended in the range where the terminals are arranged in the connector width direction, and covers the terminals 120 at the closed position from above. The end wall part 143 is positioned outside the cover plate part 142 in the connector width direction and is extended in the up-down direction (front-rear direction in FIG. 11) as illustrated in FIG. 13A and FIG. 13B. The end plate part 144 is positioned outside the end wall part 143 in the connector width direction and is housed in the housing hole part 115A of the housing 110.

While the movable member 140 is in a rising position, the end wall part 143 is positioned in front of the cover plate part 142 (lower side in FIG. 11), and is extended in the up-down direction (front-rear direction in FIG. 11) as illustrated in FIG. 13A and FIG. 13B. As illustrated in FIG. 13B, a lower end part of the end wall part 143 includes an engaging part 143A that protrudes to the front. As illustrated in FIG. 13A and FIG. 13B, an upper surface of the engaging part 143A forms an engaging surface 143A-1 that is inclined upward toward the front (see also FIG. 19B). While the movable member 140 is at the closed position, that is, the engaging surface 143A-1 is inclined forward toward the lower side, the engaging surface 143A-1 can be engaged with the engaged part FB3-1 of the flat conductor FB from behind (see FIG. 20B).

Figure 12A:
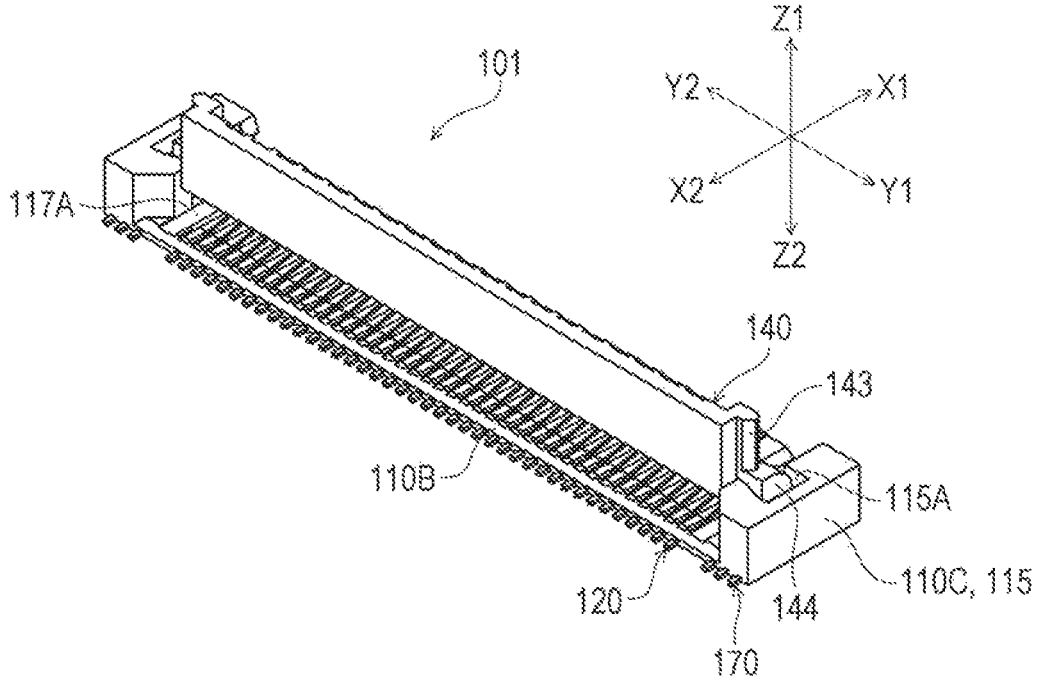
Figure 12B:
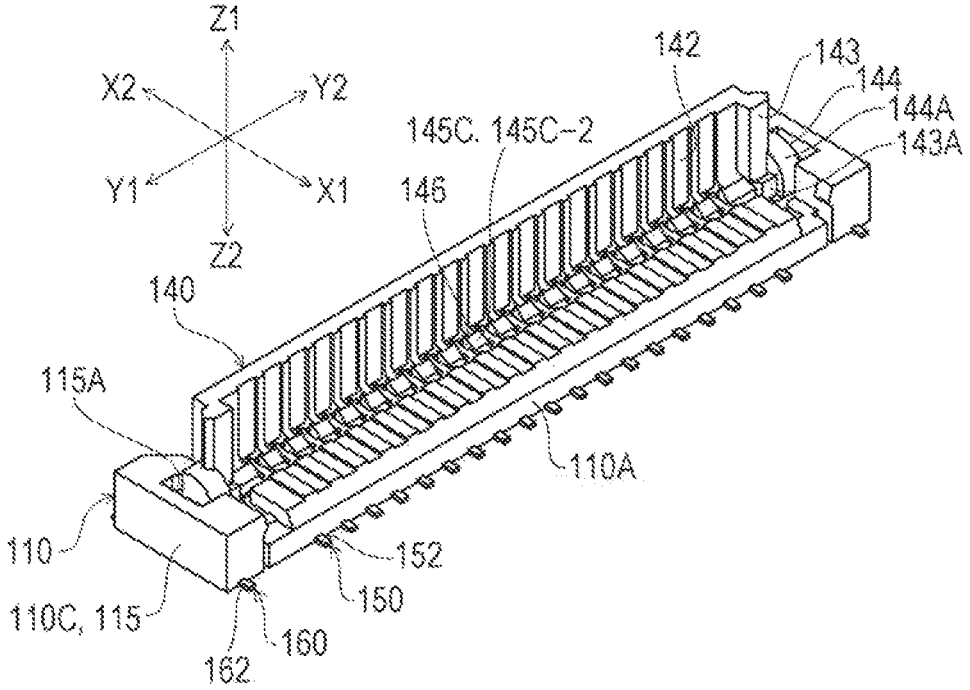
Figure 18A:
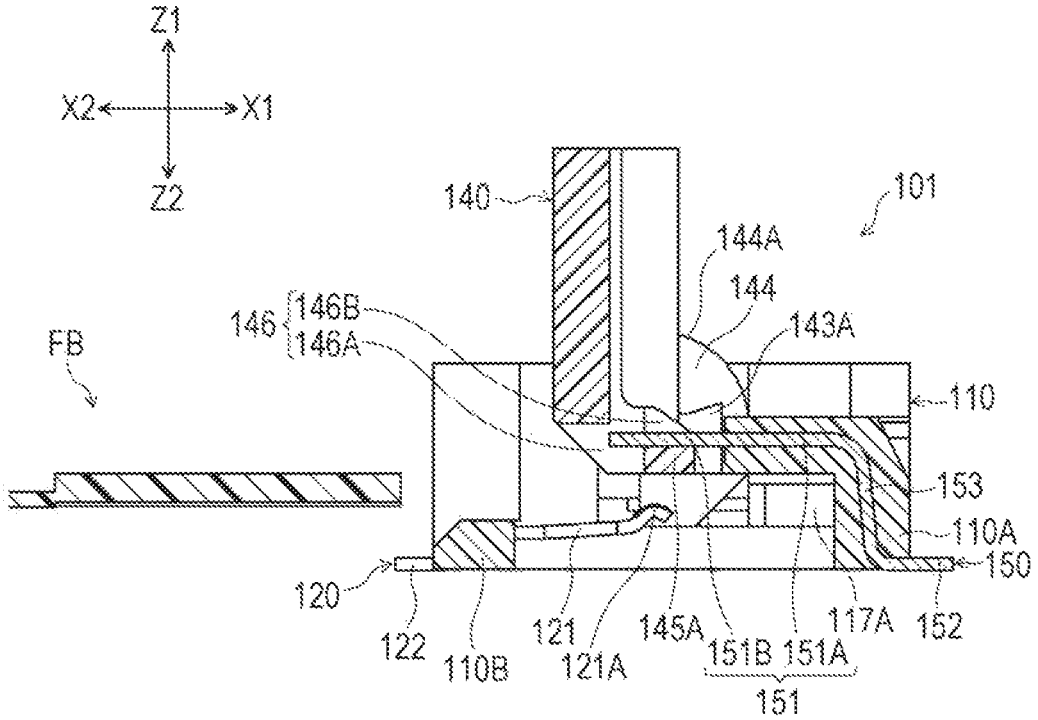
Figure 18B:
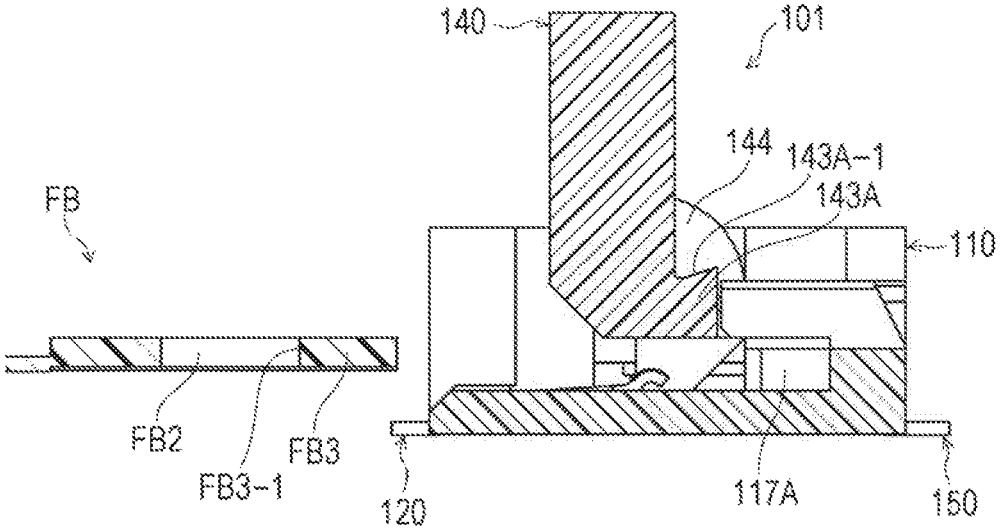

As illustrated in FIG. 13A and FIG. 13B, the end plate part 144 includes an approximately fan-like shape that is curved so as to protrude upward and forward when viewed in the connector width direction (see also FIG. 18A and FIG. 18B). The end plate part 144 is housed in the housing hole part 115A of the housing 110 as illustrated in FIG. 11, FIG. 12A, and FIG. 12B. When the movable member 140 is rotated between the open position and the closed position, a convex curved surface 144A of the end plate part 144 is in sliding contact with a front inner wall surface of the housing hole part 115A (the front one of the inner wall surfaces of the housing hole part 115A facing each other in the front-rear direction) so as to be guided in the rotating direction.

As illustrated in FIG. 13B, the rotation base part 145 includes the first shaft part 145A as the rotation shaft part that is extended in the range including the terminal arranging range, the second shaft part 145B as the rotation shaft part with a prismatic columnar shape that is extended outward in the terminal arranging direction from both end surfaces of the end plate part 144, and a plurality of coupling parts 145C that couple the first shaft part 145A to the main body part 141.

Figure 16B:
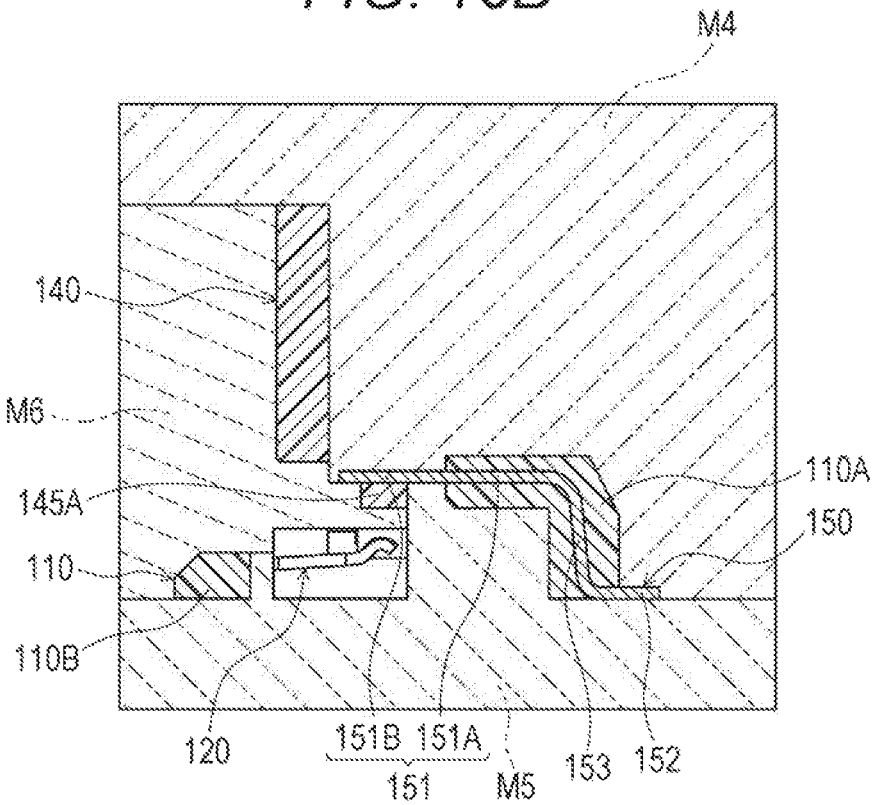

As illustrated in FIG. 16A and FIG. 16B, the first shaft part 145A has a rectangular shape whose cross section perpendicular to the connector width direction when the movable member 140 is at the open position is extended in the front-rear direction. The first shaft part 145A is extended in the range including the terminal arranging range as described above. The first shaft part 145A couples between inner side surfaces of the end wall part 143 (side surfaces positioned inward in the connector width direction) (see FIG. 13B). When the movable member 140 is positioned at any angular position in the rotating direction, the part of the first shaft part 145A that is positioned in accordance with the first metal part 150 in the connector width direction comes right below the first narrow arm part 151B of the first metal part 150 corresponding to the first metal part side restricting part. The first shaft part 145A functions as the movement restricted part whose upward movement is restricted by the first narrow arm part 151B (see FIG. 17A, FIG. 17B, FIG. 18A, FIG. 18B, FIG. 19A, FIG. 19B, FIG. 20A, and FIG. 20B).

As illustrated in FIG. 13A and FIG. 13B, the second shaft part 145B has a rectangular shape extended in the up-down direction when viewed in the connector width direction when the movable member 140 is at the open position. The second shaft part 145B is housed in the housing hole part 115A of the housing 110 together with the aforementioned end plate part 144. The second shaft part 145B is positioned right above a second metal part side restricting part 161C of the second metal part 160 to be described below when the movable member 140 is positioned at any angle in the rotating direction. The second shaft part 145B functions as the movement restricted part whose downward movement is restricted by the second metal part side restricting part 161C (see FIG. 17A and FIG. 17B).

Figure 15A:
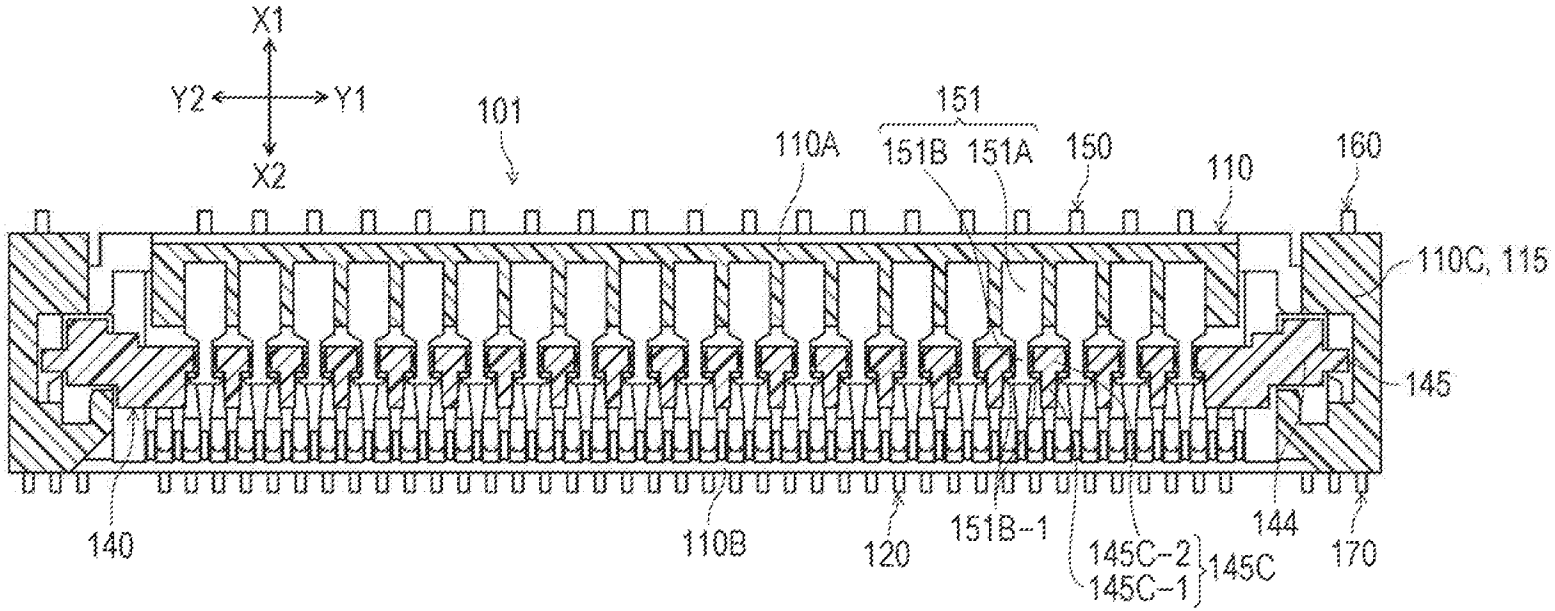
FIG. 15A is a lateral cross-sectional view illustrating the electric connector for a circuit board illustrated in FIG. 12A and FIG. 12B at a position of the first metal part in an up-down direction.
Figure 15B:
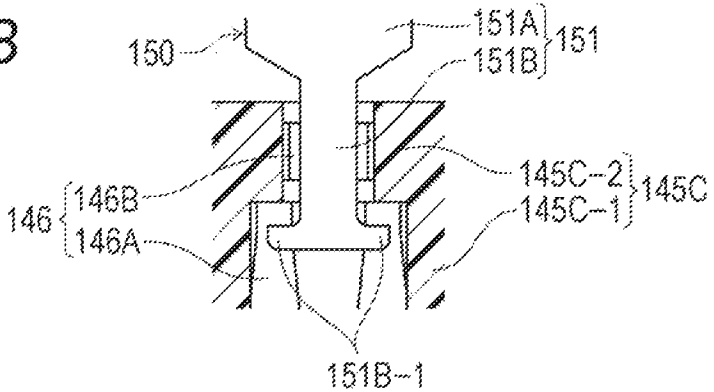
FIG. 15B is a partial magnified view of a protrusion of the first metal part illustrated in FIG. 15A and its vicinity.

The coupling part 145C is positioned to come between the two first metal parts 150 that are adjacent to each other. The coupling part 145C includes a narrow coupling part 145C-1 and a wide coupling part 145C-2. The narrow coupling part 145C-1 couples between a rear surface of the main body part 141 and an upper surface of the first shaft part 145A while the movable member 140 is at the closed position as illustrated in FIG. 11. As illustrated in FIG. 13B, the wide coupling part 145C-2 couples between a front end of the narrow coupling part 145C-1 and the upper surface of the first shaft part 145A while the movable member 140 is at the open position. As illustrated in FIG. 15A and FIG. 15B, the wide coupling part 145C-2 is formed to be larger than the narrow coupling part 145C-1 in the connector width direction. The border position between the narrow coupling part 145C-1 and the wide coupling part 145C-2 forms a step shape.

Between the two coupling parts 145C that are adjacent to each other, an entry allowing part 146 is formed penetrating in the front-rear direction. The entry allowing part 146 allows the first narrow arm part 151B of the first metal part 150, which is described below, to enter from the front. The entry allowing part 146 includes a rear end housing part 146A and a penetration allowing part 146B as illustrated in FIG. 15B. The rear end housing part 146A is positioned between the narrow coupling parts 145C-1 and houses the rear end part of the first narrow arm part 151B while the movable member 140 is at the open position. The penetration allowing part 146B is positioned between the wide coupling parts 145C-2, has narrower width than the rear end housing part 146A, and allows the penetration of the first narrow arm part 151B (see also FIG. 18A). In addition, as illustrated in FIG. 18A, the first half part of the rear end housing part 146A has a hole shape that penetrates in the up-down direction while the movable member 140 is at the open position. Furthermore, the latter half part of the rear end housing part 146A has a groove shape that opens downward. In addition, the penetration allowing part 146B has a groove shape that opens upward.

As illustrated in FIG. 14A and FIG. 14B, the first metal part 150 is formed in a manner that a metal plate with a belt shape whose terminal width direction coincides with the connector width direction (Y-axis direction) is bent in the plate thickness direction. The first metal part 150 includes an approximately crank shape as a whole, and includes the upper arm part 151, a first fixing part 152, and a first coupling part 153 (see also FIG. 16A). The upper arm part 151 is extended in the front-rear direction (X-axis direction). The first fixing part 152 is disposed below the upper arm part 151 and extended to the front. The first coupling part 153 couples between a front end of the upper arm part 151 and a rear end of the first fixing part 152.

The upper arm part 151 includes a first wide arm part 151A, and the first narrow arm part 151B as the first metal part side restricting part as illustrated in FIG. 15A. The first wide arm part 151A is embedded in and held by the front frame part 110A of the housing 110 by the integral molding (see also FIG. 18A). The first narrow arm part 151B is extended to the rear from the first wide arm part 151A. The rear end part of the first wide arm part 151A is extended from the rear surface of the front frame part 110A to the rear. The rear end part of the first wide arm part 151A and the first narrow arm part 151B are housed in the lower concave part 117B-2 of the housing concave part 117B of the housing 110 (see also FIG. 16A). The first narrow arm part 151B is narrower than the first wide arm part 151A in the connector width direction as illustrated in FIG. 15A and FIG. 15B. At the rear end part (free end part) of the first narrow arm part 151B, protrusions 151B-1 that protrude to both sides in the connector width direction are formed. The first narrow arm part 151B includes a part extended more to the front and to the rear than the first shaft part 145A of the movable member 140 in the front-rear direction as illustrated in FIG. 16A and FIG. 16B. In this part, a rolled surface is exposed.

The first narrow arm part 151B is positioned above the first shaft part 145A of the movable member 140 when the movable member 140 is disposed at any angle position in the rotating direction. The first narrow arm part 151B in contact with the first shaft part 145A restricts the upward movement of the first shaft part 145A or the movable member 140. The first narrow arm part 151B suppresses the upward disconnection of the movable member 140 from the housing 110 (see FIG. 16A and FIG. 20A). In the present embodiment, the lower surface of the first narrow arm part 151B is in surface contact with the upper surface of the first shaft part 145A when the movable member 140 is either at the open position (see FIG. 16A) or at the closed position (see FIG. 20A).

In the present embodiment, the first narrow arm part 151B is positioned in contact with the first shaft part 145A. Alternatively, the first narrow arm part 151B may be positioned with some space in the up-down direction from the first shaft part 145A. In this case, the first narrow arm part 151B restricts the upward movement of the first shaft part 145A over a predetermined amount corresponding to the size of the aforementioned space.

The first narrow arm part 151B enters the entry allowing part 146 of the movable member 140 from the front. Specifically, the first narrow arm part 151B is penetrated into the penetration allowing part 146B of the entry allowing part 146. A rear end part of the first narrow arm part 151B reaches out of the penetration allowing part 146B and is positioned within the rear end housing part 146A. As illustrated in FIG. 15B, the protrusion 151B-1 formed at the rear end part of the first narrow arm part 151B is positioned so as to face and be engaged with a rear surface of the wide coupling part 145C-2 formed at the rotation base part 145 of the movable member 140 within the rear end housing part 146A. As a result, the disconnection of the movable member 140 from the housing 110 to the rear is suppressed.

The rear end part of the first fixing part 152 and the first coupling part 153 of the first metal part 150 are embedded in and held by the front frame part 110A of the housing 110 by the integral molding as illustrated in FIG. 16A (see also FIG. 18A). The front end part of the first fixing part 152 of the first metal part 150 is extended to the front from the front frame part 110A of the housing 110 (see also FIG. 12B, FIG. 13B, and FIG. 18A). The first fixing part 152 is fixed through solder connection to the corresponding part of the circuit board (not shown) on the lower surface of the front end part.

The second metal part 160 is provided at the same position as the housing hole part 115A of the housing 110 and the second shaft part 145B of the movable member 140 in the connector width direction. As illustrated in FIG. 14A, the second metal part 160 is formed in a manner that a metal plate member with the same shape as the metal plate member used to form the first metal part 150 is bent in the plate thickness direction. As will be described below, the second metal part 160 is different from the first metal part 150 in that the bending angle of the metal plate member is smaller than 90° and a second coupling part 163 to be described below is inclined. The other structure of the second metal part 160 is the same as that of the first metal part 150. The components of the second metal part 160 that correspond to those of the first metal part 150 are denoted by the reference symbols of the components of the first metal 150 to which "10" is added and thus, the detailed description is omitted.

Figure 17A:
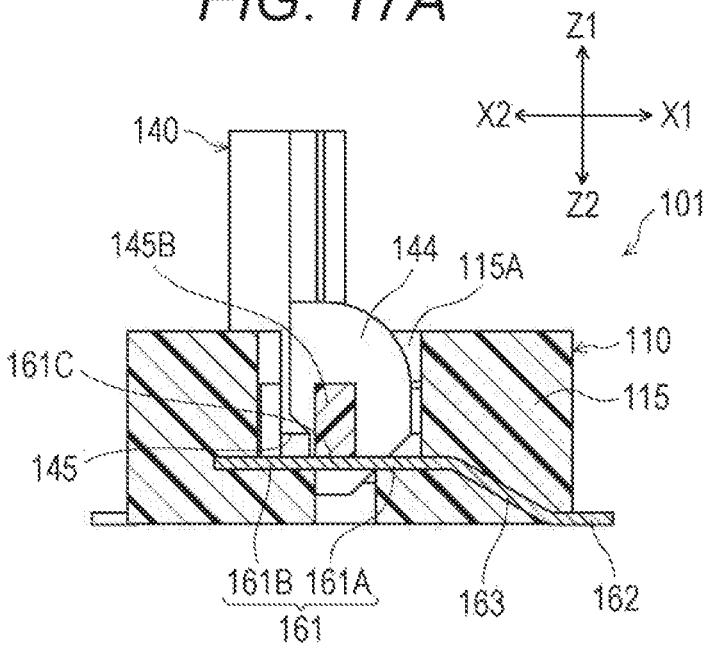
Figure 17B:
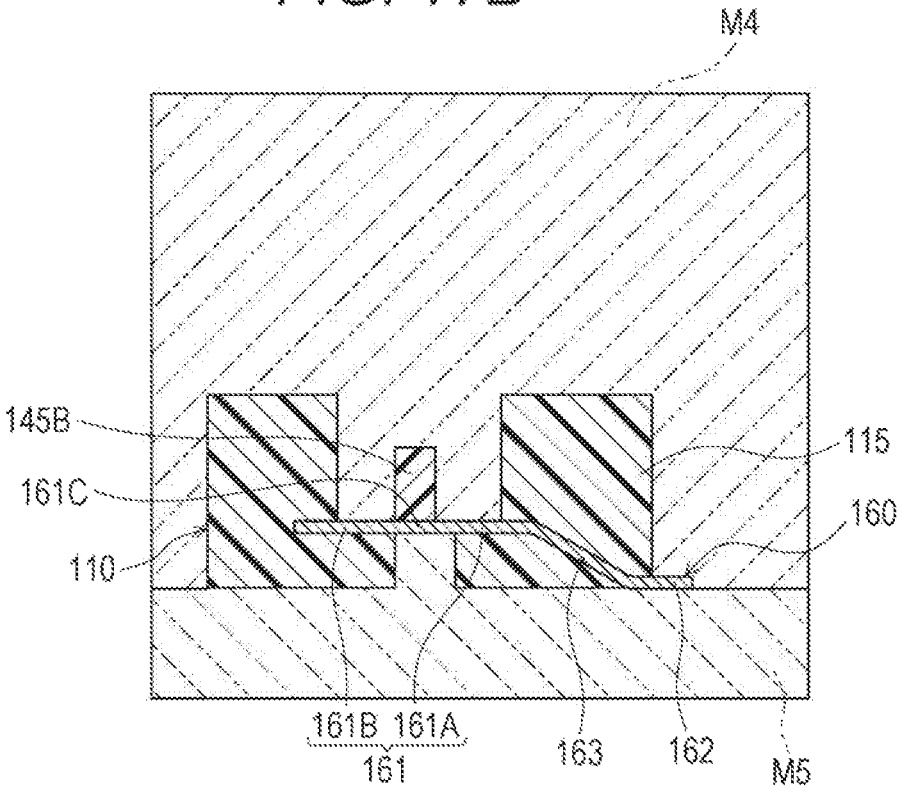

The second metal part 160 includes a lower arm part 161, a second fixing part 162, and the second coupling part 163. The lower arm part 161 is extended in the front-rear direction (X-axis direction). The second fixing part 162 is extended to the front at a position lower than the lower arm part 161. The second coupling part 163 couples between a front end of the lower arm part 161 and a rear end of the second fixing part 162. The second metal part 160 has an approximately crank shape as a whole. However, in the second metal part 160, the bending angle of the metal plate member is smaller than 90°. Therefore, as illustrated in FIG. 17A and FIG. 17B, the second coupling part 163 is inclined downward toward the front. Therefore, in the posture of the second metal part 160 that is held by the housing 110, that is, the posture in which the terminal width direction coincides with the connector width direction (Y-axis direction), the lower arm part 161 of the second metal part 160 is positioned lower than the upper arm part 151 of the first metal part 150.

As illustrated in FIG. 14A, the lower arm part 161 includes a second wide arm part 161A and a second narrow arm part 161B with the same shape as the first wide arm part 151A and the first narrow arm part 151B of the first metal part 150. As illustrated in FIG. 17A, the lower arm part 161 is extended in the range including the housing hole part 115A of the housing 110 in the front-rear direction at the intermediate position of the housing 110 in the up-down direction. A front end part of the second wide arm part 161A and a rear end part of the second narrow arm part 161B are held by the side wall 115 of the housing 110 by the integral molding. The lower arm part 161 includes a part that is extended more to the front and to the rear than the second shaft part 145B of the movable member 140. In this part, a rolled surface is exposed. In the present embodiment, protrusions 161B-1 are formed at the rear end of the second narrow arm part 161B. Therefore, as the protrusions 161B-1 are embedded in the side wall 115 by the integral molding, the lower arm part 161 is firmly held.

As illustrated in FIG. 17A, in the lower arm part 161, an intermediate part positioned in the housing hole part 115A in the front-rear direction is exposed. This exposed part forms the second metal part side restricting part 161C for restricting the movement of the second shaft part 145B of the movable member 140. The second metal part side restricting part 161C is positioned below the second shaft part 145B of the movable member 140 and restricts the downward movement of the second shaft part 145B or the movable member 140 when the movable member 140 is disposed at any angle position. Thus, the second metal part side restricting part 161C restricts the downward disconnection of the movable member 140 from the housing 110. In the present embodiment, the upper surface of the second metal part side restricting part 161C is in surface contact with the lower surface of the second shaft part 145B when the movable member 140 is either at the open position (see FIG. 17A) or at the closed position.

In the present embodiment, the second metal part side restricting part 161C is positioned in contact with the second shaft part 145B. Alternatively, the second metal part side restricting part 161C may be positioned with some space in the up-down direction from the second shaft part 145B. In this case, the second metal part side restricting part 161C restricts the downward movement of the second shaft part 145B over a predetermined amount corresponding to the size of the aforementioned space.

In the present embodiment, the lower arm part 161 of the second metal part 160 is held by the housing 110 at the front end part of the second wide arm part 161A and the rear end part of the second narrow arm part 161B as described above. Thus, the lower arm part 161 is held by the housing 110 at the position near both longitudinal ends of the second metal part side restricting part 161C. That is to say, the second metal part side restricting part 161C is held in the double fixed beam shape. Therefore, when the movement of the second shaft part 145B of the movable member 40 is restricted by the second metal part side restricting part 161C, the second metal part side restricting part 161C can resist against the contact force of the second shaft part 145B with enough strength.

As illustrated in FIG. 17A, the rear end part of the second fixing part 162 and the second coupling part 163 of the second metal part 160 are embedded in and held by the side wall 115 of the housing 110 by the integral molding. The front end part of the second fixing part 162 is extended to the front from the side wall 115 (see also FIG. 12B and FIG. 13B). The second fixing part 162 is fixed through connection by soldering to the corresponding part of the circuit board (not shown) on the lower surface of the front end part.

The third metal parts 170 are provided behind the second metal part 160 at the positions corresponding to the side wall 115 of the housing 110 in the connector width direction. The three third metal parts 170, which are arranged in the connector width direction, are held by the side wall 115. As illustrated in FIG. 14A, the third metal part 170 is formed in a manner that a metal plate member with a belt shape whose terminal width direction coincides with the connector width direction (Y-axis direction) is bent in the plate thickness direction. The third metal part 170 has a shape that a large part of the contact arm part 121 (part excluding the rear end part of the contact arm part 121) is removed from the terminal 120 described above. That is to say, the third metal part 170 includes a front end part 171 that is wider than the other part, a third fixing part 172, and a third coupling part 173. The third fixing part 172 is extended to the rear at a position lower than the front end part 171. The third coupling part 173 couples between a rear end of the front end part 171 and a front end of the third fixing part 172. The front end part 171 and the third coupling part 173 are embedded in and held by the side wall 115 of the housing 110 by the integral molding. The third fixing part 172 is extended from the side wall 115 of the housing 110 to the rear. The third fixing part 172 is fixed through solder connection to the corresponding part of the circuit board (not shown) on the lower surface thereof.

The connector 101 with the aforementioned structure is produced in accordance with the following procedure.

First, the terminals 120, the first metal parts 150, the second metal parts 160, and the third metal parts 170 are disposed in a die (upper die M4, lower die M5, and rear die M6 to be described below) and held by the die in a manner that the rolled surfaces of these members are parallel to the connector width direction (see FIG. 14A). Specifically, the connection parts 122 of the terminals 120, the upper arm parts 151 of the first metal parts 150, the lower arm parts 161 of the second metal parts 160, and the third fixing parts 172 of the third metal parts 170 are held by the upper die M4 disposed from above, the lower die M5 disposed from below, and the rear die M6 disposed from behind.

Here, as illustrated in FIG. 16B, the upper die M4 is in contact with the entire upper surface of the first narrow arm part 151B of the first metal part 150. The lower die M5 and the rear die M6 are respectively in contact with a front end area and a rear end area on the lower surface of the first narrow arm part 151B of the first metal part 150. Thus, the upper surface and the lower surface of the first narrow arm part 151B, which are the flat rolled surfaces, are used as the contact surfaces to be in contact with the dies. As a result, the space for forming the first shaft part 145A is formed surrounded by the first narrow arm part 151B, the lower die M5, and the rear die M6 as illustrated in FIG. 16B.

As illustrated in FIG. 17B, the upper die M4 is in contact with an area near the front end and an area near the rear end on the upper surface of the lower arm part 161 of the second metal part 160. The space for forming the second shaft part 145B is formed surrounded by the lower arm part 161, the upper die M4, and the lower die M5. As illustrated in FIG. 17B, the lower die M5 is in contact with an intermediate area in the front-rear direction on the lower surface of the lower arm part 161 of the second metal part 160. Thus, the upper surface and the lower surface of the lower arm part 161, which are the flat rolled surfaces, are used as the contact surfaces to be in contact with the dies.

Next, an electrically insulating material that is melted is injected into the die and solidified, and thus the housing 110 and the movable member 140 are molded at the same time. In addition, the terminals 120, the first metal parts 150, the second metal parts 160, and the third metal parts 170 are held by the housing 110 by the integral molding. As a result of this integral molding, at the position of the first metal part 150 in the connector width direction, the first shaft part 145A of the movable member 140 is formed with the upper surface thereof in contact with the lower surface of the first narrow arm part 151B in the space surrounded by the lower surface (rolled surface) of the first narrow arm part 151B of the upper arm part 151, the lower die M5, and the rear die M6 as illustrated in FIG. 16B. As illustrated in FIG. 16B, the movable member 140 is molded while the movable member 140 is at the open position. In addition, as illustrated in FIG. 17B, the second metal part side restricting part 161C constituting a part of the lower arm part 161 of the second metal part 160 is formed in the housing hole part 115A of the housing 110 (see FIG. 17A) at the position of the second metal part 160 in the connector width direction. Furthermore, the second shaft part 145B of the movable member 140 is formed with the lower surface thereof in contact with the upper surface of the second metal part side restricting part 161C in the space surrounded by the upper surface (rolled surface) of the second metal part side restricting part 161C, and the upper die M4.

Next, the upper die M4 is moved upward (Z1 direction), the lower die M5 is moved downward (Z2 direction), and the rear die M6 is moved to the rear (X2 direction), all of which are moved straight, so that the dies M4, M5, and M6 are released. After the dies M4, M5, and M6 are released, the operation of rotating the movable member 140 from the open position to the closed position is performed. Thus, the first shaft part 145A of the movable member 140 can be separated from the lower surface of the first narrow arm part 151B of the first metal part 150 corresponding to the first metal part side restricting part. In addition, the second shaft part 145B of the movable member 140 can be separated from the upper surface of the second metal part side restricting part 161C of the second metal part 160 and the movable member 140 can be made movable. Thus, the connector 101 is completed and becomes usable. Here, since the lower surface of the first narrow arm part 151B and the upper surface of the second metal part side restricting part 161C are the rolled surfaces and smooth. Therefore, it is easy to separate the first shaft part 145A and the second shaft part 145B. This operation of rotating the movable member 140 may be performed in any stage after the dies M4, M5, and M6 are released. This rotating operation may be performed by a producer before the connector 101 is shipped or by a user after the connector is shipped and before the connector is used.

In this manner, the connector 101 according to the present embodiment can be produced by integrally molding the terminals 120, and the metal parts 150, 160, and 170 at the same time as the housing 110 and the movable member 140 and by moving the movable member 140 between the open position and the closed position. Therefore, it is no longer necessary to process the components of the connector at all after the integral molding. In the present embodiment, the connector 101 can be produced easily with fewer steps. Since the steps are fewer, the connector 101 can be produced at lower cost.

Figure 19A:
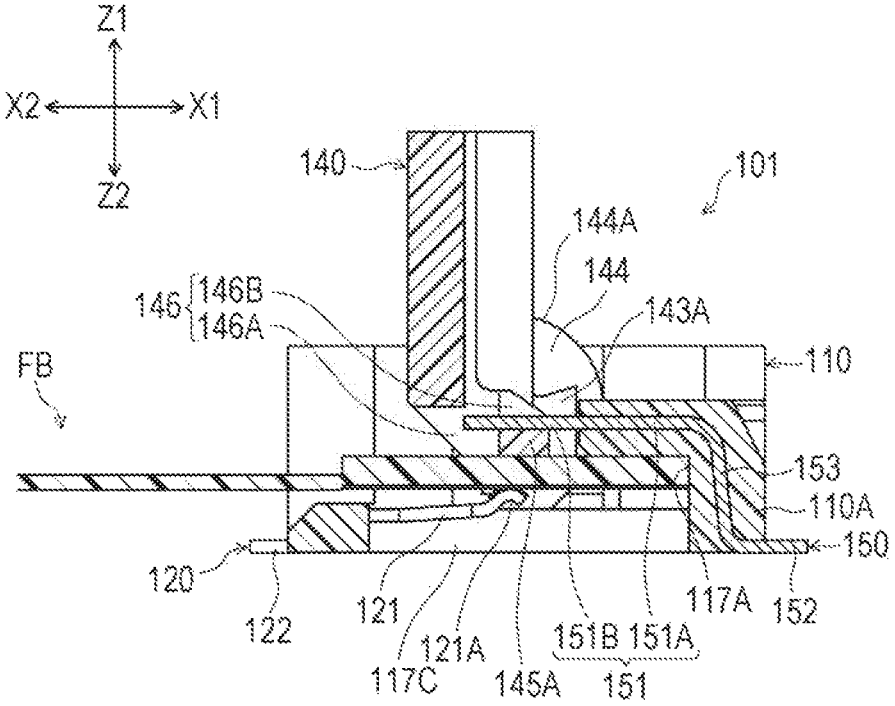
Figure 19B:
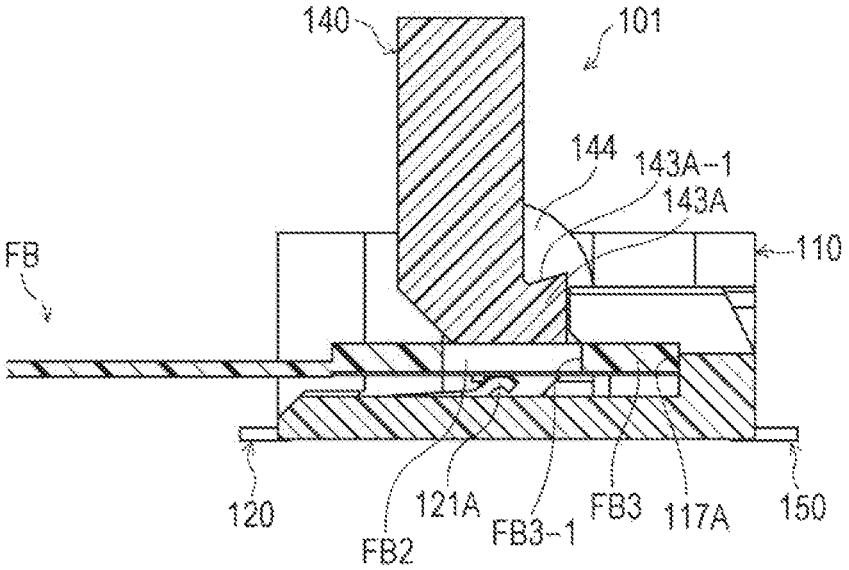
Figure 20B:
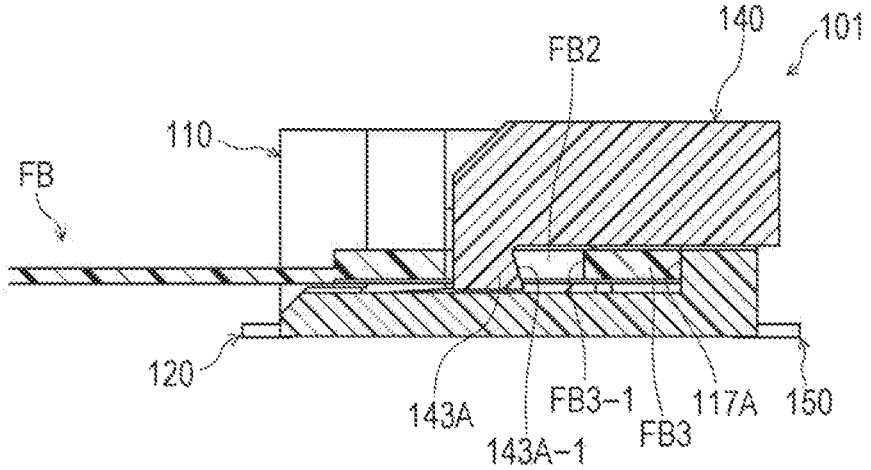

Next, the operation of connecting the connector 101 and the flat conductor FB is described with reference to FIG. 18A, FIG. 18B, FIG. 19A, FIG. 19B. FIG. 20A, and FIG. 20B. FIG. 18A and FIG. 18B are cross-sectional views of the connector 101 just before the flat conductor FB is inserted. FIG. 19A and FIG. 19B are cross-sectional views of the connector 101 when the flat conductor FB has been inserted. FIG. 20A and FIG. 20B are cross-sectional views of the connector 101 taken along a plane perpendicular to the connector width direction just before the flat conductor FB is removed. FIG. 18A, FIG. 19A, and FIG. 20A are the cross-sectional views at the position of the first metal part 150. FIG. 18B, FIG. 19B, and FIG. 20B are the cross-sectional views at the position of the engaging part 143A of the movable member 140. As illustrated in FIG. 20A, the upper surface of the flat conductor FB is pressed by the lower part of the first shaft part 145A. As a result, the contact arm part 121 of the terminal 120 is elastically deformed, so that the contact pressure between the circuit part of the flat conductor FB and the contact part 121A of the terminal 120 is increased.

First, the connection part 122 of the terminal 120 of the connector 101 is connected by soldering to the corresponding circuit part of the circuit board (not shown). In addition, the first fixing part 152 of the first metal part 150, the second fixing part 162 of the second metal part 160, and the third fixing part 172 of the third metal part 170 are connected by soldering to the corresponding part of the circuit board. By the solder connection of the fixing parts 152, 162, and 172, the housing 110 is fixed to the circuit board.

Next, as illustrated in FIG. 18A and FIG. 18B, the flat conductor FB is positioned so as to be extended in the front-rear direction along the mount surface of the circuit board (not shown) behind the connector 101 with the movable member 140 at the open position (also see FIG. 11). Next, the flat conductor FB, which is directed to the front, is inserted into the reception part 117A of the connector 101.

In the process of inserting the flat conductor FB to the reception part 117A, the front end of the flat conductor FB is in contact with the contact part 121A of the contact arm part 121 of the terminal 120 as illustrated in FIG. 19A. The front end of the flat conductor FB presses down the contact part 121A with the downward component force of the contact force. Here, the contact arm part 121 is elastically deformed downward as illustrated in FIG. 19A.

The flat conductor FB is inserted until the front end of the flat conductor FB is brought into contact with the rear surface of the front frame part 110A of the housing 110 (see FIG. 19A and FIG. 19B). As illustrated in FIG. 19A and FIG. 19B, the contact arm part 121 of the terminal 120 remains elastically deformed even after the flat conductor FB is inserted. As a result, the contact part 121A of the contact arm part 121 remains in pressure contact with the connection circuit part exposed on the lower surface of the flat conductor FB.

Next, as illustrated in FIG. 20A and FIG. 20B, the movable member 140 is rotated so as to be brought to the closed position. Here, as illustrated in FIG. 20B, the engaging part 143A of the movable member 140 is caused to enter the cut part FB2 of the flat conductor FB. As a result, the engaged part FB3-1 of the flat conductor FB is positioned ahead of the engaging surface 143A-1 of the engaging part 143A so as to be engaged with the engaging surface 143A-1. Therefore, the release of the flat conductor FB to the rear is suppressed. In this manner, rotating the movable member 140 to the closed position completes the operation of connecting the connector 101 and the flat conductor FB.

When the flat conductor FB in the state illustrated in FIG. 20A and FIG. 20B, that is, in the state of being connected to the connector 101 is removed from the connector 101 on purpose, the movable member 140 at the closed position is rotated to make the movable member 140 come to the open position illustrated in FIG. 19A and FIG. 19B. As illustrated in FIG. 19B, when the movable member 140 is at the open position, the engaging part 143A of the movable member 140 is positioned so as to be released upward from the cut part FB2 of the flat conductor FB. That is to say, the engaging part 143A is disengaged from the engaged part FB3-1 of the flat conductor FB so that the flat conductor FB can be released to the rear. Pulling the flat conductor FB to the rear in this state can remove the flat conductor FB from the connector 101 easily.

In the present embodiment, the movable member 140 includes the first shaft part 145A and the second shaft part 145B as the movement restricted parts. In addition, the first metal part 150 includes the first narrow arm part 151B as the first metal part side restricting part. Moreover, the second metal part 160 includes the second metal part side restricting part 161C. However, it is not always necessary to provide both a combination between the first shaft part 145A and the first narrow arm part 151B (referred to as "first combination") and a combination between the second shaft part 145B and the second metal part side restricting part 161C (referred to as "second combination"). For example, just the first combination may be provided.

Third Embodiment

A connector according to a third embodiment is a connector that is disposed on the mount surface of the circuit board and has the flat conductor removably connected thereto in a front-rear direction that is parallel to the mount surface. The connector according to the third embodiment includes the housing to which the flat conductor is inserted, the terminals and the metal parts held by the housing, and the movable member that is rotatable relative to the housing. The connector according to the third embodiment is common to the connector according to the second embodiment in these points. On the other hand, the connector according to the third embodiment is different from the connector according to the second embodiment in that, for example, the upward movement of the movable member is restricted by the terminal and only one kind of metal part is included. The structure of the connector according to the third embodiment is described mainly about the point different from the connector according to the second embodiment.

Figure 21:
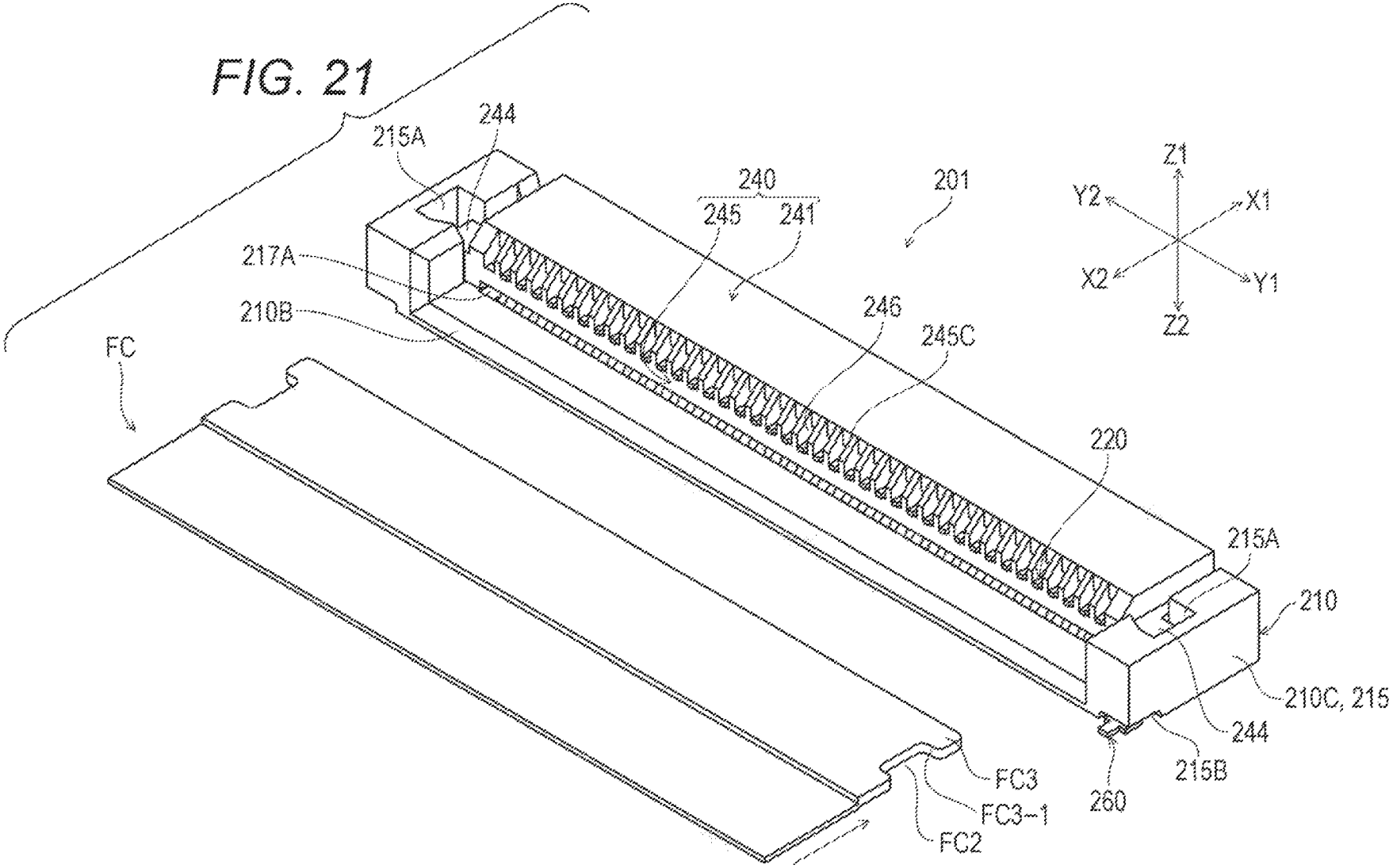
FIG. 21 is a perspective view of a flat conductor and an electric connector for a circuit board according to a third embodiment in a state just before the flat conductor is inserted.

FIG. 21 is a perspective view illustrating a flat conductor FC and an electric connector for a circuit board according to the present embodiment (this connector is hereinafter referred to as "connector 201") in a state just before the flat conductor FC is inserted. The flat conductor FC according to the present embodiment has the same shape as the flat conductor FB according to the second embodiment. Therefore, the corresponding part of the flat conductor FC is denoted by the reference symbol of the flat conductor FB with the letter B replaced by C and the same description is omitted.

Figures 22A, 22B:
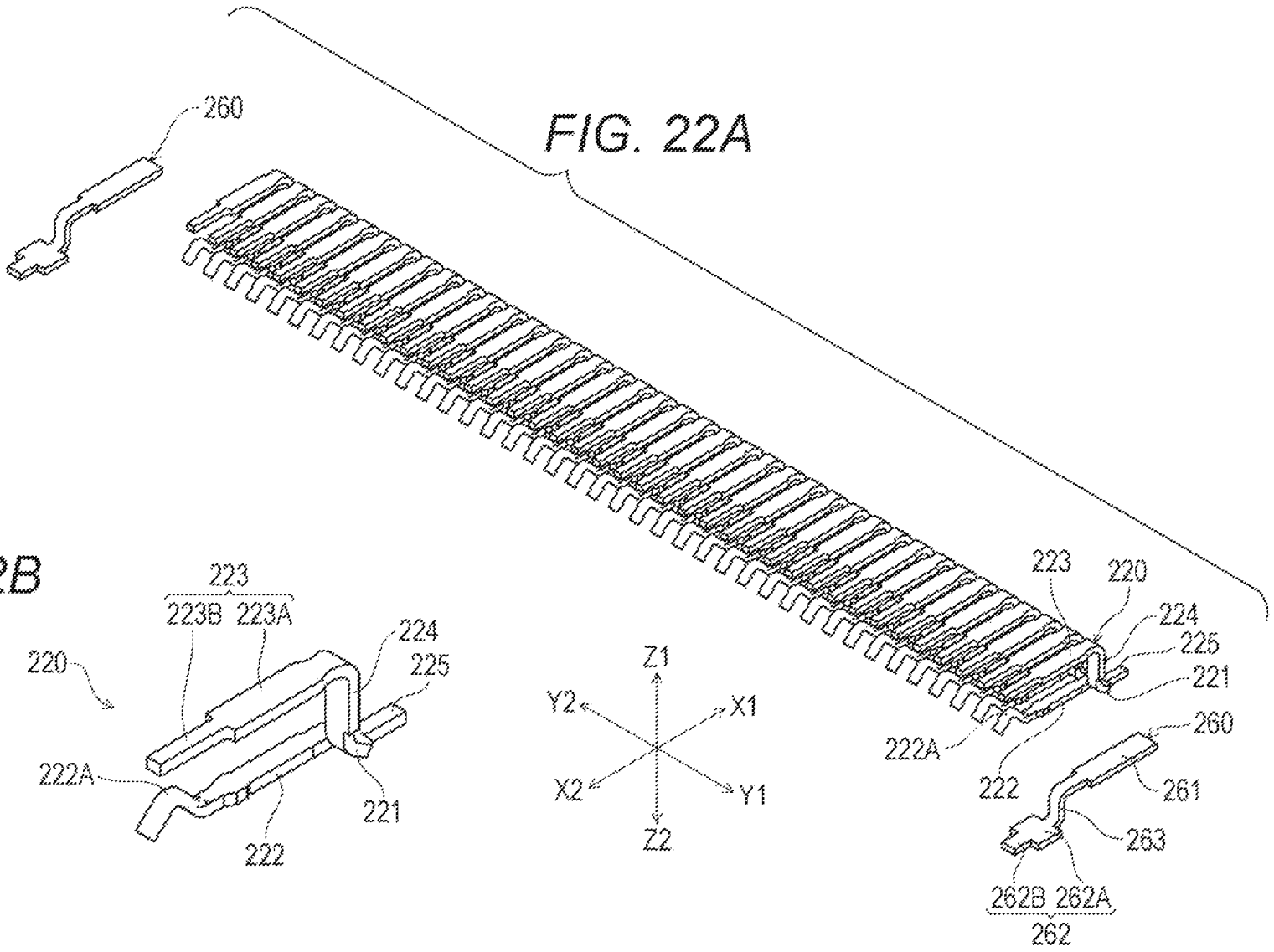
FIG. 22A is a perspective view illustrating terminals and metal parts extracted from the electric connector for a circuit board in FIG. 21.
FIG. 22B is a perspective view of the terminal alone.

The connector 201 includes a housing 210 and a movable member 240, each of which is formed of an electrically insulating material, and terminals 220 and metal parts 260, each of which is formed of a metal member held by the housing 210 by the integral molding (see also FIG. 22A and FIG. 22B).

In the present embodiment, the components of the housing 210 that correspond to those of the housing 110 according to the second embodiment are denoted by the reference symbols of the components of the housing 110 to which "100" is added. The housing 210 includes a front frame part 210A (see FIG. 23A), a rear frame part 210B, and a side frame part 210C as illustrated in FIG. 21 in a manner similar to the housing 110 according to the second embodiment. The side frame part 210C includes a housing hole part 215A for housing an end plate part 244 and a second shaft part 245B of the movable member 240, which are described below. The housing hole part 215A is formed as a space at a position near a rear end of a side wall 215 of the side frame part 210C, the space penetrating in the up-down direction and being open inward in the connector width direction. In addition, the housing 210 includes a reception part 217A for receiving the front end part of the flat conductor FC. The reception part 217A is formed to open to the rear at the position above the rear frame part 210B and below the movable member 240.

Figure 23A:
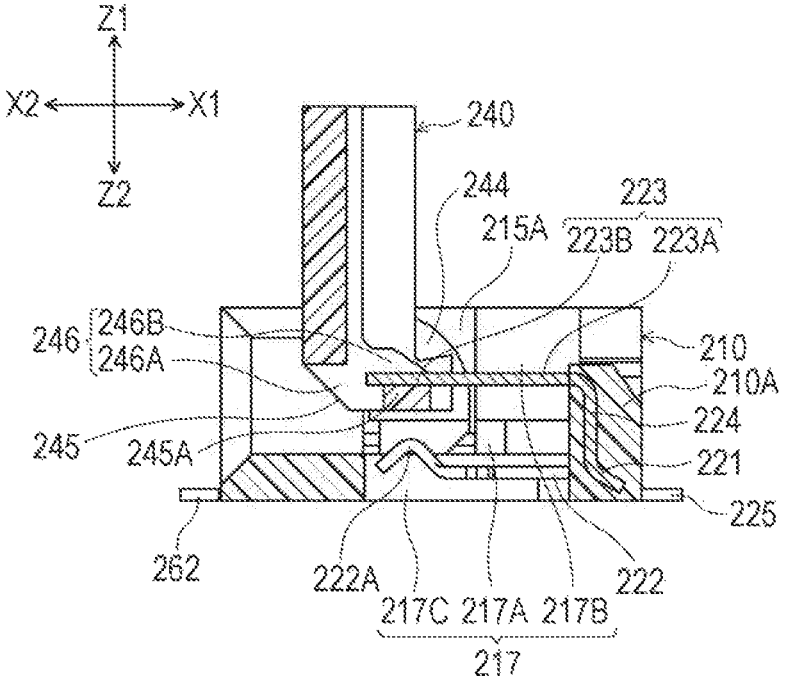

In addition, the housing 210 includes a housing concave part 217B for housing the movable member 240 above the reception part 217A (see FIG. 23A). The housing concave part 217B is formed as a space penetrating in the up-down direction and being open to the rear as illustrated in FIG. 23A. The housing concave part 217B communicates with the reception part 217A in the up-down direction and houses the most part of a rotation base part 245 of the movable member 240. At the position corresponding to an upper arm part 223, which is described below, of the terminal 220 in the terminal arranging direction, the housing concave part 217B serves as the housing part for housing a first shaft part 245A corresponding to the movement restricted part of the movable member 240 and a narrow arm part 223B of the upper arm part 223 of the terminal 220 corresponding to a terminal side restricting part as illustrated in FIG. 23A.

As illustrated in FIG. 21, the rear frame part 210B does not hold the terminals 220. The rear frame part 210B is larger in the front-rear direction than the rear frame part 110B of the housing 110 according to the second embodiment. The side wall 215 of the side frame part 210C includes a bottom concave part 215B for housing a fixing part 262 of the metal part 260. The bottom concave part 215B is formed by cutting a lower surface of the side wall 215 at a position near a rear end of the side wall 215.

The connector 201 according to the present embodiment includes one kind of terminals 220. The terminal 220 is formed by bending a metal plate member in the plate thickness direction. As illustrated in FIG. 21, the terminals 220 are arranged and held by the housing 210 in the range of the reception part 217A of the housing 210 in the connector width direction (see FIG. 22A).

As illustrated in FIG. 22A and FIG. 22B, the terminal 220 includes a base part 221, a contact arm part 222, an upper arm part 223, a coupling part 224, and a connection part 225. The base part 221 is held by the front frame part 210A (see FIG. 23A). The contact arm part 222 is extended to the rear from a rear end of the base part 221 on the Y2 side in the connector width direction. The upper arm part 223 is positioned above the contact arm part 222 and is extended to the rear at a position displaced from the contact arm part 222 to the Y1 side in the connector width direction. The coupling part 224 is extended in the up-down direction. The coupling part 224 couples between a front end of the upper arm part 223 and a rear end of the part of the base part 221 on the Y1 side in the connector width direction. The connection part 225 is extended to the front from the front end of the base part 221.

As illustrated in FIG. 23A, the contact arm part 222 is extended to the rear within a bottom hole part 217C of the housing 210. The contact arm part 222 is elastically deformable in the up-down direction. The contact arm part 222 includes a contact part 222A at a position near a rear end. The contact part 222A is formed to be bent in a manner of projecting upward. The contact part 222A is positioned within the reception part 217A. The contact part 222A can be in pressure contact with the connection circuit part formed on the lower surface of the flat conductor FB.

The upper arm part 223 is extended to the rear until substantially the same position as the rear end of the contact arm part 222 within the housing concave part 217B of the housing 210. As illustrated in FIG. 22A and FIG. 22B, an approximately first half part of the upper arm part 223 constitutes a wide arm part 223A and an approximately latter half part of the upper arm part 223 constitutes a narrow arm part 223B corresponding to the terminal side restricting part. The dimension of the narrow arm part 223B in the connector width direction is smaller than the wide arm part 223A. The upper arm part 223 includes a part that is extended more to the front and to the rear than the first shaft part 245A of the movable member 240. In this part, a rolled surface is exposed. The narrow arm part 223B enters the entry allowing part 246 of the movable member 240 from the front. The narrow arm part 223B is positioned above the first shaft part 245A of the movable member 240 corresponding to the rotation shaft part.

The narrow arm part 223B is positioned above the first shaft part 245A when the movable member 240 is disposed at any angle position in the rotating direction. The narrow arm part 223B in contact with the first shaft part 245A restricts the upward movement of the first shaft part 245A or the movable member 240. The narrow arm part 223B restricts the upward disconnection of the movable member 240 from the housing 210 (see FIG. 23A). In the present embodiment, the lower surface of the narrow arm part 223B is in surface contact with the upper surface of the first shaft part 245A when the movable member 240 is either at the open position (see FIG. 23A) or at the closed position.

In the present embodiment, the narrow arm part 223B is positioned in contact with the first shaft part 245A. Alternatively, the narrow arm part 223B may be positioned with some space in the up-down direction from the first shaft part 245A. In this case, the narrow arm part 223B restricts the upward movement of the first shaft part 245A over a predetermined amount corresponding to the size of the aforementioned space.

As illustrated in FIG. 23A, the coupling part 224 is extended in the up-down direction inside the front frame part 210A of the housing 210. The coupling part 224 and the base part 221 are together embedded in and held by the front frame part 210A. The connection part 225 is extended to the front from the lower part of the front frame part 210A. The connection part 225 is connected by soldering to a circuit part of a circuit board (not shown) on the lower surface thereof.

The movable member 240 has the shape similar to that of the movable member 140 according to the second embodiment. However, as illustrated in FIG. 21, in the movable member 240, the width of the entry allowing part 246 that allows the entry of the narrow arm part 223B of the terminal 220 is smaller than the width of the entry allowing part 146 of the movable member 140 in the second embodiment. In this point, the movable member 240 is different from the movable member 140. The components of the movable member 240 that correspond to those of the movable member 140 according to the second embodiment are denoted by the reference symbols of the components of the movable member 140 to which "100" is added and thus, the detailed description is omitted.

The metal part 260 is provided at the same position as the housing hole part 215A of the housing 210 and the second shaft part 245B of the movable member 240 corresponding to the rotation shaft part. As illustrated in FIG. 22A, the metal part 260 is formed by bending a metal plate member in the plate thickness direction. The metal part 260 includes a lower arm part 261, the fixing part 262, and a coupling part 263. The lower arm part 261 is extended in the front-rear direction (X-axis direction). The fixing part 262 is extended to the rear at a position lower than the lower arm part 261. The coupling part 263 couples between a rear end of the lower arm part 261 and a front end of the fixing part 262. The metal part 260 has an approximately crank shape as a whole. The coupling part 263 is shorter than the coupling part 224 of the terminal 220 in the up-down direction. As a result, the lower arm part 261 of the metal part 260 is positioned below the upper arm part 223 of the terminal 220.

Figure 24A:
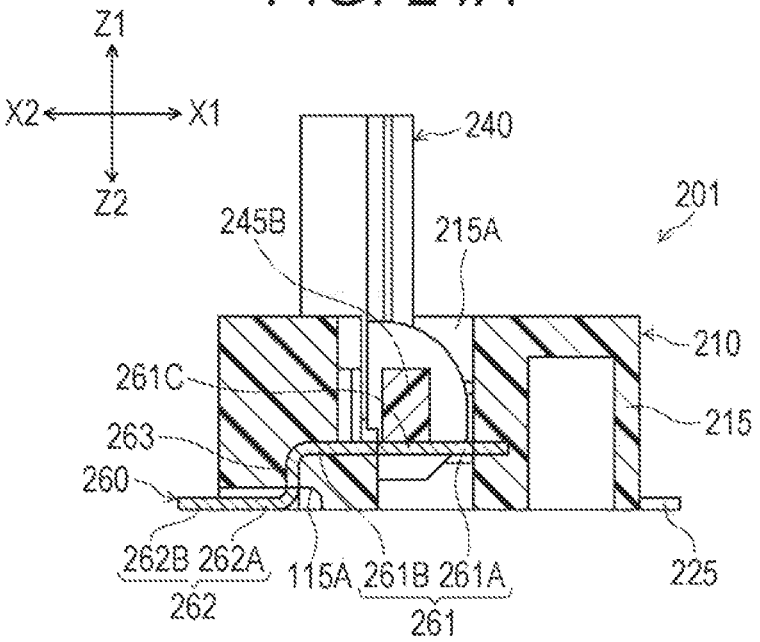

As illustrated in FIG. 22A, a rear end part of the lower arm part 261 has the same size in the connector width direction (width) as the coupling part 224. That is to say, the rear end part of the lower arm part 261 is narrower than the other part of the lower arm part 261. In the present embodiment, the lower arm part 261 is extended in the range including the housing hole part 215A of the housing 210 in the front-rear direction at the intermediate position of the housing 210 in the up-down direction as illustrated in FIG. 24A. The front end part and the rear end part of the lower arm part 261 are held by the side wall 215 of the housing 210 by the integral molding. The lower arm part 261 includes a part that is extended more to the front and to the rear than the second shaft part 245B of the movable member 240. In this part, a rolled surface is exposed.

As illustrated in FIG. 24A, in the lower arm part 261, an intermediate part positioned in the housing hole part 215A in the front-rear direction is exposed. This exposed part forms a metal part side restricting part 261C for restricting the movement of the second shaft part 245B of the movable member 240. The metal part side restricting part 261C is positioned below the second shaft part 245B of the movable member 240 and restricts the downward movement of the second shaft part 245B or the movable member 240 when the movable member 240 is disposed at any angle position. Thus, the metal part side restricting part 261C restricts the downward disconnection of the movable member 240 from the housing 210. In the present embodiment, the upper surface of the metal part side restricting part 261C is in surface contact with the lower surface of the second shaft part 245B when the movable member 240 is either at the open position (see FIG. 24A) or at the closed position.

In the present embodiment, the metal part side restricting part 261C is positioned in contact with the second shaft part 245B. Alternatively, the metal part side restricting part 261C may be positioned with some space in the up-down direction from the second shaft part 245B. In this case, the metal part side restricting part 261C restricts the downward movement of the second shaft part 245B over a predetermined amount corresponding to the size of the aforementioned space.

In the present embodiment, the lower arm part 261 of the metal part 260 is held by the housing 210 at a front end part and a rear end part thereof. Thus, the lower arm part 261 is held by the housing 210 at a position near both longitudinal ends of the metal part side restricting part 261C. That is to say, the metal part side restricting part 261C is held in the double fixed beam shape. Therefore, when the movement of the second shaft part 245B of the movable member 240) is restricted by the metal part side restricting part 261C, the metal part side restricting part 261C can resist against the contact force of the second shaft part 245B with enough strength.

As illustrated in FIG. 24A, the coupling part 263 is embedded in and held by the side wall 215 of the housing 210 by the integral molding. The fixing part 262 includes a wide fixing part 262A that is formed in a first half part and a narrow fixing part 262B that is formed in a latter half part and narrower than the wide fixing part 262A as illustrated in FIG. 22A. As illustrated in FIG. 24A, the wide fixing part 262A is positioned in the bottom concave part 215B of the side wall 215. The narrow fixing part 262B is extended to the rear to the outside of the side wall 215. The fixing part 262 is connected by soldering to the corresponding part of the circuit board (not shown) on the lower surface thereof.

The connector 201 with the structure as above is produced in accordance with the following procedure.

First, the terminals 220 and the metal parts 260 are disposed in a die (upper die M7, lower die M8, and rear die M9 to be described below) and held by the die in a manner that the rolled surfaces of these members are parallel to the connector width direction (see FIG. 22A). Specifically, the upper arm parts 223 of the terminals 220 and the lower arm parts 261 of the metal parts 260 are held by the upper die M7 disposed from above, the lower die M8 disposed from below, and the rear die M9 disposed from behind.

Figure 23B:
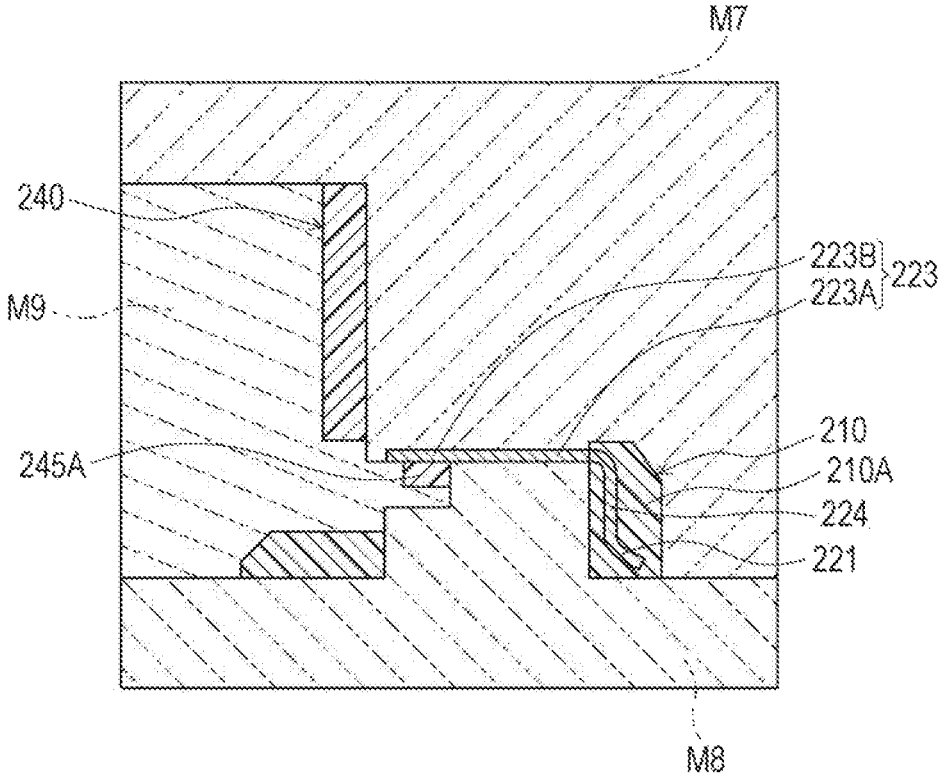

Here, as illustrated in FIG. 23B, the upper die M7 is in contact with the entire upper surface of the upper arm part 223 of the terminal 220. The lower die M8 and the rear die M9 are respectively in contact with an approximately front half area and a rear end area on the lower surface of the upper arm part 223 of the terminal 220. Thus, the upper surface and the lower surface of the upper arm part 223, which are the flat rolled surfaces, are used as the contact surfaces to be in contact with the dies. As a result, the space for forming the first shaft part 245A is formed surrounded by the upper arm part 223, the lower die M8, and the rear die M9 as illustrated in FIG. 23B.

Figure 24B:
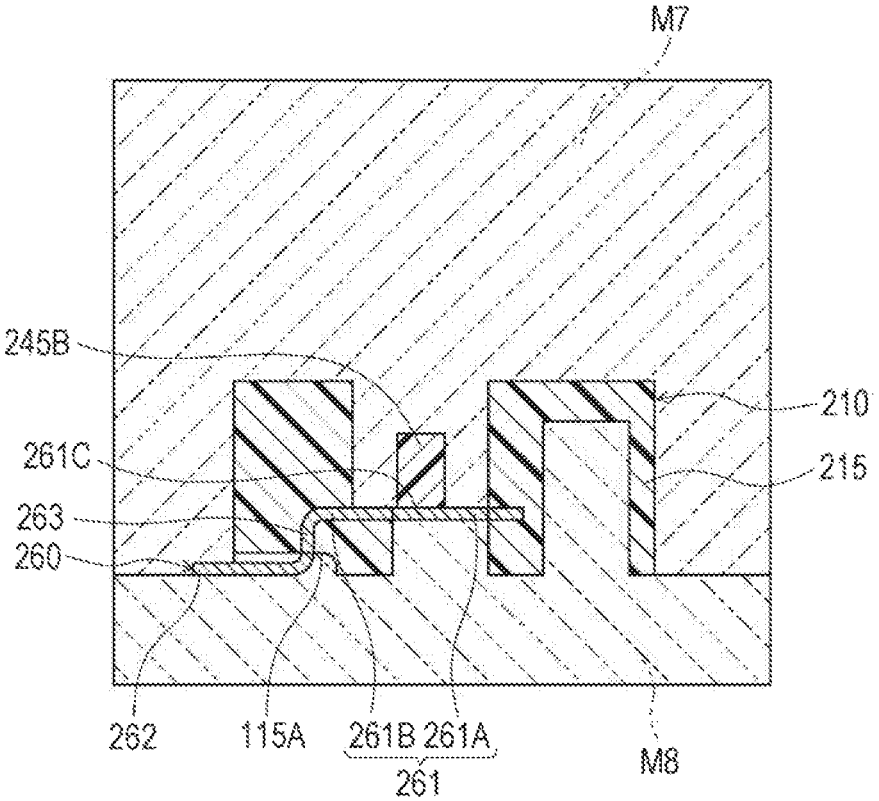

As illustrated in FIG. 24B, the upper die M7 is in contact with an area near the front end and an area near the rear end on the upper surface of the lower arm part 261 of the metal part 260. The space for forming the second shaft part 245B is formed surrounded by the lower arm part 261 and the upper die M7. As illustrated in FIG. 24B, the lower die M8 is in contact with an intermediate area in the front-rear direction on the lower surface of the lower arm part 261 of the metal part 260. Thus, the upper surface and the lower surface of the lower arm part 261, which are the flat rolled surfaces, are used as the contact surfaces to be in contact with the dies.

Next, an electrically insulating material that is melted is injected into the die and solidified, and thus the housing 210 and the movable member 240 are molded at the same time. In addition, the terminals 220 and the metal parts 260 are held by the housing 210 by the integral molding. As a result of this integral molding, at the position of the upper arm part 223 of the terminal 220 in the connector width direction, the first shaft part 245A of the movable member 240 is formed with the upper surface thereof in contact with the lower surface of the narrow arm part 223B of the upper arm part 223 in the space surrounded by the lower surface (rolled surface) of the narrow arm part 223B, the lower die M8, and the rear die M9 as illustrated in FIG. 23B. As illustrated in FIG. 23B, the movable member 240 is molded while the movable member 240 is at the open position. In addition, as illustrated in FIG. 24B, the metal part side restricting part 261C constituting a part of the lower arm part 261 of the metal part 260 is formed in the housing hole part 215A of the housing 210 at the position of the metal part 260 in the connector width direction. Furthermore, the second shaft part 245B of the movable member 240 is formed with the lower surface thereof in contact with the upper surface of the metal part side restricting part 261C in the space surrounded by the upper surface (rolled surface) of the metal part side restricting part 261C, and the upper die M7.

Next, the upper die M7 is moved upward (Z1 direction), the lower die M8 is moved downward (Z2 direction), and the rear die M9 is moved to the rear (X2 direction), all of which are moved straight, so that the dies M7, M8, and M9 are released. After the dies M7, M5, and M9 are released, the operation of rotating the movable member 240 from the open position to the closed position is performed. Thus, the first shaft part 245A of the movable member 240 can be separated from the lower surface of the narrow arm part 223B corresponding to the terminal side restricting part of the terminal 220. This operation can cause the second shaft part 245B of the movable member 240 to be separated from the upper surface of the metal part side restricting part 261C of the metal part 260 and also make the movable member 240 movable. Thus, the connector 201 is completed and becomes usable. Here, the lower surface of the narrow arm part 223B and the upper surface of the metal part side restricting part 261C are rolled surfaces and smooth. Therefore, it is easy to separate the first shaft part 245A and the second shaft part 245B. This operation of rotating the movable member 240 may be performed in any stage after the dies M7, M8, and M9 are released. This rotating operation may be performed by a producer before the connector 201 is shipped or by a user after the connector is shipped and before the connector is used.

The connector 201 according to the present embodiment can be produced by integrally molding the terminals 220 and the metal parts 260 at the same time as the housing 210 and the movable member 240 and by moving the movable member 240 between the open position and the closed position. Therefore, it is no longer necessary to process the components of the connector at all after the integral molding. In the present embodiment, the connector 201 can be produced easily with fewer steps. Since the steps are fewer, the connector 201 can be produced at lower cost.

The operation of connecting the connector 201 and the flat conductor FC is similar to the operation of connecting the connector 101 and the flat conductor FB in the second embodiment, and therefore, the description is omitted.

In the present embodiment, the movable member 240 includes the first shaft part 245A and the second shaft part 245B as the movement restricted parts. In addition, the terminal 220 includes the narrow arm part 223B as the terminal side restricting part. Moreover, the metal part 260 includes the metal part side restricting part 261C. However, it is not always necessary to provide both a combination between the first shaft part 245A and the narrow arm part 223B (referred to as "first combination") and a combination between the second shaft part 245B and the metal part side restricting part 261C (referred to as "second combination"). For example, just the first combination may be provided.

In the first to third embodiments, the movable member is movable by rotation between the first position and the second position. However, the movement of the movable member is not limited to this rotation. The movable member may be, for example, a movable member that can slide. This type of movable member is movable between the first position and the second position in any one of the insertion/removal direction of the flat conductor, the connector width direction, and the connector thickness direction.

In the first to third embodiments, the housing part of the housing houses the entire movement restricted part of the movable member and the entire movement restricting part of the metal member. In this point, it is not always necessary that the entire movement restricted part and the entire movement restricting part are housed in the housing part. Just a part of the movement restricted part may be housed in the housing part and/or just a part of the movement restricting part may be housed in the housing part The connector according to any of the first to third embodiments has the flat conductor removably connected thereto in the direction parallel to the mount surface of the circuit board. However, the connector to which the technology according to the present disclosure is applied is not limited to this type. For example, the technology according to the present disclosure is also applicable to a connector that allows the flat conductor to be removably connected in a direction perpendicular to the mount surface of the circuit board, that is, a connector whose connector width direction and connector thickness direction are parallel to the mount surface of the circuit board.

In the first to third embodiments, the housing part for housing the movement restricted part and the movement restricting part is formed in the penetration space penetrating the housing. In this point, it is not always necessary that the housing part is formed in the penetration space. For example, the housing part may be a space outside the housing that communicates with the penetration space along the up-down direction and is open in the up-down direction, or a space continuing to both the space and the penetration space.

In the first to third embodiments, the housing part is formed to penetrate the housing in the up-down direction corresponding to the restricted direction where the movement of the movement restricted part is restricted by the movement restricting part. In this point, the housing part only needs to be open along the restricted direction. For example, if the restricted direction is the front-rear direction, the housing part may be formed to penetrate the housing in the front-rear direction. In this case, the housing part is formed by the release of the dies disposed in the front-rear direction.

In the above description, the terms "vertical", "perpendicular", "orthogonal", "parallel", planar", and the like do not strictly mean "vertical", "perpendicular", "orthogonal", "parallel", "planar", and the like. That is to say, these terms "vertical", "perpendicular", "orthogonal", "parallel", "planar", and the like allow an error or tolerance in the design and production, and mean "substantially vertical", "substantially perpendicular", "substantially orthogonal", "substantially parallel", "substantially planar", and the like.

In the above description, the terms "identical". "same", "equal", "different", and the like about the dimension, size, shape, position, and the like of the external appearance of the member do not strictly mean "identical", "same", "equal", "different", and the like. That is to say, these terms "identical", "same", "equal", "different", and the like allow an error or tolerance in the design and production, and mean "substantially identical", "substantially same", "substantially equal", "substantially different", and the like.

Embodiments of the present disclosure may be the following first electric connector for a circuit board and first producing method for the electric connector for a circuit board.

The first electric connector for a circuit board is an electric connector for a circuit board that is mounted on a mount surface of a circuit board and has a flat conductor removably connected thereto in a front-rear direction, and has a connector width direction coinciding with a width direction of the flat conductor and a connector thickness direction coinciding with a direction perpendicular to the front-rear direction and the connector width direction, the first electric connector including: a housing including a reception part corresponding to a space that is open so that the flat conductor can be inserted toward front; a plurality of metal members that are held by the housing by integral molding; and a movable member that is movable relative to the housing, the movable member being movable between a first position and a second position, wherein the movable member includes a movement restricted part whose movement in a direction perpendicular to the connector width direction is restricted; the metal members include a plurality of terminals used to connect to the flat conductor; at least a part of the metal members is formed of a rolled metal plate, includes a rolled surface that is parallel to the connector width direction, and a part of the metal members is exposed more than the movement restricted part from the housing in a range including the movement restricted part in the front-rear direction at a position corresponding to the movement restricted part in the connector width direction; the exposed part includes a movement restricting part that restricts movement of the movement restricted part over a predetermined amount with the rolled surface of the exposed part facing the movement restricted part; the electric connector for a circuit board includes a housing part corresponding to a space for housing at least a part of the movement restricted part and at least a part of the movement restricting part in a range corresponding to the movement restricted part and the movement restricting part in the connector width direction; and the housing part is formed in at least one of a penetration space that penetrates the housing in a restricted direction corresponding to a direction where the movement of the movement restricted part is restricted by the movement restricting part and a space that communicates with the penetration space in the restricted direction outside the housing.

The first producing method for an electric connector for a circuit board is a producing method for an electric connector for a circuit board that is mounted on a mount surface of a circuit board, has a flat conductor removably connected thereto in a front-rear direction, and has a connector width direction coinciding with a width direction of the flat conductor, the electric connector including a housing including a reception part corresponding to a space that is open so that the flat conductor can be inserted toward front, a plurality of metal members that include a plurality of terminals for connection to the flat conductor and are held by the housing by integral molding, and a movable member that is movable relative to the housing, the movable member being movable between a first position and a second position, the producing method including: disposing a plurality of metal members formed of a rolled metal plate in a die so that rolled surfaces of the metal members are parallel to the connector width direction; holding a part of the metal members by the die and exposing another part of the metal members into the die; injecting an electrically insulating material that is melted into the die and solidifying the material, and with a part of the metal members exposed, holding another part of the metal members by the housing by integral molding; forming a movement restricting part that restricts movement of the movable member in a direction perpendicular to the connector width direction with the exposed part of the metal member; forming a movement restricted part whose movement is restricted by the movement restricting part in a part of the movable member in surface contact with the rolled surface of the movement restricting part; and after releasing the die, moving the movable member between the first position and the second position so that the movement restricted part of the movable member is separated from the movement restricting part of the metal member and the movable member is made movable.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electric connector for a circuit board, comprising:

a housing including a reception part corresponding to a space that is open so that a flat conductor to be removably connected to the electric connector for a circuit board in a front-rear direction can be inserted in the space toward front;

a plurality of metal members that are held by the housing by integral molding; and a movable member that is movable relative to the housing, wherein:

the movable member is movable between a first position and a second position;

the movable member includes a movement restricted part whose movement in a direction perpendicular to a connector width direction that corresponds to a width direction of the flat conductor is restricted;

the metal members include a plurality of terminals used to connect to the flat conductor;

at least a part of the metal members is formed of a rolled metal plate, includes a rolled surface that is parallel to the connector width direction, and includes an exposed part that is exposed from the housing more than the movement restricted part in a range including the movement restricted part in the front-rear direction at a position corresponding to the movement restricted part in the connector width direction, the rolled surface of the exposed part faces the movement restricted part, and the exposed part includes a movement restricting part that restricts movement of the movement restricted part over a predetermined amount;

the electric connector for a circuit board includes a housing part corresponding to a space for housing at least a part of the movement restricted part and at least a part of the movement restricting part in a range corresponding to the movement restricted part and the movement restricting part in the connector width direction; and the housing part is formed in at least one of a penetration space that penetrates the housing in a restricted direction corresponding to a direction where the movement of the movement restricted part is restricted by the movement restricting part and a space that communicates with the penetration space in the restricted direction outside the housing.

2. The electric connector for a circuit board according to claim 1, wherein:

the movable member is movable with rotation around a rotation axial line extended in the connector width direction between the first position and the second position;

the movable member includes a rotation base part in a part including the rotation axial line, the rotation base part including a rotation shaft part; and the movement restricted part is provided to the rotation shaft part.

3. The electric connector for a circuit board according to claim 2, wherein the rolled surface of the movement restricting part of the metal member has a shape extended along a peripheral surface of the rotation shaft part of the movable member and is in contact with the peripheral surface, and the movement restricting part can guide rotation of the rotation shaft part.

4. The electric connector for a circuit board according to claim 2, wherein:

the rotation shaft part of the movable member includes a large diameter part including a curved surface with an arc-like shape in a part of the rotation shaft part in a circumferential direction, and includes a small diameter part including a curved surface with an arc-like shape that is smaller in diameter than the large diameter part in another part in the circumferential direction; and the movement restricting part of the metal member is curved with an arc-like shape along the curved surface of the large diameter part.

5. The electric connector for a circuit board according to claim 1, wherein the movable member is movable along any one of an insertion/removal direction of the flat conductor, the connector width direction, and a connector thickness direction corresponding to a direction perpendicular to the front-rear direction and the connector width direction between the first position and the second position.

6. The electric connector for a circuit board according claim 1, wherein:

the movement restricting part of the metal member has a belt-like plate shape that is extended in a direction where opposite inner wall surfaces face each other in one direction in a plane perpendicular to the connector width direction in the housing part; and the metal member is held by the housing at a position near both ends of the movement restricting part in the direction where the movement restricting part is extended.

7. The electric connector for a circuit board according to claim 1, wherein:

the movable member includes an engaging part for inhibiting removal of the flat conductor, and the engaging part includes, in a rear part thereof, a guiding surface for guiding the flat conductor to the front in a process of inserting the flat conductor with the movable member present at the first position, and also includes, in a front part thereof, an engaging surface that can be engaged with an engaged part provided to the flat conductor from the rear after the flat conductor is inserted; and the guiding surface is extended to the connector thickness direction when viewed in the connector width direction with the movable member present at the second position.

8. The electric connector for a circuit board according to claim 2, wherein:

the terminal includes a contact arm part that is extended to the rear, the contact arm part including a contact part that is formed at a rear end part thereof and that can be in contact with the flat conductor;

the rotation base part of the movable member is positioned behind the contact part when viewed in the connector width direction; and the rotation base part of the movable member includes a groove part for housing a rear end of at least a part of the terminals at a position corresponding to the contact arm part of the terminal in the connector width direction.

9. The electric connector for a circuit board according to claim 8, wherein:

the terminals include a first terminal and a second terminal with different shapes;

the first terminal has its rear end housed in the groove part of the movable member; and a second contact arm part corresponding to the contact arm part of the second terminal has its rear end positioned ahead of a rear end of a first contact arm part corresponding to the contact arm part of the first terminal, the rear end of the second contact arm part being positioned in a range of the first contact arm part in the connector thickness direction.

10. The electric connector for a circuit board according to claim 8, wherein:

at least the terminal corresponding to a part of the terminals includes a held arm part that is held by the housing and that is extended to the rear along the contact arm part in a range including the rear end of the contact arm part in the front-rear direction;

the held arm part is positioned displaced in the connector width direction from the groove part in the range including the groove part of the movable member in the front-rear direction; and in the housing, a space that penetrates in the connector thickness direction in the range including the groove part is formed at a wall part that is positioned opposite to the contact arm part with respect to the held arm part in the connector thickness direction.

11. The electric connector for a circuit board according to claim 8, wherein:

at least a part of the terminals includes a held arm part that is held by the housing and that is extended to the rear along the contact arm part in a range including the contact part of the contact arm part in the front-rear direction;

the held arm part is positioned displaced in the connector width direction from the contact part in the range including the contact part in the front-rear direction; and in the housing, a space that penetrates in the connector thickness direction in the range including the contact part is formed at a wall part that is positioned opposite to the contact arm part with respect to the held arm part in the connector thickness direction.

12. The electric connector for a circuit board according to claim 1, wherein:

the movable member is movable with rotation around a rotation axial line extended in the connector width direction between the first position and the second position;

the movable member includes a rotation base part in a part including the rotation axial line, the rotation base part including a rotation shaft part;

the metal members include a plurality of metal parts in addition to the terminals;

the terminals are arranged in the connector width direction;

the metal parts include a first metal part that is positioned in a range where the terminals are arranged in the connector width direction;

the rotation shaft part of the movable member includes a first shaft part corresponding to the movement restricted part that is provided at a position corresponding to the first metal part in the connector width direction; and a first metal part side restricting part corresponding to the movement restricting part of the first metal part is positioned on one side with respect to the first shaft part of the movable member in the connector thickness direction.

13. The electric connector for a circuit board according to claim 12, wherein:

the metal parts include, in addition to the first metal part, a second metal part positioned outside the range where the terminals are arranged;

the rotation shaft part of the movable member includes, in addition to the first shaft part, a second shaft part corresponding to the movement restricted part that is provided at a position corresponding to the second metal part in the connector width direction; and a second metal part side restricting part corresponding to the movement restricting part of the second metal part is positioned on the other side with respect to the second shaft part of the movable member in the connector thickness direction.

14. The electric connector for a circuit board according to claim 12, wherein:

a penetration allowing part that allows penetration of the first metal part side restricting part of the first metal part is formed at a position corresponding to the first shaft part in the connector width direction in the rotation base part of the movable member; and the first metal part side restricting part is penetrated into the penetration allowing part, the first metal part side restricting part includes a free end part positioned outside the penetration allowing part, the free end part includes a protrusion protruding to the connector width direction, and the first metal part side restricting part is configured to be engaged with the rotation base part with the protrusion.

15. The electric connector for a circuit board according to claim 1, wherein:

the movable member is movable with rotation around a rotation axial line extended in the connector width direction between the first position and the second position;

the movable member includes a rotation base part in a part including a rotation axial line, the rotation base part including a rotation shaft part;

the terminals are arranged in the connector width direction;

the rotation shaft part of the movable member includes a first shaft part corresponding to the movement restricted part that is provided at a position corresponding to the terminal in the connector width direction; and a terminal side restricting part corresponding to the movement restricting part of the terminal is positioned on one side with respect to the first shaft part of the movable member in the connector thickness direction.

16. The electric connector for a circuit board according to claim 15, wherein:

the metal members include, in addition to the terminals, a plurality of metal parts positioned outside the range where the terminals are arranged in the connector width direction;

the rotation shaft part of the movable member includes, in addition to the first shaft part, a second shaft part corresponding to the movement restricted part that is provided at a position corresponding to the metal part in the connector width direction; and a metal part side restricting part corresponding to the movement restricting part of the metal part is positioned on the other side with respect to the second shaft part of the movable member in the connector thickness direction.

17. A producing method for an electric connector for a circuit board, the producing method comprising:

disposing a plurality of metal members formed of a rolled metal plate in a die so that rolled surfaces of the metal members are parallel to a connector width direction corresponding to a width direction of a flat conductor that is removably connected to the electric connector for a circuit board;

holding a part of the metal members by the die and exposing another part of the metal members into the die;

molding a housing and a movable member by injecting an electrically insulating material that is melted into the die and solidifying the material, and with a part of the metal members exposed, holding another part of the metal members by the housing by integral molding;

forming a movement restricting part that restricts movement of the movable member in a direction perpendicular to the connector width direction with the exposed part of the metal member;

forming a movement restricted part whose movement is restricted by the movement restricting part in a part of the movable member in surface contact with the rolled surface of the movement restricting part; and after releasing the die, moving the movable member between a first position and a second position so that the movement restricted part of the movable member is separated from the movement restricting part of the metal member and the movable member is made movable.

* * * * *